US011262155B2

(12) United States Patent
Vabnick

(10) Patent No.: US 11,262,155 B2
(45) Date of Patent: Mar. 1, 2022

(54) FLUID JET STABILIZING PROJECTILE FOR ENHANCED IED DISRUPTERS

(71) Applicant: Federal Bureau of Investigation, Washington, DC (US)

(72) Inventor: Ian B. Vabnick, Quantico, VA (US)

(73) Assignee: The United States of America as Represented by the Federal Bureau of Investigation, Department of Justice, Washington, DC (US)

( * ) Notice: Subject to any disclaimer, the term of this patent is extended or adjusted under 35 U.S.C. 154(b) by 0 days.

(21) Appl. No.: 16/987,942

(22) Filed: Aug. 7, 2020

(65) Prior Publication Data

US 2021/0041205 A1 Feb. 11, 2021

Related U.S. Application Data

(60) Provisional application No. 62/884,961, filed on Aug. 9, 2019.

(51) Int. Cl.

| | |
|---|---|
| ***F41B 9/00*** | (2006.01) |
| ***F42B 10/02*** | (2006.01) |
| ***F41H 11/12*** | (2011.01) |

(52) U.S. Cl.

CPC ..... *F41B 9/0087* (2013.01); *F41H 11/12* (2013.01); *F42B 10/02* (2013.01)

(58) Field of Classification Search

CPC ..... F41G 9/0087; F41H 11/12; F42B 10/02
USPC ..... 124/56
See application file for complete search history.

(56) References Cited

U.S. PATENT DOCUMENTS 2,491,516 A 12/1949 Piggot et al.
4,046,055 A * 9/1977 McDanolds ..... F42B 33/06 86/50
4,169,403 A * 10/1979 Hanson ..... F42B 33/062 102/293

(Continued)

FOREIGN PATENT DOCUMENTS

ES 2083894 A2 4/1996
GB 2083894 A2 3/1982

OTHER PUBLICATIONS

U.S. Appl. No. 17/138,661, filed Dec. 30, 2020.
U.S. Appl. No. 15/731,874, filed Aug. 18, 2017.

*Primary Examiner* — Samir Abdosh
(74) *Attorney, Agent, or Firm* — Leydig, Voit & Mayer, Ltd.

(57) ABSTRACT

A propellant driven disrupter (PDD) for disrupting an explosive target, comprising: a disrupter barrel having a breech and muzzle end; a projectile liquid or gas positioned in the barrel and extending a longitudinal distance in the disrupter barrel. The projectile liquid distal end is located farthest from the disrupter barrel breech end. A jet stabilizing projectile (JSP) is at least partially positioned in the barrel and operably contacts the projectile liquid distal end. The JSP has a JSP proximal end facing toward the disrupter barrel breech end and a distal end opposed to the JSP proximal end, wherein some or all of the JSP is positioned in the barrel. The PDD may contain the JSP, with an air region between the JSP distal end and the muzzle end, or an air region in an adapter that is connected to the muzzle end. Also provided are JSP's having improved flight stability for use with liquid or air-filled disrupters and methods of disrupting a target.

21 Claims, 35 Drawing Sheets

(56) References Cited

U.S. PATENT DOCUMENTS 4,779,511 A * 10/1988 Proctor ..... F42B 33/06 86/50
4,955,939 A 9/1990 Petrousky et al.
4,957,027 A 9/1990 Cherry
5,134,921 A * 8/1992 Breed ..... F41A 23/06 86/50
5,210,368 A * 5/1993 Heller, Jr. ..... F41A 19/59 42/84
5,230,324 A * 7/1993 Van Horssen ..... F41B 11/723 124/61
5,460,154 A * 10/1995 Mattern ..... B09B 3/0058 124/56
5,460,155 A * 10/1995 Hobbs, II ..... F41H 13/0006 124/1
5,785,038 A * 7/1998 Mattern ..... B09B 3/0058 124/56
5,792,977 A 8/1998 Chawla
6,269,725 B1 8/2001 Cherry
6,439,127 B1 8/2002 Cherry
6,490,957 B1 * 12/2002 Alexander ..... F41B 11/00 86/50
6,532,947 B1 * 3/2003 Rosa ..... F42B 12/40 124/56
6,584,908 B2 7/2003 Alford
6,644,166 B2 11/2003 Alexander et al.
7,401,766 B2 * 7/2008 Schorloff ..... F41H 11/12 254/389
8,091,479 B1 1/2012 Jakaboski et al.
8,276,495 B1 10/2012 Chiu et al.
8,677,902 B1 3/2014 Rock et al.
9,322,624 B2 4/2016 Alford et al.
9,322,625 B1 4/2016 Langner
9,404,718 B1 8/2016 Shaver et al.
9,453,713 B1 9/2016 Langner
9,976,838 B1 5/2018 Langner
10,054,388 B1 * 8/2018 Langner ..... F41B 9/0075
10,066,916 B1 9/2018 Vabnick et al.
10,451,378 B2 10/2019 Vabnick et al.
10,495,433 B1 12/2019 Langner
10,760,872 B2 9/2020 Vabnick
10,794,660 B2 10/2020 Vabnick
10,921,089 B1 2/2021 Vabnick et al.
2006/0163544 A1 * 7/2006 Schlorff ..... F41H 11/12 254/231
2011/0061521 A1 3/2011 Gardner et al.
2020/0173761 A1 6/2020 Vabnick
2021/0041205 A1 * 2/2021 Vabnick ..... F41H 11/12

* cited by examiner

FLUID JET STABILIZING PROJECTILE FOR ENHANCED IED DISRUPTERS

CROSS-REFERENCE TO RELATED APPLICATIONS

This application claims the benefit of and priority to U.S. Provisional Patent Application No. 62/884,961 filed Aug. 9, 2019, which is specifically incorporated by reference in its entirety to the extent not inconsistent herewith.

STATEMENT OF GOVERNMENT INTEREST

The inventions described herein were invented by employees of the United States Government and thus, may be manufactured and used by or for the U.S. Government for governmental purposes without the payment of royalties.

BACKGROUND OF INVENTION

In the art of hazardous devices access and disablement, including explosive ordnance disposal, a common tool, particularly for neutralizing improvised explosive devices (IEDs), is the propellant driven disrupter, also generally and colloquially referred to as a "water cannon". A propellant driven disrupter may be used to fire a solid projectile or a jet of fluid, which is typically water, at an IED with the goal of disrupting the explosive and avoiding its detonation. A solid projectile may penetrate tougher casing materials. On the other hand, a jet of water has considerable mass and momentum and acts upon the target explosive for a longer duration than does a solid "slug" projectile. The water may penetrate into the IED and separate components such as the fuzing system and firing train, without requiring precise aiming due to the large cross section of the water jet. Additionally, a jet of water has a reduced risk of initiating an explosive due to shock, compared to a solid projectile.

A significant limitation of fluid jets, particularly of water jets, is that they can rapidly disperse and break up into a cloud of droplets, referred to as atomization, as a result of the combination of dynamic forces acting upon the water jets. Atomization of the water jet reduces the length and mass of the water jet, which limits the momentum and energy transfer to the target IED and limits the duration of the action. This reduces the effectiveness as well as the reliability of IED disruption when using water jets. Thus, there is a need in the art to address these limitations and to provide a reliable platform for neutralizing a wide range of IEDs, over a wide range of situations, including various target and environmental conditions. Provided herein are specially designed fluid jet stabilizing projectiles (JSP), associated systems, and associated methods, for use with propellant driven disrupters which improve the effectiveness and reliability of fluid jets propelled from disrupters to perforate and disable IEDs or to aid in a breach of a structure.

SUMMARY OF THE INVENTION

Provided herein are fluid jet stabilizing projectiles (JSPs), as well as projectile systems and associated methods, that address the above and other challenges associated with disabling explosive devices using fluid jets fired from a propellant driven disrupter. The JSP addresses such challenges by reducing hydrodynamic and aerodynamic stresses experienced by the fluid-jet during its trajectory toward a target, and optionally during its interaction with the target.

The JSPs, or disrupters having any of the JSPs, and projectile systems provide a number of functional benefits with respect to a well-controlled and stabilized expelled fluid jet, including increased stand-off distance and improved target penetration (e.g., increased penetration depth) with respect to a target such as an improvised explosive device (IED). These functional benefits can result in a significantly reduced risk of an unwanted shock-initiated explosive event.

In addition, the JSPs, or disrupters having any of the JSPs, and projectile systems provide a platform for breaching through a wide range of materials, such as walls, windows, doors, vehicle bodies and windshields. Such materials can provide a challenge for conventional disrupters. For example, those materials positioned between the disrupter and explosive target can substantially affect the fluid jet, decreasing momentum and energy, such that, upon finally reaching the target, the fluid jet is ineffective at reliably and safely destroying the explosive target.

The JSP may have a variety of configurations and parameters, such as shape and density, to thereby enhance fluid-jet performance. The JSP may be positioned in the barrel such that it plugs a projectile liquid in the barrel, for example in combination with a seal. The JSP may be part of a projectile system, where the JSP plugs a container having a projectile liquid therein, for example. Either way, after the projectile liquid and the JSP are expelled, or fired, from the propellant driven disrupter, the liquid forms a fluid jet that is in contact with the JSP. The interaction of the JSP with the fluid jet provides a stabilizing effect on the fluid jet, as described herein. The JSP may be provided standalone, as part of a projectile system including a projectile liquid, or as part of a propellant driven disrupter, for example. Preferably, the JSP is positioned in the barrel so that there is liquid in operable contact with the JSP proximal end and there is an air-region extending from the JSP distal end to the muzzle end. The JSP is compatible with an adapter connected to the barrel muzzle end, with air extending into the adapter lumen that functionally provides an air-region distal to the JSP in the disrupter barrel or at the disrupter barrel muzzle end. These aspects are preferred as they provide additional liquid jet stability upon firing of the propellant driven disrupter, such as by reducing or eliminating a reverse jet gradient that otherwise forms in the expelled liquid jet, and thereby provides good hydraulic-stabilizing force on the expelled JSP proximal surface and attendant improvement in JSP flight stability and target disruption.

A propellant driven disrupter (PDD) for disrupting an explosive target may comprise: a disrupter barrel having a breech end and a muzzle end; a projectile liquid positioned in the barrel and extending a longitudinal distance in the disrupter barrel, wherein the projectile liquid has a distal end that is located farthest from the disrupter barrel breech end; and a jet stabilizing projectile (JSP) at least partially positioned in the barrel and in operable contact with the projectile liquid distal end, wherein the JSP has a JSP proximal end facing toward the disrupter barrel breech end; and a JSP distal end opposed to the JSP proximal end and facing toward the disrupter barrel muzzle end; wherein 50% to 100%, inclusively of the JSP is positioned in the barrel. The 50% to 100% of the JSP being positioned in the barrel optionally refers to 50% to 100% of the longitudinal length of the JSP, where the longitudinal length is measured along the JSP longitudinal axis, which is coincident with the longitudinal axis of the PDD barrel when the JSP is positioned therein, and the longitudinal length corresponds to the distance between the proximal-most end of the JSP to the distal-most end of the JSP. Any JSP provided herein may be characterized as forming a fluidic plug in the barrel, thereby fluidically sealing projectile liquid in the barrel lumen. Optionally, 90% to 100%, or optionally 100% of the JSP is positioned inside the barrel. Optionally, the proximal end of the JSP is in physical contact with the projectile liquid. At least a portion of the projectile liquid forms a fluid-jet when the projectile liquid is propelled out of the barrel.

The PDD may further comprise a fluidic plug, such as a fluidic plug further comprising a seal positioned between an outer surface of the JSP and a lumen surface of the disrupter barrel, wherein the seal is formed of a material configured to press-fit and form the fluidic plug in the barrel with the JSP. The material may be described as a "flexible material", or a material that can deform under an applied force and, at least partially, relax back to an undeformed state upon removal of the applied force. Examples include elastomers and soft polymers. For example, polyurethane is flexible and can press fit between the JSP and the disrupter barrel lumen surface, thereby ensuring there is no projectile fluid leakage past the JSP. The seal may correspond to an o-ring, or multiple sealing members or nubs. Grease or wax may also provide a reliable seal. Any JSP can comprise a seal, configured to provide for the JSP forming the fluid plug in the barrel. For example, the seal of the JSP can comprise at least one of (i) one or more protrusions and (ii) one or more depressions of a surface of the JSP (e.g., see 1910 of FIG. 22A).

For any PDD and JSP embodiments, the projectile liquid may be water or a HEET fluid. For example, the projectile liquid may correspond to any of the fluid projectiles described in U.S. patent application Ser. No. 15/731,874 filed Aug. 18, 2017 to Vabnick et al. and titled "Disrupter Driven Highly Efficient Energy Transfer Fluid Jets", and U.S. Pat. No. 10,451,378 titled "Reverse Velocity Jet Tamper Disrupter Enhancer", which are specifically incorporated herein by reference in its entirety for the fluids, suspensions and containers described therein, and also for the adapters described therein related to addressing the reverse velocity jet gradient; referred herein as a highly efficient energy transfer (HEET) fluid projectile, and may include high viscosity liquids, optionally with solid particles suspended therein. The HEET fluid may have an effective density of between 0.5 q/mL and 15 g/mL at 20° C. The PDD may include a plurality of projectile liquids. The PDD may include more than one JSP, each JSP being different from or optionally identical to any other JSP. Optionally, when inside the PDD barrel, the JSP is not entirely enveloped by the projectile liquid; for example, less than 90% or less than 75% of an outer surface of the JSP is in physical contact with the projectile liquid, and optionally less than or equal to 50% of the JSP outer surface is in physical contact with the projectile liquid, when the JSP is inside the barrel of the PDD. The projectile liquid forms a fluid jet when the projectile liquid is propelled (fired, expelled) from the PDD, that trails behind, but envelops at least a proximal end of, the JSP. The propellant driven disrupter may be any conventional disrupter, including a Percussion Actuated Non-electric (PAN) disrupter, dearmer or a water cannon.

The disrupter barrel has an inner diameter and the JSP has a maximal outer diameter. Any JSP provided herein may have wherein a maximal outer diameter (when positioned in the barrel) that is greater than or equal to 90% of the disrupter barrel inner diameter and less than or equal to the disrupter barrel inner diameter. For example, any JSP may be used with o-ring in the PDD barrel. The o-ring may be functionally provided as a special series of relief and recess features that function as compression rings on the outer surface of the JSP that can effectively compress together to form a seal when the JSP is forced into the barrel, thereby forming a reliable seal between the JSP and the disrupter barrel. The proximal end of the JSP may be in physical contact with a distal end of a container, the container having the projectile liquid contained therein. The proximal end of the JSP may be in physical contact with a distal end of a container, the container having the projectile liquid contained therein, and the proximal end of the JSP being in physical contact with the container. Optionally, the container is used for loading the projectile liquid into the barrel, but the projectile liquid is not encapsulated in said container after being fired, or otherwise propelled, out of the PDD barrel. The container is, for example, an ejecta, wherein it can be expelled from the barrel but itself does not become part of the fluid-jet projectile. For example, the container may be expelled in a direction different from the flight path or trajectory of the fluid jet. For example, a projectile liquid encapsulated by a container may be loaded in the PDD barrel, and the JSP also may be loaded in the barrel such that the proximal end of the JSP is in physical contact with the container. Optionally the JSP is in direct physical contact with the projectile liquid, for example the JSP may fluidically plug the projectile liquid in the container encapsulating the projectile liquid. Optionally the JSP is not in direct physical contact with the projectile liquid, for example a membrane, spacer, or container portion may physically separate the JSP and the projectile liquid. For example, the container may fully encapsulate the projectile liquid such that the proximal end of the JSP is in physical contact with the distal end of the container, but not in direct physical contact with the projectile liquid in the container.

Any JSP may have a shape and an effective density selected such that the fluid-jet encapsulates at least the proximal end of the JSP after expulsion from the barrel. Any JSP may have a shape and an effective density selected such that the fluid-jet encapsulates 10% to 75% of an outer surface of the JSP after expulsion from the barrel.

Any JSP may have an effective density that is within 20% of an effective density of the projectile liquid. Any JSP may have an overall shape characterized as spherical, hemispherical, spheroidal, ovoid, ogive, conical, cylindrical, parabolic, or any combination of these. The proximal portion or proximal surface of any JSP may have a shape characterized as spherical, hemispherical, spheroidal, ovoid, ogive, conical, cylindrical, parabolic, linear, rectangular, or any combination of these. The distal portion or distal surface of any JSP may have a shape characterized as spherical, hemispherical, spheroidal, ovoid, ogive, conical, cylindrical, parabolic, or any combination of these. The JSP has three primary forces acting upon it in free flight: hydraulic pressure, air pressure and gravity. The position and magnitude of these forces may be effected by the mass distribution and shape of the JSP. A JSP (optionally with fluid-jet in contact therewith) in stable flight has a trajectory such that the JSP hits the aim point (intended and aimed-at point on the target) and the trajectory of the JSP is in line (or, co-axial, or co-incident) with the projectile's longitudinal axis.

Any JSP may have a shape and/or effective density, including an effective density distribution, such that the center of hydraulic pressure of the fluid-jet on the JSP is coincident or proximate to the center of gravity of the JSP, when the fluid-jet and the JSP are in flight toward the target. In addition to the hydraulic center of pressure, any JSP may have a shape and/or effective density such that the center of air pressure of the JSP is coincident or proximate to the center of gravity of the JSP, when the fluid-jet and the JSP are in flight toward the target. In this context, "proximate" refers to a position between the centers of hydraulic pressure and center of gravity such that free flight of the JSP characteristics are improved. Optionally, the term "proximate" can be quantified as being within 2 inches, within 1 inch, or within 0.5 inches of each other. For example, the JSP can have a shape and effective density such that a center of hydraulic pressure of the fluid-jet on the JSP is coincident with or within 2 inches from a center of gravity of the JSP. Preferably, the center of gravity is distally located (e.g., is closer to the target) relative to the center of pressure associated with flow of the JSP through air. Optionally, in comparing the distance measured from the base or proximal end of the JSP, the center of hydraulic pressure of the fluid-jet on the JSP can be closer to the base or proximal end of the JSP than the center of gravity of the JSP. There are primarily three forces acting on the JSP-air pressures (center of pressure, CP), hydraulic pressure (HP), and gravity (CG). In the absence of the hydraulic contribution, to improve free flight characteristics of the JSP, such as for flight to be stable, the CP can be behind the CG. Drag on the JSP in flight can be exploited with manipulation of the JSP geometry (shape), effective density (of liquid and/or JSP), and/or effective density distribution of the JSP, to further improve free flight characteristics and stabilize the JSP, such as by moving the CG to a more distal location on the JSP. Accordingly, any of the JSP's provided herein may be described as having, during use, a CG that is distal to the CP associated with air-flow over the JSP. The hydraulic force, generated by a liquid jet acting on the proximal end of the JSP, provides additional stability to JSP flight.

Any JSP may have a shape and/or effective density such that the center of hydraulic pressure of the fluid-jet on the JSP and the center of gravity of the JSP are collinear and on the longitudinal axis of the JSP, when the fluid-jet and the JSP are in flight toward the target.

Any JSP may have a shape and/or effective density such that the center of hydraulic pressure of the fluid-jet on the JSP is farther from the distal-most end of the JSP than the center of gravity of the JSP during the majority of the flight of the fluid-jet and the JSP toward the target.

Any of these criteria of the JSP with respect to the hydraulic pressure of the fluid-jet on the JSP and the center of gravity of the JSP, as noted above, may allow for stabilized flight. "Stabilized flight" refers to a lack of unwanted yaw, pitch or other offsetting motion such as wobble or tumbling that would tend to lead to inaccuracy. Stabilized flight may be quantitatively characterized as ensuring deviation of the target point of impact is within 6 inches or less, preferably within 3 inches or less, of the point of aim of a linear trajectory between the muzzle end of the barrel and the target, and is this tolerance holds for the JSP for up to or at least 20 feet toward the target.

At least a portion, or the entirety, of an outer surface of any JSP may be smooth. For example, the proximal end, or surface thereof, of the JSP may be smooth. For example, at least a portion, or the entirety, of an outer surface of any JSP may have a surface roughness characterized as having a surface roughness that, to the naked eye appears smooth. Alternatively, smoothness may refer to any recess or relief feature amplitudes that are less than 1 mm, less than 500 μm or less than 50 μm. At least a portion, or the entirety, of an outer surface of any JSP may be free of dimples, grooves, scores, channels, hollows, flutes, or any combination of these. Smoothness is also a factor in the dynamic friction coefficient of the material relative to a known surface material such as a steel and for the JSP can be in the range of 0.01-0.7. For example, a JSP can be impregnated with a lubricant. Smoothness and/or lubricant-impregnation can aid in reducing shear forces between the JSP and the barrel lumen surface and between a JSP and a target portion during its travel through target barriers and media. An example of a lubricating additive is PTFE. For polyurethane, the durometer hardness also influences the friction coefficient. For example, high durometer polyurethane in the range of 85-90 is preferred for some embodiments. Delrin™ has a low dynamic coefficient of friction. Delrin™ is in the acetal resin family of plastics, which can be used in the JSP. Also, lubricating additives such as acetal resin materials can be blended with PTFE, such as Teflon®, to greatly reduce the coefficient of friction.

Any JSP may be formed of at least one polymer material. Any JSP may comprise one or more additives; the one or more additives comprising at least one of a lubricant and a plurality of particles. For example, a lubricant is a polymer material. For example, the JSP can comprise a plurality of particles inside of the JSP, such as embedded in the JSP or positioned in a cavity of the JSP. Any JSP may comprise at least one polymer material selected from the group consisting of polyurethane, polyoxymethylene, Delrin™, silicone, nitrile, polyacetic acid, and any combination thereof. For any JSP, the distal end of the JSP may comprise an outer layer formed of a metal or other hard material; or wherein a portion of the distal end is formed of a metal or other hard material. Any JSP may comprise voids or air channels. Any JSP may be characterized by a durometer selected from the range of 60 to 90. Any JSP can have a dense material region inside of the JSP, the dense material region having a higher density than any other internal portion of the JSP. The dense material region can be a rod, for example, formed of a dense material such as one or more metals. Optionally, the dense material region (e.g., a metal rod) has a length that is 10% to 50% of the length of the JSP.

During use, the fluid-jet optionally does not encapsulate the distal-most end of the JSP during flight, but rather the fluid-jet encapsulates a proximal portion of the JSP with a trailing fluid jet behind.

In any method, the step of loading the primary projectile may comprise filling at least a portion of the barrel with a fluid or a cartridge containing the fluid. Any method may comprise selecting the JSP or selecting at least a shape and an overall effective density such that the fluid-jet at least partially encapsulates at least the proximal end of the JSP for at least the entire time the JSP travels between barrel muzzle and target, such as up to about 50 feet after the primary projectile and JSP are propelled out of the barrel. Optionally, at some point during time of flight, the fluid-jet encapsulates at least 50% of the JSP.

Any JSP may be frangible, such that the JSP is fractured or disintegrated upon a target impact. For example, any JSP may be formed of one or more polymers that are characterized brittle fracture behavior. For example, at least a portion of any JSP may be formed of a composite material such as ceramic or clay material, and optionally held together by a thin outer shell of plastic. For example, any JSP may be have one or more weakened regions such as due to intentional scoring, flutes, channels, or hollows to promote fracture on impact. For example, if the JSP is frangible, the JSP may be destroyed on initial impact with the target, such as with a first barrier. The shape and density of the JSP may also be selected to cause the JSP to be deflected upon impact with the target. Whether the JSP is deflected or destroyed upon impact, the liquid of the fluid-jet then propagates into the target (e.g., an explosive device), to disrupt it. Alternatively, the JSP can continue to propagate through the target riding on the front of the fluid jet tip.

Any PDD and JSP disclosed herein may be used with other devices or methods intended to improve fluid jet performance or properties. For example, not filling the barrel fully with projectile liquid, and plugging the liquid in the barrel, leaving an air-space or distal region free of projectile in the barrel may improve fluid jet performance. Accordingly, for example, the projectile liquid may be plugged with any JSP such that an air-space, distal region free of projectile in the barrel, is formed in a distal region of the barrel. In other words, the length of the fluid-filled portion of the disrupter barrel, also referred herein as the fluid (or liquid) projectile length, may be less than the total disrupter barrel length. For example, any PDD and JSP disclosed herein may be used with an adapter operably connected to the barrel of the PDD, such as a fluid jet enhancement adapter, such as a RevJet. For example, the adapter may correspond to any of the adapters, including fluid jet enhancement adapters, or "RevJet" adapters, and associated embodiments, described in U.S. patent application Ser. No. 15/896,760 filed Feb. 14, 2018 to Vabnick et al. and titled "Reverse Velocity Jet Tamper Disrupter Enhancer", which is specifically incorporated herein in its entirety.

For any PDD and JSP disclosed herein, the disrupter barrel may have an air-space between the distal end of the JSP and the muzzle end of the barrel; and wherein the air-space corresponds to a length of the barrel selected from the range of 20% to 200% of a longitudinal length of the projectile liquid in the disrupter barrel. For any PDD and JSP disclosed herein, the PDD may comprise a fluid jet enhancement adapter operably connected to the muzzle end of the barrel; wherein a length of the adapter is selected from the range of 20% to 200% of a longitudinal length of the projectile liquid in the disrupter barrel. The projectile liquid may have a length equivalent to a length of the disrupter bore, or a length that is at least 95%, 90%, 80% 60%, or between 50% and 95% of the length of the disrupter bore. One representative example is a fluid column that is 13.75" in a 21.75" length bore, or about 63%.

Any JSP may have a shape and an overall effective density selected to improve one or more performance characteristics of the PDD compared to a PDD used without the JSP, the one or more performance properties selected from the group consisting of: increased jet length at impact, increased jet impact duration, decreased jet reverse velocity gradient, decreased fluid jet atomization, increased target penetration depth, increased momentum and energy transfer to a target, increased volumetric destruction of a target, increased stand-off distance while maintaining target inactivation, decreased cross-sectional area of the fluid-jet at impact, decreased barrier penetration time (also known as dwell time), decreased air drag on the fluid jet tip, reduced risk of shock initiation, and any combination of these. For example, a greater amount of propellant may be used to fire the projectile liquid and JSP to disrupt the target explosive without shock initiation of the target explosive, compared to an otherwise equivalent setup without the JSP. In other words, without the JSP, the projectile liquid would either not disable the target explosive or would cause shock initiation of the target explosive. For example, use of a PDD with a JSP, compared to an otherwise equivalent PDD and projectile without the JSP, may increase penetration in continuous media, such as explosives, by at least 20%. For example, use of a PDD with a JSP, compared to an otherwise equivalent PDD and projectile without the JSP, may increase a penetrable barrier thickness limit by 100% through steel barrier(s).

As noted, also disclosed herein are projectile systems that include a projectile liquid and a JSP, where the projectile system may be loaded into a barrel of a PDD. A projectile system for a propellant driven disrupter (PDD) may comprise: a friction reducing container having a cylindrical shape with a container wall having a thickness defined by an outer diameter and an inner diameter, wherein the outer diameter is selected to fit in a barrel of the PDD and the inner diameter is selected to provide a container lumen; a friction reducing container proximal end that defines a proximal end of the container lumen and configured to face a breech-end portion of the barrel; a projectile liquid that at least partially fills the container lumen; wherein the projectile liquid is water or a highly efficient energy transfer (HEET) fluid; and a jet stabilizing projectile (JSP) defining a distal end of the projectile system and configured to face a muzzle end of the barrel; wherein the JSP forms a fluidic plug at a distal end of the container. Any projectile system may further include an explosive cartridge, for example in operable connection with the proximal end of the container. The explosive cartridge may be in physical contact with the proximal end of the container. The explosive cartridge may be in physical contact with the projectile liquid.

Also disclosed herein are related methods. For example, provided is a method of stabilizing a fluid-jet projectile comprising the steps of: loading a liquid projectile into a proximal portion of a disrupter barrel of a propellant driven disrupter (PDD); inserting a jet stabilizing projectile (JSP) into a distal portion of the barrel, such that a proximal end of the JSP is in contact with the liquid projectile and the JSP forms a fluidic plug in the barrel; and exploding an explosive cartridge in a breech of the PDD, wherein the breech is operably connected to a proximal end of the barrel thereby propelling the projectile liquid and the JSP out of the disrupter barrel and toward a target; wherein the liquid of the liquid projectile forms a fluid-jet that continuously encapsulates at least a proximal portion of the JSP after the projectile liquid and JSP are propelled out of the barrel, thereby stabilizing the fluid jet and improving one or more performance characteristics of the fluid-jet compared to a fluid-jet without the JSP; wherein the one or more performance characteristics comprises reducing shockwaves in the fluid-jet, reducing pressure waves in the fluid-jet, increasing fluid-jet length at impact with the target, increasing fluid-jet impact duration, decreasing fluid-jet reverse velocity gradient, decreasing atomization of the fluid-jet, decreases air drag on the fluid jet tip, decreasing cross-sectional area of the fluid-jet at impact, increasing target penetration depth, increasing momentum and energy transfer to the target, increasing volumetric destruction of the target, increasing stand-off distance while maintaining target disruption, decreasing penetration time, or any combination of these.

The fluid-jet may fully encapsulate the JSP, such that the distal portion of the JSP is enveloped at some point during flight by liquid. The fluid-jet may partially encapsulate the JSP, such that at least a distal portion of the JSP is not enveloped with liquid. The amount of encapsulation is controlled be the relative densities between the fluid and JSP, JSP shape, and/or JSP positioning in the barrel, including whether any of the JSP extends outside the barrel before firing, and the ratio of JSP outer diameter to bore size. The desired amount of encapsulation is dependent on the specific application, such as target composition, geometry, stand-off distance, JSP composition, geometry, etc.

Any method for stabilizing a fluid-jet projectile may comprise disrupting the explosive target with the projectile liquid and JSP.

In any method for stabilizing a fluid-jet projectile the step of disrupting the explosive target may comprise: penetrating a surface of the target with the JSP; or fracturing or disintegrating the JSP upon target impact.

In any method for stabilizing a fluid-jet projectile the step of inserting the JSP may comprise forming an air-space between a distal end of the JSP and a muzzle end of the disrupter barrel; and wherein the air-space corresponds to a length of the barrel selected from the range of 20% to 200% of a longitudinal length of the liquid projectile in the disrupter barrel. In any method for stabilizing a fluid-jet projectile the method may comprise the step of attaching a fluid jet enhancement adapter to a muzzle end of the barrel; wherein the fluid jet enhancement adapter has a length that is greater than or equal to 20% and less than or equal to 200% of a longitudinal length of the liquid projectile in the disrupter barrel.

Any method for stabilizing a fluid-jet projectile may comprise sealing or fitting the JSP into the barrel using a seal, such as a seal formed of polyurethane, which may be provided separately from the JSP or may be a portion of the JSP. The JSP may be press-fit into the barrel. A rammer is optionally used to insert the JSP into the barrel. Optionally, one or more o-rings are used to seal the JSP into the barrel such that the JSP provides a fluidic plug in the barrel and is not too easily dislodged, such as when the barrel is aimed downward. Optionally, multiple radiuses of triangle nubs are used to seal the JSP into the barrel such that the JSP provides a fluidic plug in the barrel and is not too easily dislodged, such as when the barrel is aimed downward. Optionally, grease or wax may be used to seal the JSP in the barrel. Any one or combination of these sealing methods or materials may be used. Any one or combination of these sealing methods or materials may be provided with the projectile system described here.

Optionally, any JSP is propelled at a velocity of Mach 0.5 to 1.5. Any method may comprise selecting the JSP or selecting at least a shape and an overall effective density to improve the one or more performance characteristics. Selecting an overall effective density of the JSP may comprise selecting a composition, one or more additives, a porosity, an internal structure, at least one physical dimension of the JSP, or a combination of these of the JSP; and wherein selecting a shape of the JSP comprises selecting a shape of a proximal end surface, a shape of a distal end surface, an overall shape, or a combination of these of the JSP. Optionally, a JSP at least doubles a barrier thickness limit when used with a primary liquid projectile comprising water, compared to an equivalent PDD and primary projectile without the JSP. Optionally, a JSP increases a penetration depth by at least 20% when used with a primary projectile comprising water, compared to an equivalent PDD and primary projectile without the JSP.

Also disclosed herein are methods for preparing any one or any combination of the PDD embodiments disclosed herein. Also disclosed herein are methods for operating any one or any combination of the PDD embodiments disclosed herein. Also disclosed herein are methods for making a JSP, according to any one or any combination of the embodiments of PDDs, JSPs, and projectile systems disclosed herein. Also disclosed herein are methods for making a projectile system, according to any one or any combination of the embodiments of PDDs, JSPs, and projectile systems disclosed herein. Also disclosed herein are PDDs, JSPs, and projectile systems having any one or any combination of embodiments of PDDs, JSPs, and projectile systems disclosed herein.

Any PDD, JSP, and projectile system disclosed herein may be compatible with and used with a fluid jet enhancement adapter, such as any disclosed in U.S. patent application Ser. No. 15/896,760 now U.S. Pat. No. 10,451,378). The fluid jet enhancement adapter may comprise: a first end operably connected to a muzzle end of a propellant driven disrupter barrel and a second end, wherein a longitudinal region extends between the first end and the second end. The longitudinal region of the adapter has: a longitudinal region inner surface that defines a longitudinal region lumen; a longitudinal region outer surface opposably facing the longitudinal region inner surface, with a longitudinal region wall having a wall thickness that separates the longitudinal region inner surface from the longitudinal region outer surface. The longitudinal region lumen of the adapter has a first end inner diameter that is substantially equivalent to a muzzle inner diameter (inner diameter at the muzzle end of the disrupter barrel). The wall of the adapter forms a continuous surface that radially isolates the longitudinal region lumen of the adapter from a surrounding environment. The adapter may be connected to a disrupter by any one or more connection mechanisms. Any of the adapters may further comprise a means for connecting the adapter to a disrupter barrel. The means may comprise a connector, such as a connector positioned at or extending from the first end. The connector may have threads or grooves in a portion of the connector outer surface or connector inner surface, such as to physically and reliably connect to another correspondingly threaded or grooved connection element, for example at the muzzle end of the disrupter barrel. For example, the disrupter barrel may have threads or grooves on its outer surface for rotationally mating with the connector of the adapter. The adapters are compatible with a range of connection mechanism types and configurations, and need not be limited to any specific mechanism. For example, the connector may comprise a clamp, a fastener, or a collet, that when tightened, reliably secures and holds the adapter to the disrupter barrel, including so that the components continue to remain connected even for repeated use and exposure to explosive expulsion of the projectile liquid out of the barrel. The threaded connector may slide over the barrel and be clamped to the barrel. The rotational mating occurs between the threaded clamp and adapter such that any conventional barrel may be retrofitted without machining or modification of the conventional barrel.

As noted earlier, a projectile liquid may be encapsulated within a cylindrical container that tight fits in the barrel lumen. For example, the projectile liquid may correspond to any of the fluid projectiles described in U.S. patent application Ser. No. 15/731,874 filed Aug. 18, 2017 to Vabnick et al. and titled "Disrupter Driven Highly Efficient Energy Transfer Fluid Jets"; referred herein as a highly efficient energy transfer (HEET) fluid projectile, and may include high viscosity liquids with solid particles suspended therein. In other words, any JSP described herein is compatible with a range of projectile liquids and projectile types, including liquid pored directly in the barrel lumen, liquid phase and solid phase mixtures, and liquid-based projectiles within an encapsulation container that is positioned in the barrel lumen and the JSP that fluidically seals the encapsulation container at a distal end. U.S. patent application Ser. No. 15/731,874 is incorporated herein by reference in its entirety. The projectile liquid may be at least partially encapsulated by a friction reducing container having a cylindrical shape with a container wall having a thickness defined by an outer diameter and an inner diameter, wherein the outer diameter is selected to fit in a barrel of the disrupter and the inner diameter is selected to provide a container lumen. The friction reducing container is especially relevant for aspects where the fluid contained in the container lumen may have a tendency to interact with the disrupter barrel or plug the barrel with risk of misfire and damage to the disrupter. In this manner, the friction reducing container may help provide desired fluid jet characteristics for a desired target configuration, placement, and environmental conditions, while preserving the central concept of having a fluid jet acting on and around a distal portion of the JSP. The friction reducing container has a container proximal end that defines a container proximal end of the container lumen and is configured to face a breech-end portion of the barrel, where an explosive cartridge is located. The friction reducing container has a friction reducing container distal end that defines a distal end of the container lumen and is configured to face a muzzle of the barrel and at which the JSP is positioned to ensure a fluid seal at the container distal end.

A fluid, such as a HEET fluid may be positioned in the container lumen and at least partially fill the container lumen, with a remainder of the container lumen occupied by the JSP, and as desired, a seal between the JSP and the container wall. The entire container lumen may be filled with HEET fluid, with a JSP adjacent thereto. Alternatively, the entire container lumen may be filled with HEET fluid and JSP. Air pockets or air-spaces may be present in the container lumen, such as a HEET fluid that fills at least 95%, 99% or 99.5% of the container lumen, including in a manner such that air pockets are not visible to the naked eye. For example, a HEET fluid may comprise a plurality of solid particles; wherein the plurality of solid particles are positioned at the proximal end of the friction reducing container to form a HEET density gradient, with a highest effective density at the proximal end to provide an improved jet parameter during use.

Any of the HEET fluids may comprise a Newtonian fluid, a semi-solid, or a Newtonian fluid and a semi-solid. A HEET fluid may be selected from the group consisting of: water, oil, syrup, ionic solutions, alcohol, a liquid polymer, a pre-polymer, an elastomer-containing liquid, a mechanophore, a clay, and any combination thereof. The solid particles may be selected from the group consisting of clay, steel shot, lead shot, plastic beads, sand, metallic microparticles, garnet (e.g., microparticles of garnet), ceramic powder, wood dust, plastic dust, and any combination thereof. Any HEET fluid may comprise a syrup and sand mixture. Any projectile system, any HEET fluid projectile, or any projectile having a liquid encapsulated in a container, may have a container lumen that comprises a plurality of fluid zones and the HEET fluid comprises a plurality of unique HEET fluid compositions, with a unique HEET fluid composition contained in each fluid zone. In this manner, for example, a proximal fluid may be positioned at the proximal end of the container lumen, a distal fluid positioned at the distal end, and none to any number of intervening fluids between the distal and proximal fluids. The fluids may be independently selected in composition. The fluids may be similar or equivalent, but with particles positioned in one or more of the fluids, including different particles and/or different particle concentration.

Any of the HEET fluid projectiles may comprise a membrane that separates adjacent fluid zones, wherein the membrane prevents migration of HEET fluid or a constituent thereof between adjacent fluid zones. For example, the membrane may only prevent movement of particles between adjacent fluid zones, or the membrane may also prevent fluid migration and particle migration Any of the devices and systems described herein may be used without a projectile liquid. For example, a PDD disclosed herein can be used with any JSP disclosed herein, but without a projectile liquid. Optionally, methods disclosed herein for disrupting a target explosive can comprise propelling (firing) any JSP disclosed herein from a PDD without a projectile liquid. Propelling a JSP from a PDD without a projectile liquid, with only a gas such as air between the breech and the JSP, facilities a high velocity of JSP firing, such as over 3,000 fps, which can be desirable in certain applications.

The PDD may be described as having at least a portion, or the entirety, of an outer surface of the JSP that is smooth; and wherein a ratio of dynamic friction coefficient of the at least a portion, or of the entirety, of the outer surface of the JSP to a dynamic friction coefficient of steel is selected from the range of 0.01 to 0.7.

The JSP may be characterized by a durometer selected from the range of 60 to 90.

The JSP may comprise at least one polymer material selected from the group consisting of polyurethane, polyoxymethylene, Delrin™, silicone, nitrile, polyacetic acid, acetal resin, PTFE, Teflon®, and any combination thereof.

The JSP may be propelled at a velocity of Mach 0.5 to 1.5.

The JSP may comprise a seal, configured to provide for the JSP forming the fluid plug in the barrel.

The seal may comprise at least one of (i) one or more protrusions and (ii) one or more depressions of a surface of the JSP. In this way, the seal may be characterized as integrated with the JSP. Of course, the systems and methods are compatible with a separate component that functions as a seal, such as an o-ring or the like.

The JSP may be described as having a shape and an effective density selected improve one or more performance characteristics of the fluid jet and/or improve free-flight characteristics of the JSP by increasing air-drag stabilization of the JSP in flight. For example, the center of hydraulic pressure of the fluid-jet on the JSP may be closer to the proximal end of the JSP than the center of gravity of the JSP.

During use, the fluid-jet may encapsulate at least 50% of the JSP. The fluid-jet may not encapsulate the distal-most end of the JSP. Alternatively, the fluid-jet may encapsulate the distal-most end of the JSP.

The PDD may further comprise a rammer configured to receive a portion of the JSP and to force the JSP at least partially into the disrupter barrel and form a fluidic seal between the JSP and the disrupter barrel. A proximal portion of the JSP may extend out of the rammer corresponding to the seal portion of the JSP (or an o-ring affixed to the proximal portion of the JSP). In this manner, a user can readily transmit a force to the JSP, even an inconveniently shaped and/or sized JSP, in a reliable and efficient manner, thereby ensuring proper seating of the JSP in the disrupter barrel. Preferably, the rammer is also used in combination with the JSP to ensure there is a desired seating depth of the JSP in the disrupter barrel (for when the JSP is only partially positioned in the disrupter barrel).

The methods described herein may further comprise selecting the JSP or selecting at least a shape and an overall effective density such that the fluid-jet at least partially encapsulates at least the proximal end of the JSP for up to about 50 feet after the projectile liquid and JSP are propelled out of the barrel.

The methods and systems described herein may utilize a liquid projectile in the barrel. The methods and systems described herein, however, are also compatible with a liquid projectile-free configuration, wherein air separates the JSP from the disrupter breech, including for applications where very high JSP velocities are desirable. Preferably, the JSP distal end is separated from the disrupter barrel muzzle end or from a distal end of an adapter connected to the disrupter barrel muzzle end. In this manner, there is a second air region that extends distally from the JSP distal end to the end of the disrupter barrel, or to an end of an adapter connected to the disrupter barrel that effectively extends barrel length. Preferably, the CG is positioned distally relative to the air-drag CP on the JSP.

In certain embodiments, the JSP is seated either inside the shell or in the chamber adjacent to a blank shell, including for a JSP that is a polymer or plastic (including rubber) sphere or slug. See, e.g., U.S. Pat. App. No. 63/033,475 filed Jun. 2, 2020 by Vabnick titled "Rounded Projectiles for Target Disruption", which is specifically incorporated by reference herein, including for a JSP configured to have CG distal to CP after expulsion from a disrupter barrel in a configuration where the JSP is part of the shell or is in the chamber adjacent to a blank shell, so that the gas behind the JSP is the explosive gas that functions to explosively drive the JSP out of the barrel.

The invention also includes any of the JSP's provided herein, including for use with a propellant drive disrupter. As described, the JSP can be used with a liquid to provide additional stability from the corresponding fluid jet acting on the proximal end of the JSP. As described, the JSP can be used with a gas such as air, including for any of the projectiles described in U.S. Provisional Pat. App. No. 63/033,475 filed Jun. 2, 2020 titled "Supersphere Projectile for Target Disruption", which is specifically incorporated by reference herein for the various projectiles used without projectile liquid, and related methods. For those embodiments, it is particularly preferred that the JSP center of gravity is positioned coincident with or, more preferably, distal to, the center of pressure associated with JSP flow through air to facilitate reliable JSP flight stability even without assistance of a stabilizing liquid jet.

Without wishing to be bound by any particular theory, there may be discussion herein of beliefs or understandings of underlying principles relating to the devices and methods disclosed herein. It is recognized that regardless of the ultimate correctness of any mechanistic explanation or hypothesis, an embodiment of the invention can nonetheless be operative and useful.

BRIEF DESCRIPTION OF THE DRAWINGS

FIG. 4C illustrates JSP without liquid projectile. FIG. 4D illustrates JSP with liquid projectile partially enveloping a proximal portion of the JSP, thereby providing additional stability to the JSP flight via the hydraulic force of the liquid jet on the JSP.

FIG. 5A is a photograph of a moment before impact of the fluid jet and JSP with the target. FIG. 5B is a photograph after impact of the fluid jet and JSP with the target. FIG. 5C is an expanded photograph of the JSP portion at a moment before impact.

In FIG. 2B, the second end of the adapter includes a threaded surface.

FIG. 19A illustrates a JSP having an ogive-shaped distal region. The JSP may have a hollow region (FIGS. 19B and 19C). For example, the JSP may have a hollow region extending from the distal region FIGS. 19B-19D), and the hollow region may further include microparticles (FIG. 19B), such as metal microspheres, therein or may be without microparticles (FIG. 19C-19D). FIGS. 19C-D illustrates that the JSP hollow region position may be varied, and may extend from the distal region (e.g., the end of the JSP pointing toward the target) or proximal region (e.g., the end of the JSP that faces toward the breech end of the disrupter).

FIG. 21A is an external view and FIG. 21B is a longitudinal cross-sectional view of a JSP and rammer, illustrating how the rammer can contact the JSP to facilitate positioning of a portion of the JSP into the disrupter barrel. FIG. 21B is a cross-sectional view along a longitudinal center plane of the JSP in a rammer of FIG. 21A. FIG. 21C is a view of the JSP-rammer proximal end down the longitudinal axis. FIG. 21D is a perspective view, illustrating a portion of the JSP ready to be press-fit via the rammer into a barrel. FIG. 21E illustrates the JSP removed from the rammer. FIG. 21F is a view of the rammer of FIG. 21E from the distal end down the longitudinal axis. FIG. 21G is a side view of the rammer. The proximal end of the rammer is open to receive the JSP. The distal end of the rammer may have a closed surface or may be at least partially open.

FIG. 22D is a cross-sectional view of the JSP of FIG. 22A. FIG. 22C is a cross-sectional view of the JSP of FIG. 22B. FIG. 22F is a cross-sectional view of the JSP of FIG. 22E (external view) and 22G (longitudinal cross-section). The JSP of FIGS. 22E, 22F, and 22G includes a metal portion inside of the JSP at the distal region ("internal metal point" labeled as 2210). FIG. 22I is a cross-sectional view of the JSP of FIG. 22H. FIG. 22K is a cross-sectional view of the JSP of FIG. 22J. FIG. 22M is a longitudinal cross-sectional view of the JSP of FIG. 22L, reflecting a JSP can be formed of a single material.

FIG. 23B is a perspective view. FIGS. 23C and 23D are end views of the proximal and distal ends of the JSP, respectively. The JSP may include a hollow internal region extending from the proximal region or the distal region, as shown in FIGS. 23E-23F, respectively. A JSP of this configuration can exhibit stable flight characteristics, for example.

FIG. 25C is a solid view and FIG. 25A is a transparent view of the JSP to help show air-flow channels through the JSP. FIG. 25B is an end view of the distal end of the JSP of FIG. 26A, illustrating a plurality of air inlets. As noted throughout, a JSP can include protrusions and/or depressions, optionally at the proximal region or end, optionally for providing a fluidic plug in the barrel.

FIG. 27A shows optional dimensions of a JSP in inches. FIG. 27B is a view down the distal end. FIG. 27C is a shaded view to illustrate complex 3D surface geometry, with a combination of concave and convex regions.

DETAILED DESCRIPTION OF THE INVENTION

Figure 1:
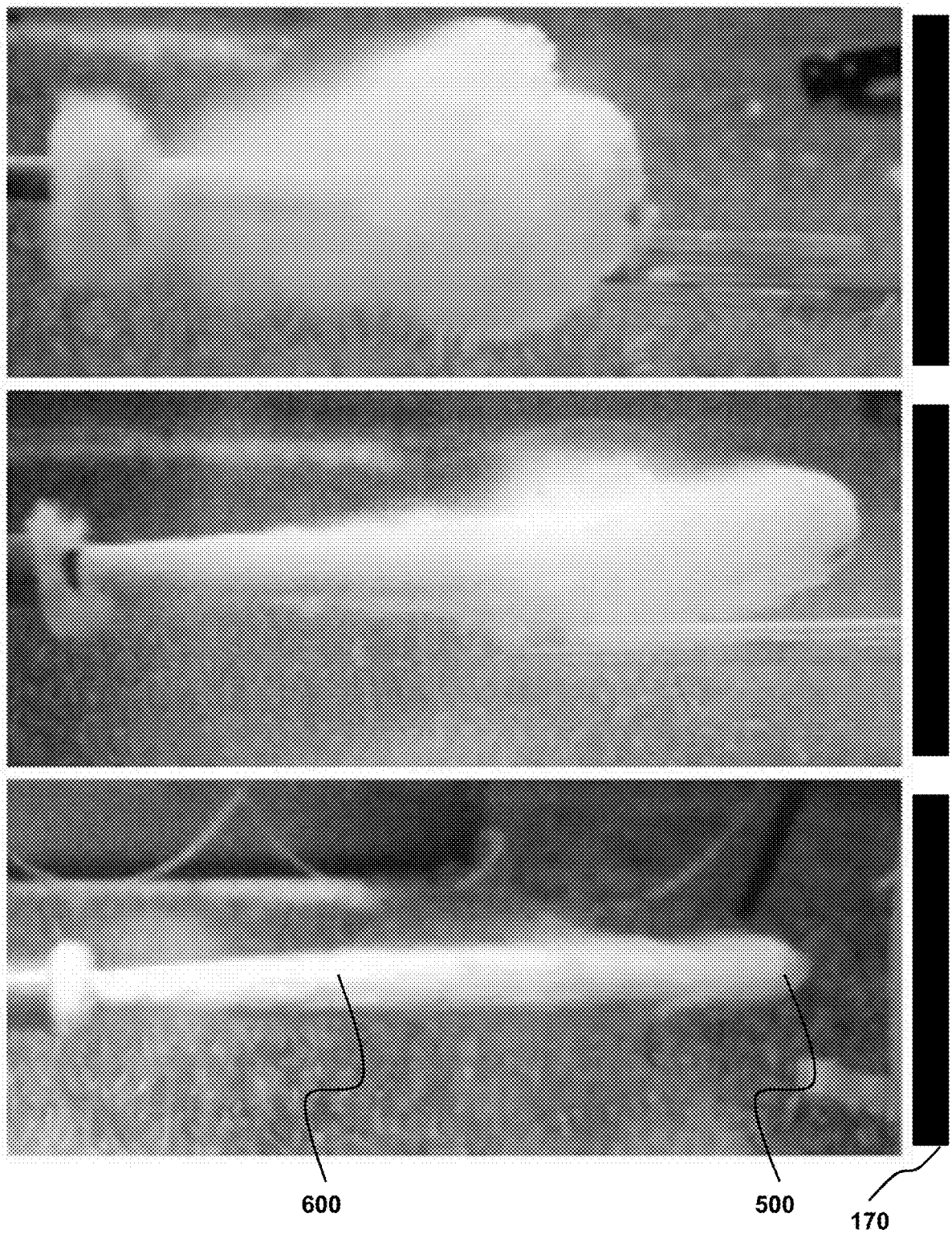
FIG. 1 shows photographs comparing a fluid jet (water jet) propelled from a PAN disrupter (top panel), propelled from a PAN disrupter with a fluid jet enhancement adapter (RevJet; middle panel), and propelled from a PAN disrupter with a fluid jet enhancement adapter (RevJet) and with a JSP (bottom panel), such as a spherical JSP. The fluid jet in the case of the disrupter with the RevJet and the JSP clearly exhibits less atomization of the fluid, as reflected by the relatively confined and well-defined fluid jet.

In general the terms and phrases used herein have their art-recognized meaning, which can be found by reference to standard texts, journal references and contexts known to those skilled in the art. Referring to the drawings, like numerals indicate like elements and the same number appearing in more than one drawing refers to the same element. The following definitions are provided to clarify their specific use in the context of the invention.

The term "breech" refers to the portion of the barrel of the propellant driven disrupter in which an explosive cartridge is positioned.

"Distal" refers to a direction that is furthest from the breech or the explosive cartridge, or that is closest to the to-be-disrupted target. "Proximal" refers to a direction that is toward the explosive cartridge or that is furthest from the to-be-disrupted target. Each of the terms distal and proximal may thus be used to describe portions, regions, and ends of components, systems, devices, and elements, such as portions, regions, and ends of a JSP, a barrel, a container, and a projectile liquid. For example, a proximal portion or end of a JSP is the portion or end closest to or facing toward the explosive cartridge or that is furthest from the to-be-disrupted target. For example, a distal portion or end of a JSP is the portion or end furthest from the breech or the explosive cartridge, or that is closest to the to-be-disrupted target.

The term "effective" with regard to a property such as viscosity, density, surface tension refers to an average measure of a property, including for a composite material that is formed of a combination of different materials. For example, a fluid mixture having multiple fluids and/or solid particles can be characterized as having an effective density or viscosity, which is a weighted average or bulk measure of the density or viscosity of the constituents of the fluid mixture. When applied to a fluid property, the term "effective" may refer to a mass-weighted average of the fluid and its constituents. When applied to a fluid property, the term "effective" may refer to a volume-weighted average of the fluid and its constituents. When applied to a fluid property, the term "effective" may refer to a bulk property of the fluid and its constituents. Accordingly, the term "distribution" reflects a material having different constituents, such that some areas have a higher value than others. In the context of a JSP formed of materials of different densities, or having one or more voids, such as an internal compartment, the density distribution may spatially-vary with position in the JSP. In this manner, the CG of the JSP can be manipulated, including by use of dense embedded materials favoring a distal portion of the JSP, internal compartment voids favoring the proximal portion of the JSP, and/or internal compartments filled with material of higher density than the bulk material that forms the JSP.

The term "suspended" with regard to solid particles in a fluid refers to a suspension, or a mixture of solid particles in a fluid wherein the solid particles are thermodynamically favored to precipitate or sediment out of the fluid solution. The suspension may appear uniform, particularly after agitation, (i.e., solid particles macroscopically evenly distributed in the fluid). The suspension is typically microscopically heterogeneous. In an embodiment, solid particles in a suspension are one micrometer or larger in diameter, including up to 1 cm, and any sub-ranges thereof. The solid particles of a suspension may be visible to the human eye. Solid particles in a suspension may appear uniformly mixed, particularly after agitation, but are undergoing sedimentation. The solid particles may remain suspended in the solution on short time scales (e.g., less than one minute) or indefinitely kinetically (i.e., in contrast to thermodynamically). As used herein, solid particles suspended in a fluid may refer to particles fully sedimented (e.g., lead shot particles settled to the bottom of a container with a highly viscous liquid such as syrup that hinders movement of the particles). As desired, a physical barrier may be positioned in the container so as to confine particles to a specific location, particularly for fluids through which the particles may otherwise readily traverse.

The term "shape" of a JSP may refer to an overall shape of the JSP, such as a cross-sectional shape or cross-sectional contour of an outer surface of the JSP, or a shape of a portion of the JSP, where the portion of the JSP may be a distal portion, an outer surface of the distal portion, a proximal portion, or an outer surface at the proximal portion. Selecting a shape of a JSP, or portion thereof, optionally includes selecting relative and/or absolute dimensions characterizing the JSP, or any portion thereof.

The term "dispersed" in regard to solid particles in a fluid refers to a dispersion, or a microscopically homogenous, or uniform, mixture of solid particles in a fluid. Similarly to a suspension, a dispersion may be thermodynamically favored to segregate by sedimentation but wherein sedimentation is kinetically slowed or prevented. As used herein, a dispersion is a microscopically homogenous mixture having solid particles that are less than one micrometer in diameter. One example of a dispersion is a colloid (e.g., milk, tea, and coffee).

The term "jet length" refers to the length of a column of fluid propelled out of a barrel muzzle. As a fluid is propelled out of the disrupter, it tends to disperse and undergo atomization. Thus, jet length may vary with time elapsed since leaving the muzzle and, consequently, vary with the distance from the muzzle.

The term "atomization" refers to the dispersion of a portion of the propelled fluid out of the jet and into a cloud of fluid droplets surrounding the fluid jet. Atomization is one process that reduces the jet length and integrity. Atomized fluid is not included in the determination of jet length.

The term "jet length at impact" refers to the jet length at the initial moment of impact between the fluid jet and the target.

The term "jet duration" or "fluid jet duration" refers to the time until the fluid is completely atomized or dissipated and no jet, or collimated fluid, remains.

The term "jet impact duration" refers to the total time the fluid jet imparts force or work on the target. The jet impact duration is a function of jet length at impact and jet velocity during impact.

The term "reverse velocity gradient" refers to an explosively propelled fluid in a barrel disrupter having a fluid proximal end having a higher velocity than the fluid distal end, such that upon exit from the muzzle, there is an adverse impacting on one or more fluid jet parameters, resulting in premature jet breakdown and decrease in disruptive power. Provided herein are various fluid jet enhancement adapters and methods that can minimize the reverse jet velocity gradient, thereby improving one or more fluid jet parameters, including by an improvement of a fluid jet parameter by at least 10%, at least 20%, at least 50% or at least 100% compared to the same projectile liquid fired from the same or comparable disrupter but without any of the adapters disclosed herein. U.S. Pat. No. 10,451,378 and U.S. Pub. no. 2020/0056858 titled "Reverse Velocity Jet Tamper Disrupter Enhancer" are specifically incorporated by reference herein for the adapters and methods of reducing a reverse velocity gradient to provide improved target disruption arising from improved fluid jet and JSP flight stability.

The term "jet fluid velocity" or "fluid jet velocity" is used broadly herein and refers to a characteristic average velocity, such as the average velocity of the entire fluid jet or the average velocity of a leading edge of the jet.

As used herein, the terms "fluid jet", "jet fluid", "fluid-jet", and "jet-fluid" are used interchangeably to refer to the jet of fluid formed when the projectile liquid is propelled from the barrel of the disrupter toward a target. For example, a fluid jet is the jet of fluid a point between the disrupter and the target after the projectile liquid is propelled out of the barrel.

"Volumetric destruction" refers to a disrupted, destroyed, or other physically altered volume of the target by the propelled and target impacted fluid jet. Destruction may be by physical release of material of the volume and/or functional destruction, such as release of a battery from a circuit, disruption of power circuits, or other circuit disruption, where a goal defeating an IED before an unwanted explosion occurs.

As used herein, "cap" and "plug" are used broadly to refer to a physical seal of a container having fluid, such as a liquid. The cap or plug may refer to a seal of a container encapsulating a HEET fluid for example, such that an encapsulated fluid may be positioned within the disrupter barrel. The cap or plug may refer to a seal applied within the disrupter barrel or at the muzzle end of the disrupter barrel to seal otherwise un-encapsulated fluid within the disrupter barrel (e.g., a fluid may be poured into the disrupter barrel and then a plug may be applied to seal the fluid within the barrel). Any JSP described herein may be a cap or plug, such as to fluidically seal a projectile liquid in a container and/or in a barrel of a PDD.

The terms "fluidic seal" and "fluidic plug" are used interchangeably and refer to a physical plug, such as a JSP, that seals or plugs a liquid in a container and/or in a barrel such that the liquid cannot or does not escape the container or barrel where fluidically plugged or fluidically sealed until the fluidic seal or plug is removed, such as by being propelled from a PDD. For example, a JSP may be inserted into a muzzle end of a barrel of a PDD and fluidically plug a projectile liquid that is located in a breech end of the barrel, such that the projectile liquid cannot and/or does not flow past the JSP toward the muzzle end and out the muzzle end of the barrel, even if the barrel is rotated in any direction (e.g., muzzle facing down toward ground), until the projectile liquid and JSP are propelled out of the barrel of the PDD, such as by exploding an explosive cartridge in the PDD. To further assist in sealing the barrel, a seal, such as an o-ring, viscous immiscible fluid, or fluid barriers, including formed of flexible materials, may be positioned between the JSP and barrel lumen.

"Operably connected" refers to a configuration of elements, wherein an action or reaction of one element affects another element, but in a manner that preserves each element's functionality. For example, the adapter is operably connected to the muzzle end of the disrupter barrel such that a projectile liquid that is expelled from the disrupter barrel may enter the adapter's longitudinal region lumen without loss of pressure or fluid mass. For example, a JSP may be in operable connection with a projectile liquid such that the projectile liquid and the JSP may be propelled and expelled out of the barrel together and form a fluid jet in physical contact with at least a proximal end of the JSP after being propelled (or fired) from the PDD barrel, such as by exploding an explosive cartridge in the breech end of the PDD. The connection may be by a direct physical contact between elements. For example, at least a portion (e.g., proximal end) of the JSP may be in direct physical contact with the projectile liquid inside the barrel of the PDD. The connection may be indirect, with another element that indirectly connects the operably connected elements. For example, the JSP may be in operable connection with the projectile liquid, when inside the barrel of the PDD, though physically separated from the projectile liquid by a membrane or a container or other material positioned between the liquid and the JSP in the barrel.

The terms "directly and indirectly" describe the actions or physical positions of one component relative to another component. For example, a component that "directly" acts upon or touches another component does so without intervention from an intermediary. In contrast, a component that "indirectly" acts upon or touches another component does so through an intermediary (e.g., a third component).

The term "substantially equivalent" refers to one or more properties of two or more elements that are within 10%, within 5%, within 1%, or are equivalent. For example, the diameter of an element A is substantially equivalent to the diameter of an element B if these diameters are within 10%, within 5%, within 1%, or are equivalent.

The term "radially isolates" refers to an adapter barrel wall that prevents release of liquid in a radial direction, and instead forces all fluid out of the adapter distal muzzle end. Accordingly, substantially all fluid that enters the adapter lumen at the first (proximal) end ultimately exists the adapter lumen through the second (distal) adapter end.

The term "conventional disrupter" or "dearmer" refers to any commercially-available directional propellant-driven disrupter device having a barrel for ejecting a projectile (e.g., fluid jet) at a target explosive for disruption of said explosive, without a JSP and/or an adapter described herein. Exemplary conventional disrupters include Percussion Actuated Non-Electric (PAN), Pigstick, Water Jet Disrupter Cannon, and similar disrupters.

"Sharp corner shape transition" refers to a discontinuity between two surface, wherein there is an abrupt change in slope, including by a right-angle corner or non-right angle corner.

The term "fluid jet parameter" refers to a parameter useful in describing a characteristic or quality of a fluid jet expelled from the disrupter. Exemplary fluid jet parameters include, but are not limited to, jet integrity, jet length, jet impact duration on target, jet velocity, reverse velocity gradient, jet diameter, penetration depth, momentum on target, energy on target, impact pressure time-course, effective stand-off distance, barrier thickness limit, component kill, and explosive impact dynamics. As described, the improvement in fluid jet parameter may be quantified, as appropriate, such as an improvement of at least 10%, 25%, 50% or 100% compared to an equivalent system without a JSP, compared to without a JSP and a RevJet (fluid jet enhancement adapter).

The term "characteristic fluid jet diameter" refers to a measure of a diameter of the fluid jet expelled from the barrel. It may be an average diameter over the discernable length of the fluid jet, or may be a diameter at a defined location over time, such as the distal end (e.g., the jet tip), the proximal end (e.g., the jet rear), or a mid-way point between the leading distal end and the trailing proximal end.

Rarefaction is an art-recognized term referring to the reflection of a pressure wave at an interface due to a shock impedance mismatch. The term rarefaction waves refers to the pressure waves themselves that are moving back and forth in the fluid column and cause a reduction in the density (i.e., opposite of compression) of a fluid or other projectile. Rarefaction waves are tensile waves. The waves cause a loss in fluid mass due to radial (hoop) dispersion and mixing of the fluid with air. The term "rarefaction wave amplitude" refers to the maximum change in density from the mean density.

The term "shock initiation event" refers to an explosion, detonation, or other unwanted failure of the target caused by shock delivered by the projectile (e.g., fluid jet) onto the target (e.g., the target explosive device may detonate as a result of the imparted shock during transfer of energy from the fluid jet to the target device). The term "probability of a shock initiation event" refers to the statistical probability of the projectile (e.g., fluid jet) causing a shock initiation event, for a particular disrupter and projectile system. The probability of a shock initiation event is affected, for example, by the velocity, density, and cross-sectional area of the fluid jet, which is affected by barrel length and adapter length, for example.

The term "stand-off distance" refers to the maximal distance from the target at which the fluid jet may be fired to achieve target disruption safely. The nominal stand-off distance refers to the distance resulting in optimum performance. Generally, the RevJet adapters provided herein facilitate an increase in stand-off distance without adversely impact target disruption.

In the following description, numerous specific details of the devices, device components and methods of the present invention are set forth in order to provide a thorough explanation of the precise nature of the invention. It will be apparent, however, to those of skill in the art that the invention can be practiced without these specific details.

Figure 6:
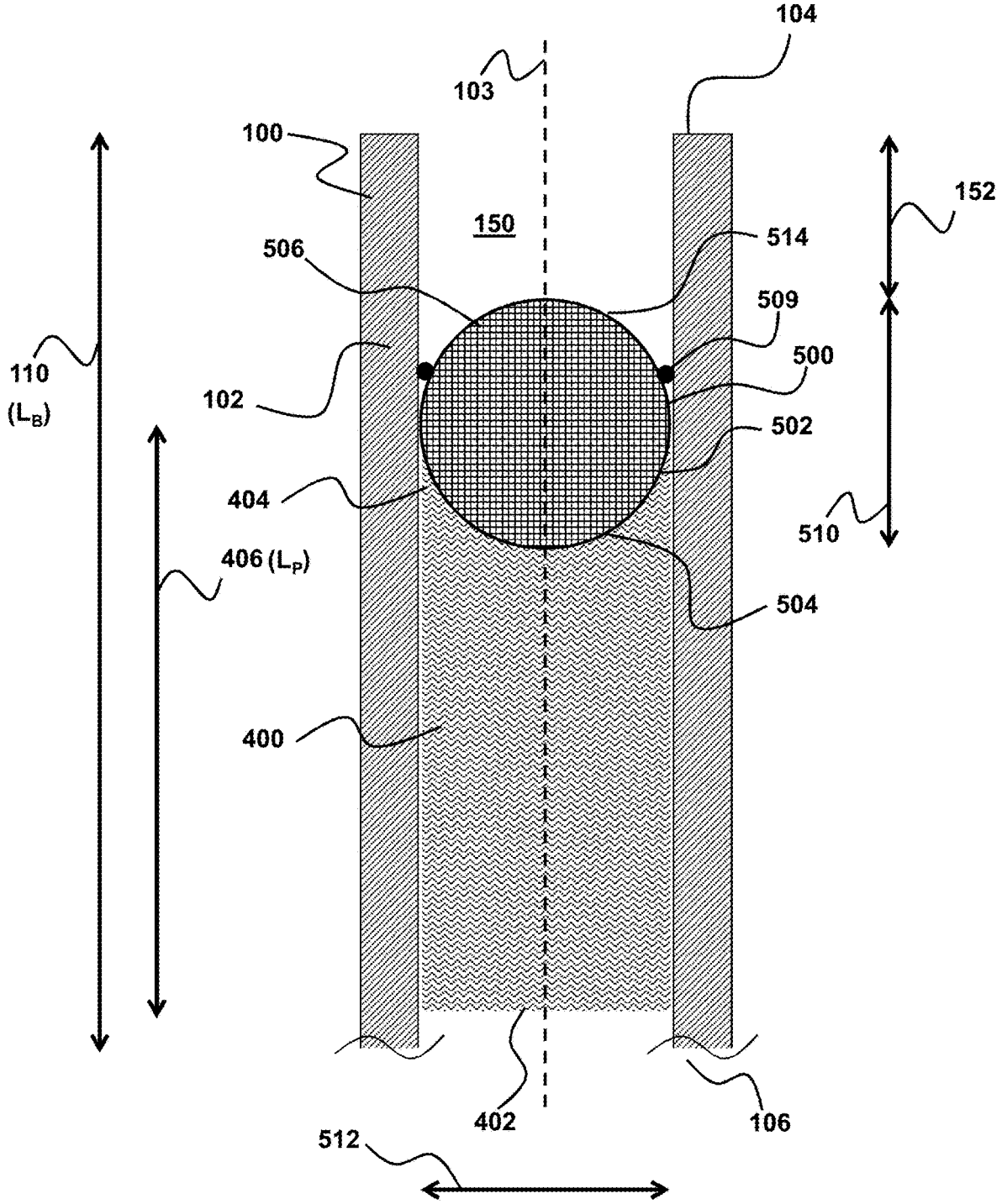
FIG. 6 is a schematic of a PDD barrel including a JSP and a projectile liquid in the barrel, according to some embodiments.
Figure 7:
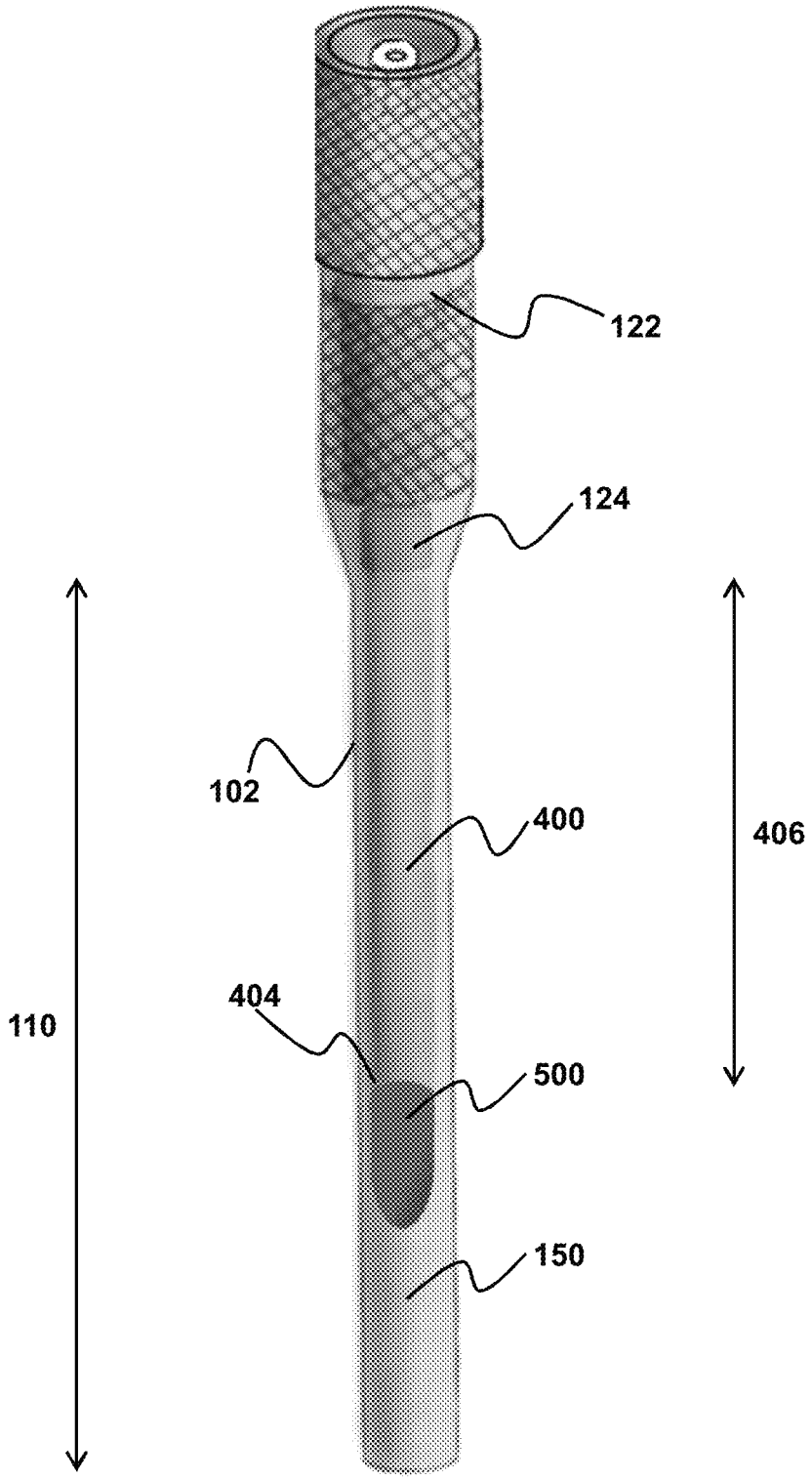
FIG. 7 is a schematic of an exemplary PDD with a projectile liquid in a container and JSP in the barrel, according to some embodiments.
Figure 8:
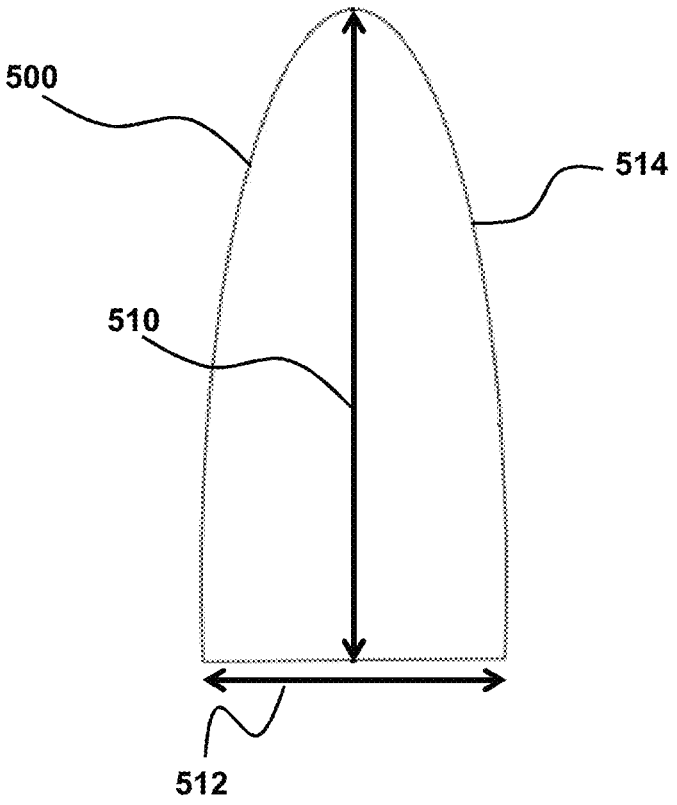
FIG. 8 is a schematic of a JSP, according to some embodiments.
Figure 9:
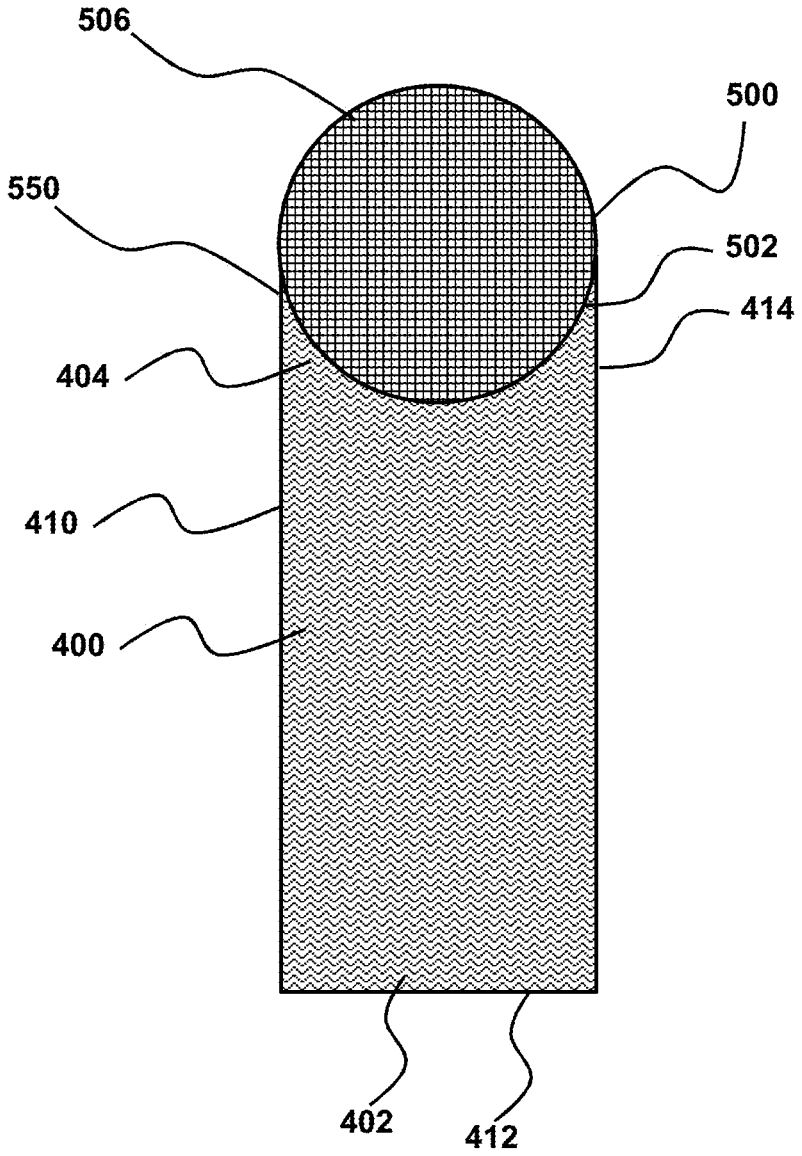
FIG. 9 is a schematic of an exemplary projectile system, according to certain embodiments, including a container, a projectile liquid, and a JSP fluidically plugging the projectile liquid in the container.
Figure 9:
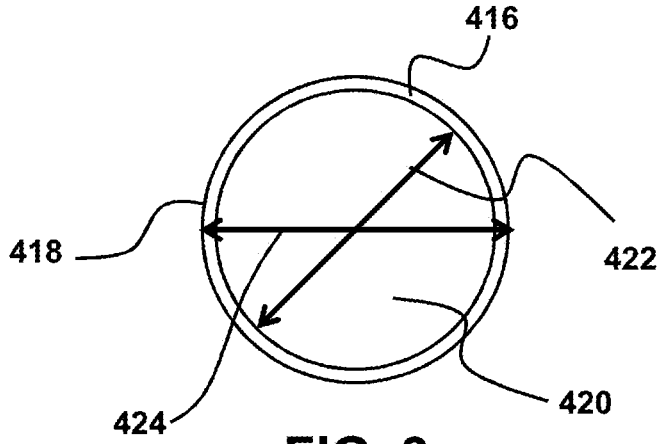
Figure 10:
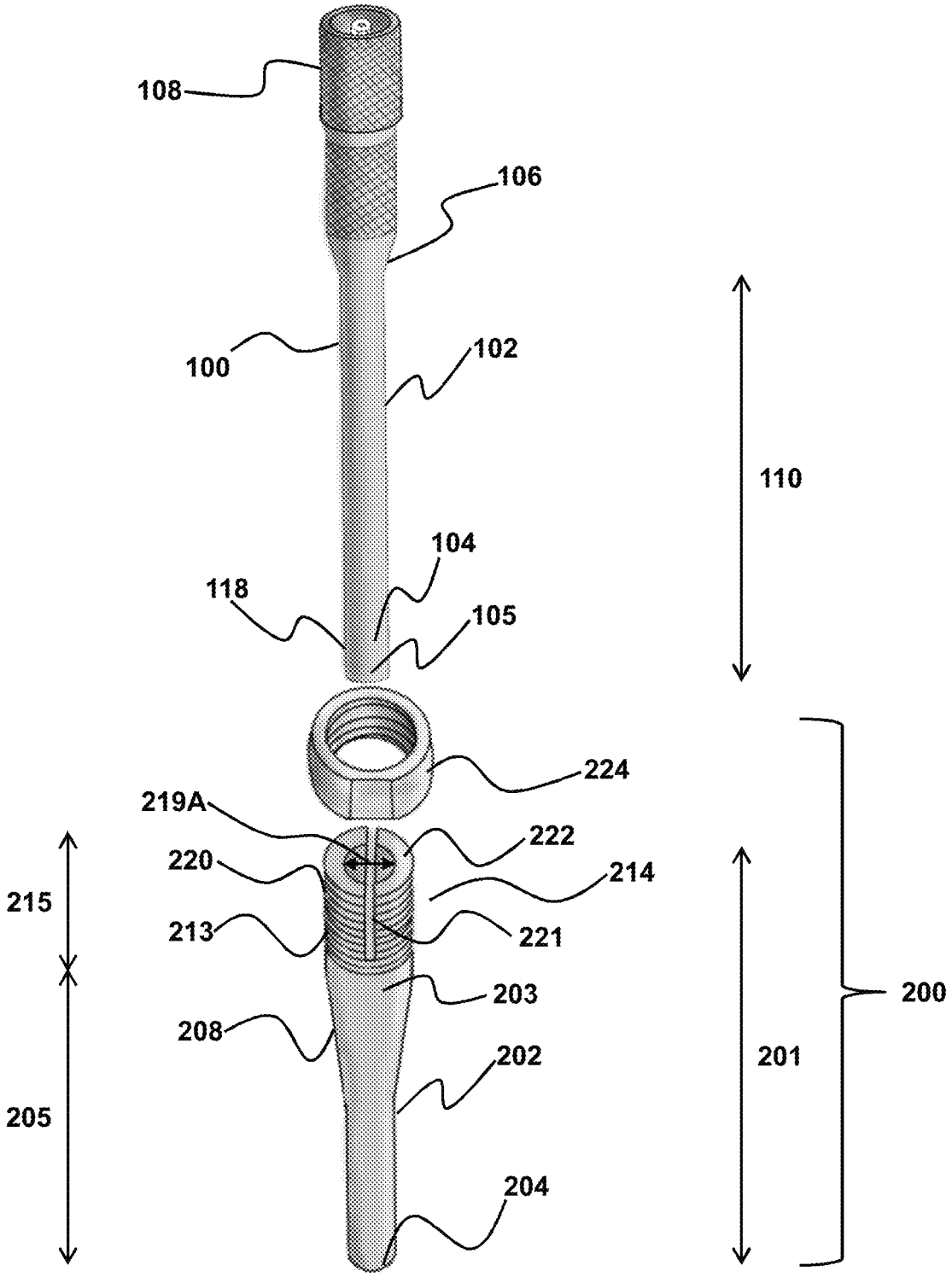
FIG. 10 is an illustration showing a portion of a propellant driven disrupter, including the barrel, and disassembled components of an exemplary fluid jet enhancement adapter.
Figure 11A:
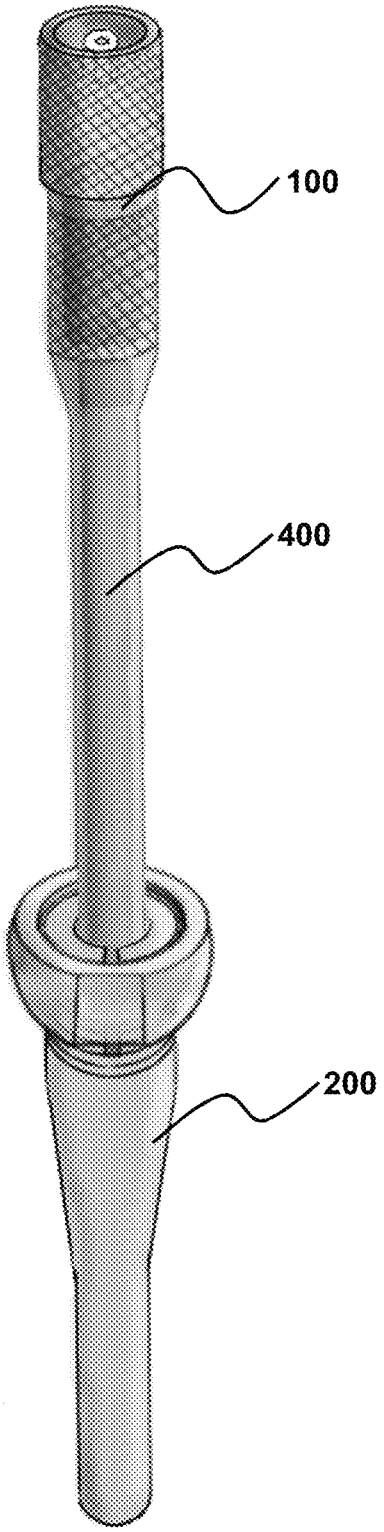
FIGS. 11A and 11B are illustrations showing the disrupter of FIG. 1 with a projectile liquid therein and the adapter of FIG. 1 operably connected to the disrupter.
Figure 11B:
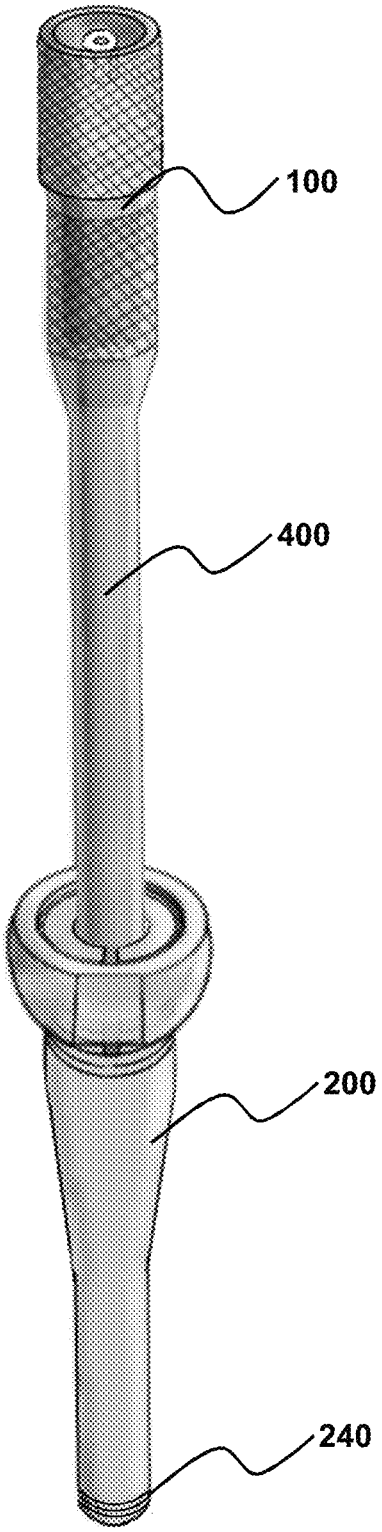
Figure 12:
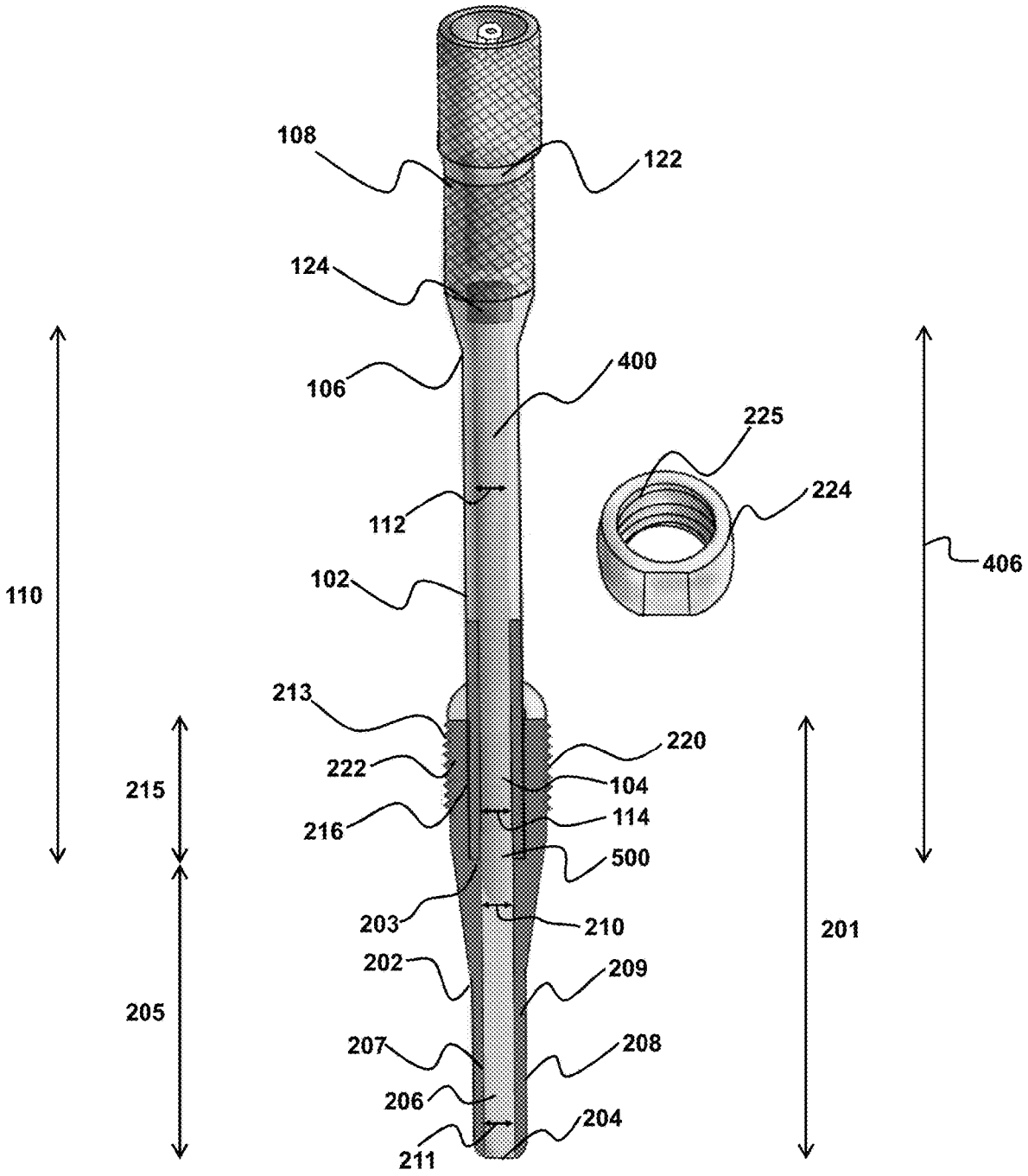
FIG. 12 is a partial cross-sectional illustration of a disrupter and adapter, with the nut shown separately from the adapter for visual clarity.
Figure 13:
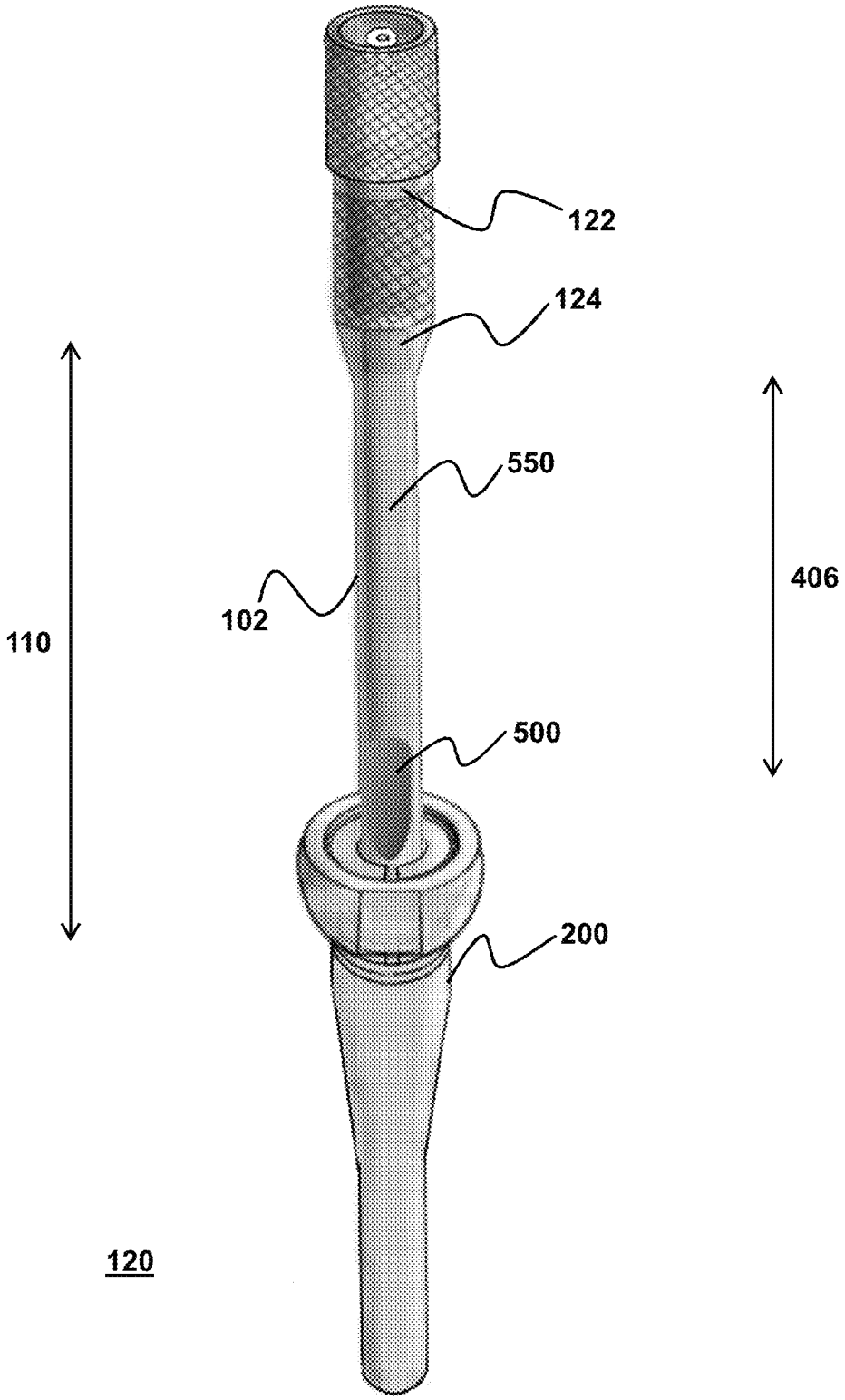
FIG. 13 is an illustration showing a disrupter and projectile with an exemplary fluid jet enhancement adapter operably connected thereto.

FIG. 6 is a schematic showing a barrel of an exemplary PDD including a JSP and a projectile liquid in the barrel, according to some embodiments. FIG. 7 is a schematic of an exemplary PDD with a projectile liquid and JSP in the barrel, according to some embodiments. FIG. 8 is a schematic of a JSP, according to some embodiments. FIG. 9 is a schematic of an exemplary projectile system, according to certain embodiments, including a container, a projectile liquid, and a JSP fluidically plugging the projectile liquid in the container. FIG. 10 is an illustration showing a portion of a propellant driven disrupter, including the barrel, and disassembled components of an exemplary fluid jet enhancement adapter. FIGS. 11A and 11B are illustrations showing the disrupter of FIG. 1 with a projectile liquid therein and the adapter of FIG. 1 operably connected to the disrupter. In FIG. 11B, the second end of the adapter includes a threaded surface. FIG. 12 is a partially cross-sectional illustration of the disrupter and adapter of FIG. 11A, with the nut shown separately from the adapter for visual clarity. FIG. 13 is an illustration showing the disrupter and projectile of FIG. 7 with an exemplary fluid jet enhancement adapter operably connected thereto. For clarity, FIGS. 6-13 may be viewed together with the following description.

A propellant driven disrupter 100 may be a conventional disrupter such as a PAN disrupter. Disrupter 100 includes a disrupter barrel 102 having a breech end 106 and a muzzle end 104. The muzzle end is the distal portion 105 of the disrupter barrel. Barrel 102 has a barrel lumen having a barrel lumen inner diameter 112. Barrel 102 has a muzzle end inner diameter 114 and a muzzle end outer diameter 116, defining a muzzle end outer surface 118. Barrel 102 has a barrel length 110. Disrupter 100 also includes a breech 108, which may be loaded with an explosive cartridge 122 (e.g., an explosive blank). Breech 108 may be a proximal portion of barrel 102 or a separate compartment that is operably connected to barrel 102. The lumen of barrel 102 may be loaded with a projectile liquid 400. Projectile liquid 400 may include a jet stabilizing projectile (JSP) 500 that retains (forms a fluidic plug) the liquid of projectile liquid 400 at the distal end of projectile liquid 400 within barrel 102. Proximal end 402 of projectile liquid 400 may be capped or sealed. Projectile liquid 400 may be prepared by filling at least a portion of the lumen of barrel 102 with one or more liquids (e.g., water), and then plugging the liquid within barrel 102 with JSP 500, optionally using a rammer or ramrod. Alternatively, projectile liquid 400 may be a partially or fully encapsulated projectile liquid. Fully encapsulated projectile liquid 400, such as HEET fluid, may be loaded into the lumen of barrel 102 such that the wall of barrel lumen 102 does not physically contact the projectile liquid 400.

For example, FIG. 6 illustrates a projectile liquid 400 in barrel 102 of propellant driven disrupter (PDD) 100. PDD 100 includes a JSP 500 in barrel 102, the jet stabilizing projectile (JSP) 500 being in operable connection with a distal end 404 of projectile liquid 400. JSP 500 may form a fluidic plug retaining projectile liquid 400 in barrel 102. For example, a proximal end or proximal portion 502 of JSP 500 physically contacts projectile liquid 400, though a physical contact is not necessary for an operable connection between the two. A seal 509 positioned between a JSP outer surface and lumen surface of the barrel may form a fluidic plug to prevent unwanted liquid loss. JSP 500 also has a distal end 506 facing toward the muzzle end 104 of barrel 102 (e.g., facing toward a target). As illustrated in FIG. 6, PDD 100 may include an air space 150 between muzzle end 104 and distal end 506 of JSP 500. Air-space 150 may improve fluid jet parameters, when compared to loading projectile liquid 400 and JSP 500 such that there is no air-space 150 (e.g., JSP seals muzzle end). Projectile liquid 400 is characterized by a projectile liquid length 406, which may be less than barrel length 110, such as when there is an air-space 150. Air-space 150 is characterized by an air-space length 152, which may be measured from a distal end (e.g., distal-most end) of JSP 500 to the muzzle end 104. With respect to air-space 150, it is noted that reducing the fluid jet length to increase performance characteristics, such as a fluid jet with or without a JSP, is counterintuitive, and is one of the many examples of unexpected benefits achieved by the technical solutions provided herein. As conventionally understood, the ideal penetration equation for fluid-fluid interactions predicts that the penetration is proportional to a fluid jet length. However, this equation does not account for a reverse velocity gradient in the fluid jet. Using a fluid jet enhancement adapter, such as a RevJet, and even replacing the liquid in the barrel with a gas such as air, and/or reducing the projectile liquid length in the barrel to less than the length of the barrel, is counterintuitive and provides for improved performance characteristics. JSP 500 may be characterized by a longitudinal length 510, which is a length of JSP 500 from a proximal-most end to a distal-most end of JSP 500 along a longitudinal axis of JSP 500, which is coincident with a longitudinal axis 103 of barrel 102. JSP 500 may have a variety of shapes. For example, JSP 500 may be spherical, such as illustrated in FIG. 6. For example, JSP 500 may have an ogive shape, such as illustrated in FIG. 8. JSP 500 is also characterized by an outer surface 514. As depicted in FIG. 6, 100% of the JSP is positioned within barrel 102. Optionally, 50% to 100%, inclusively, of the JSP is positioned within barrel 102, where the 50% to 100% value may be with respect to longitudinal length 510 of JSP 500.

FIG. 9 illustrates a projectile system 550, which includes JSP 500 forming a fluidic plug to retain projectile liquid 400 in container 410. Container 410 has a proximal end 412, configured to face a breech end of a barrel, and a distal end 414, configured to be in operably connection with JSP 500. JSP 500 may be in physical contact with container 410, or a portion of the wall 416 of container 410, at distal end 414 of container 410. Container 410 has a lumen 420 having projectile liquid 400 therein. Container 410 has an inner diameter 422 of the lumen and an outer diameter 424 of the container. Container 410 has an outer surface 418. Outer surface 418 is configured to be in operably connection, optionally in physical connection, with an inner surface of barrel 102 when loaded in PDD 100. Projectile system 550 may further include an explosive cartridge in operable connection with container proximal end 412 and/or in operable connection with projectile liquid 400. Optionally, the explosive cartridge forms the proximal end 412 and the explosive cartridge is in physical contact with projectile liquid 400.

FIG. 10 illustrates a disassembled exemplary adapter 200 and a portion of a propellant driven disrupter 100. FIGS. 11A and 11B illustrate disrupter 100, including projectile liquid 400 therein, and adapter 200 assembled and operably connected to disrupter 100, and FIG. 12 illustrates a partial cross-section of the disrupter 100 and adapter 200 of FIG. 11A or 11B. Adapter 200 of adapter length 201 includes a longitudinal region 202 that may be operably connected to barrel muzzle end 104 at the first end 203 of longitudinal region 202 (an operably connection is illustrated in FIG. 11A or 11B). Longitudinal region 202 has a second end 204 where an expelled projectile liquid 400 may exit adapter 200. Longitudinal region 202 has a length 205 between first end 203 and second end 204. Longitudinal region 202 has a longitudinal region lumen 206 having an inner surface 207. A longitudinal region wall 209 separates inner surface 207 from longitudinal region outer surface 208 by a wall thickness 226. Longitudinal region lumen 206 has a first end inner diameter 210 at first end 203 and a second end inner diameter 211 at second end 204. Optionally, projectile liquid 400 and JSP 500 illustrated in FIGS. 7, 11A, 11B, and 12 are part of projectile system 550 loaded in PDD 110.

Adapter 200 may include a connector 213 at or extending from first end 203 of longitudinal region 202. When adapter 200 includes connector 213, adapter length 201 includes longitudinal region length 205 and connector length 215. The exemplary adapter 200 of FIGS. 1-3 includes a connector 213 for mounting onto—or otherwise operably connecting to—muzzle end 104 of barrel 102. At least a portion of connector 213 is a collet 222 which includes two kerf cuts 221. This connector 213 has outer surface 217 having threads or grooves 220. Connector 213 further includes a nut 224 with inner threads or grooves 225 which correspond to threads or groove 220 such that nut 224 may be rotationally tightened onto outer surface 217 of connector 213. Connector 213 further includes a lumen having an inner surface 216. Connector 213 is at proximal region 214 of adapter 200 and proximal region 214 has a resting proximal diameter 219A (inner) which may be greater than proximal lumen diameter 219B (inner). Resting proximal diameter 219A (inner) is selected such that adapter 200 may be secured to the barrel when nut 224 is tightened over at least a portion of collet 222 and outer surface 217, proximal region inner diameter (inner diameter of connector 213) is reduced from resting proximal diameter 219A (inner) to proximal lumen diameter 219B (inner), which provides a compression fit. The proximal lumen diameter 219B (inner) is substantially equivalent to or minimally greater than muzzle end outer diameter 116 in order to tightly (e.g., hand tight) accommodate a portion of muzzle end 104. This exemplary connector 213 forms a friction fit over muzzle end 104.

Any of the adapters described herein may be compatible with a wide range of connection mechanism types and configurations. For example, adapter 200 may include connector 213 that is adapted to connect adapter 200 to a disrupter 100 via a screw-type connection such that connector 213 and muzzle end 104 having corresponding threads (e.g., connector 213 may be screwed onto and over muzzle end 104 having threads at outer surface 118 or connector 213 may be screwed into muzzle end 104 having corresponding threads at the inner surface of muzzle end 104). In another example, connector 213 may be configured to allow adapter 200 to be inserted into muzzle end 104 and held in place via friction. In yet another example, connector 213 may be configured to tightly fit over muzzle end 104 via friction and optionally further tightened via a clamp (i.e., no threads in this example). When adapter 200 is operably connected to disrupter 100, the connection is such that substantially no fluid is lost to a surrounding environment (air) 120 as fluid exits barrel 102 and enters adapter 200 and such that adapter 200 remains connected to barrel 102 after projectile liquid 400 is fully expelled from adapter 200. Adapter 200 may remain operably connected to barrel 102 after at least one, at least two, at least five, or at least ten uses of disrupter 100 (wherein use of disrupter 100 constitutes firing of a projectile). Connecter 213 may have one or more, two or more, three or more, or four or more kerf cuts. Any of the elements and/or portions of connector 213 may be formed of substantially the same material(s) as longitudinal region 202. Any of the elements and/or portions of connector 213 may be formed of different material(s) than longitudinal region 202 (e.g., nut 224, if used, may be formed of a different metal than connector 213 or longitudinal region 202). Optionally, an adhesive may be used between connector 213 and barrel 102. Alternatively, adapter 200 may be operably connected at first end 203 to muzzle end 104 via such that adapter 200 does not include connector 213. In another example, adapter 200 may be operably connected to muzzle end 104 via a tongue and groove type connection mechanism, wherein connector 213 is formed as a radially configured tongue and muzzle end 104 includes a corresponding radial groove, or vice versa. A clamp and/or an adhesive may be further used in the previous example to further increase tightness of fit.

Figure 14:
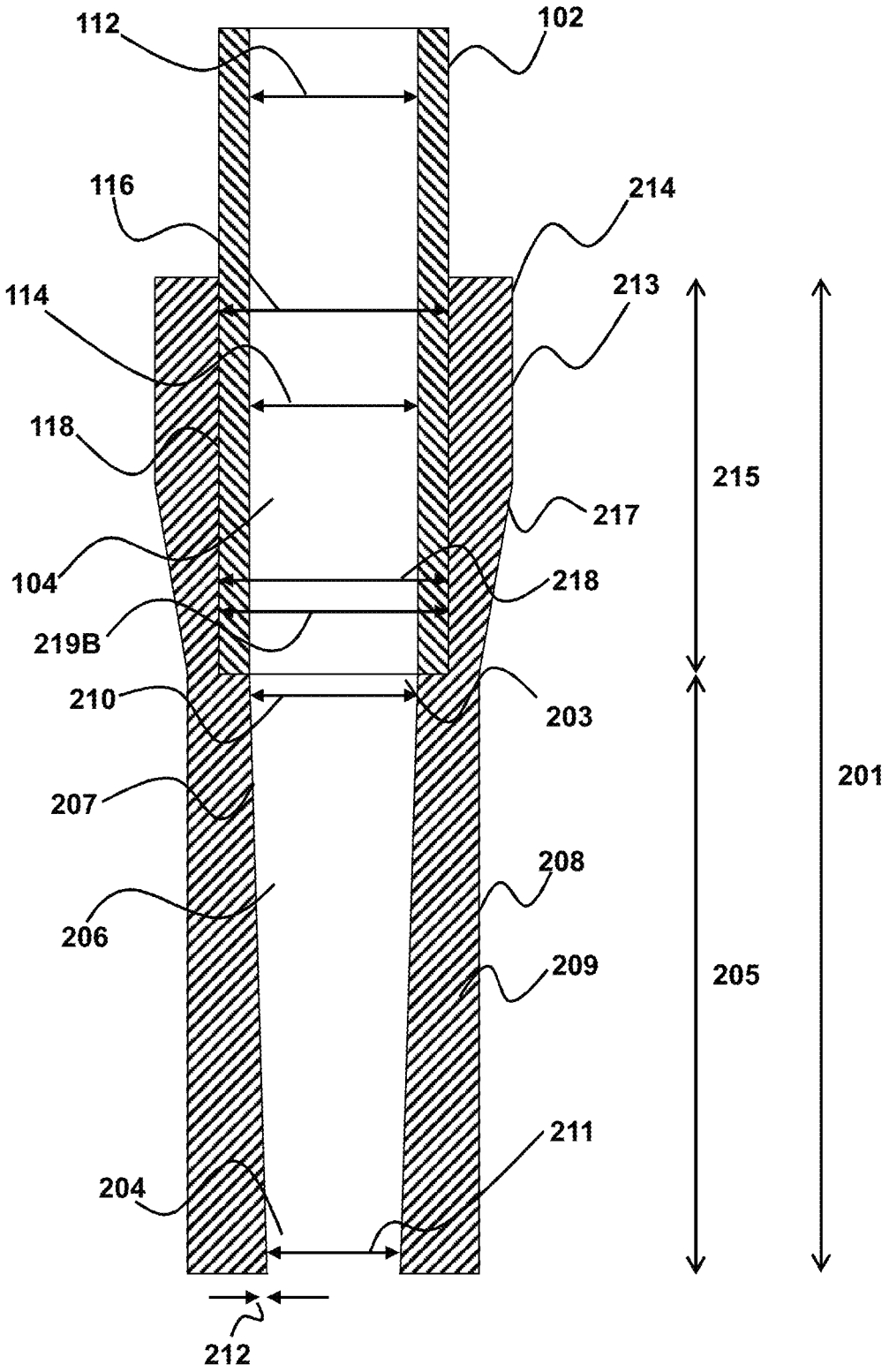
FIG. 14 is a cross-sectional illustration showing a portion of a muzzle portion of a disrupter barrel and an exemplary adapter having a taper.

FIG. 14 illustrates an exemplary adapter 200 operably connected to barrel 102 at muzzle end 104. Adapter 200 is, for example, pressure fit by sliding connector 213 over muzzle end 104 and a clamp (not shown) may be tightened over connector 213 to increase tightness of fit. FIG. 14 shows adapter 200 having a taper 212. Taper 212 may be described by an angle (e.g., 1° or more, 5° or less, or between 1° and 5°), a length, and/or a ratio of inner diameters (e.g., ratio of first end inner diameter to second end inner diameter). For visual clarity, FIG. 14 illustrates taper 212 by the difference in radii between the first end inner radius and the second end inner radius dimensions.

Longitudinal region wall thickness 226 may be uniform or non-uniform over length 205 of longitudinal region 202. For example, wall thickness 226 is non-uniform where longitudinal region inner diameter changes while longitudinal region outer diameter remains unchanged. For example, wall thickness 226 is non-uniform where longitudinal region outer diameter changes while longitudinal region inner diameter remains unchanged (e.g., if outer surface 208/outer diameter is configured to include a taper such as illustrated in FIGS. 10, 11A-11B, and 8). For example, wall thickness 226 is non-uniform where the inner and outer diameters of longitudinal region 202 both change by different amounts.

The entirety of adapter 200 may be formed of a single material or combination of materials (e.g., entire adapter 200 is formed of stainless steel). Any one or a more elements of adapter 200 (e.g., connector 213 or nut 224) may be formed of a different material or different combination of materials than are other elements of adapter 200. For example, longitudinal region outer surface 208 may be at least partially formed of a different material than substantially the remainder of adapter 200. For example, outer surface 208 may include a partial or full coating, such as a coating configured to prevent corrosion, formed of a different material than are other elements of adapter 200 (e.g., aircraft grade aluminum). Adapter 200 may be uniformly or non-uniformly formed of one or more metals (e.g., stainless steel or aircraft aluminum), one or more ceramic materials (e.g., alumina), one or more polymer or plastic materials, carbon fiber, or of any combination of these.

Longitudinal region length 205 may between 20% and 200% of fluid-projectile length 406. Length 205 may be empirically determined for any disrupter system according to disrupter 100 parameters (e.g., length and cartridge 122 characteristics) and/or projectile liquid parameters (e.g., composition). Projectile liquid length 406 may be substantially equivalent to barrel length 110 (e.g., FIG. 11A or 11B and 12). Projectile liquid length 406 may be less than barrel length 110 (e.g., FIG. 13). Additionally, for example, any of taper 212, wall thickness 226, and composition material(s)

in adapter 200 may be empirically determined for any disrupter system according to disrupter 100 parameters, projectile liquid parameters (e.g., composition), and/or desired improvement in target disruption parameters (e.g., fluid jet length, impact pressure, reverse fluid jet velocity, etc.).

The invention can be further understood by the following non-limiting examples.

Example 1: JSP Used with ReVJeT and Water Fluid Jets

Provided herein are jet stabilizing projectile (JSP) that reduce the hydrodynamic and aerodynamic stresses on a fluid jet. The water jets of propellant-driven disrupters such as the Percussion Actuated Non-Electric (PAN) Disrupter are inherently unstable and break up due to atomization after a short distance of flight. In addition, air drag at the jet tip and shock perturbations inside the water column produced by the breech explosion further degrade the jet. All these physical stresses work together to cause the jet to atomize primarily in the jet tip region. The JSP provided herein is used to seal the bore at the muzzle and traps the water inside the disrupter barrel. Although the JSP will benefit all disrupters, a ReVJeT disrupter enhancer (see, e.g., U.S. patent application Ser. No. 16/366,487 filed Mar. 27, 2019; Ser. No. 15/896,760 filed Feb. 14, 2018, each of which are specifically incorporated by reference for the adapters, fluids, and reverse velocity jet tamper disrupter enhancers described therein) used along with the JSP is preferred due to the increased free-flight travel and improved JSP flight stability. For the purposes of describing the benefits of the invention, the discussion below focuses on using the ReVJeT to drive the JSP. After the disrupter is fired, the ReVJeT causes the JSP and the water column to accelerate in such a way that the water jet has a relatively uniform velocity throughout. The JSP moves at the water jet front.

For background, propellant-driven disrupters are versatile in the types of projectiles they can shoot. Of particular importance is the fact that this type of disrupter can drive fluid jets at high velocity. Fluid jets are very efficient at momentum and energy transfer and produce relatively low impact pressures. Although the most commonly used fluid is water, HEET fluids (see, e.g., U.S. patent application Ser. No. 15/731,874 filed Aug. 18, 2017, which is specifically incorporated herein for the HEET fluids and systems described therein) can also be fired from these disrupters. For the purposes of explaining the invention, water and HEET jets should be considered interchangeable. Disrupters are similar in design to cannons and generally are composed of a separate breech attachment and barrel constituting a cartridge chamber, forcing cone, and a bore. A blank cartridge filled with propellant is placed in the chamber of the disrupter and is confined by attaching the breech. Fluids are poured into the bore of the disrupter which is typically sealed chamber-side and at the muzzle with hollow, thin-walled caps or plugs. The purpose is to create a water-tight membrane that has no influence on the jet and only serves the function of preventing bore leakage. High speed videos show the muzzle caps get pushed out of the jet path, probably due to the reverse velocity gradient, except when the ReVJeT disrupter enhancer is used. With the ReVJeT, the cap typically travels at the jet tip for several feet, and even through barriers. Unfortunately, the cap's shape and physical characteristics do not enhance or stabilize the jet. In contrast, the JSP reduces hydrodynamic and aerodynamic stresses thus improving jet propagation in free flight and through semi-solid media such as explosives, increases barrier penetration, and reduces shock impulse. This is achieved by having a JSP that is not simply a thin-walled plastic that is only for temporarily sealing fluid, but has a significant longitudinal length (e.g., greater than about 0.7 inches, up to about 6 inches), mass, and corresponding effective density similar to water (e.g., between 0.8 g/cm$^3$ and 1.5 g/cm$^3$) in order to effect a change in a fluid jet property.

Before the JSP is described and its function explained, a brief explanation of the principle of the ReVJeT is helpful. The Reverse Velocity Jet Tamper (ReVJeT) disrupter enhancer improves jet stability by greatly reducing the water jet's reverse velocity gradient (RVG). The RVG effect results in the water at the rear of the jet moving faster than the water at the jet front. The water moves progressively faster from jet tip to jet tail in a continuum because the rearward water is accelerated in the barrel for longer times. The ReVJeT is a hollow region of bore in front of a fluid column. It can be produced by removing water from the bore or can be an empty bore extension which is attached to a fully-filled disrupter barrel. In the latter case, the ReVJeT generally has a uniform inner diameter which is approximately equal to the disrupter bore diameter. It acts as a channel to allow the jet tip to accelerate under confinement, and wall-shear stress causes the rearward portion of the jet's acceleration to be reduced. The result is a relatively uniform velocity profile with respect to jet length.

Similar to the traditional muzzle caps, the JSP seals the muzzle and holds the water column in the bore of the disrupter. The JSP is seated at the proximal end of the ReVJeT disrupter enhancer tube. When the disrupter is fired, the JSP is accelerated along with the jet tip inside the ReVJeT tube. Upon exiting the ReVJeT, the JSP travels in contact with the jet tip and remains at the jet tip even after impacting and penetrating an object such as an improvised explosive device. High speed video reveals the JSP greatly reduces water jet tip radial dispersion.

Figure 2:
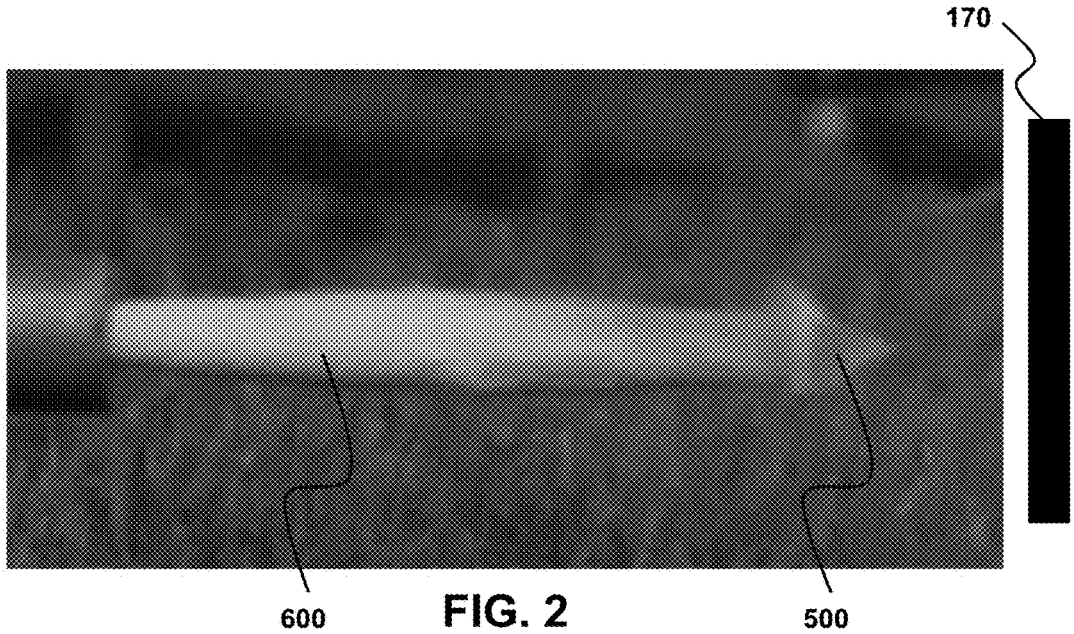
FIG. 2 is a photograph of a JSP, such as a spherical JSP, and the associated fluid jet imaged approximately 10 inches from the end of an adapter fitting to a barrel of a disrupter.

The JSP reduces radial dispersion at the jet front and radially along the jet body by several functional pathways. It reduces air drag erosion at the jet tip by causing the air flow to separate creating a slip stream behind the JSP. The air flow separation also minimizes the effects of drag and atomization along the sides of the jet. FIG. 1 shows a qualitative comparison of the reduction in the vapor cloud envelope of the water jet 600 after full ejection from PAN with cap (top), ReVJeT enhancer with cap (middle) and for the ReVJeT driven JSP 500 (bottom) toward a target 170. The low air pressure zone behind the JSP causes the jet to effectively draft and remain in contact with the JSP. There is a considerable amount of literature on aerodynamics of spheres and bullets that support this theory. To maximize the air separation, the JSP should have a smooth surface. Rough surfaces create a boundary layer which air flows around reducing the slip stream size. For example, this is the golf ball dimples' function. Up to 12 inches from the barrel, water is observed flowing forward and around the boundary of a spherically shaped JSP and to a point slightly in front of the projectile (FIG. 2). This is likely due to a low pressure boundary layer around the JSP. The JSP is pushing back on the water jet due to air drag and causes the water to flow around the JSP and thus encapsulates the proximal portion of the projectile. This behavior is important to JSP flight as will be described below. The air drag is less than it would be with no opposing jet as the water fills the zone adjacent the back portion of the JSP and reduces the pressure differential across the JSP.

The JSP may reduce the shockwave effects that cause repeated radial dispersion of water as pressure waves move back and forth in the water column. The shockwaves are caused by the explosion inside the chamber. These pressure waves cause both compressive and tensor stresses in the water jet. Because water cannot withstand hoop stress and is unconfined in free-flight, it atomizes as a procession of repeated radially expanding rings of water spray are observed propagating down the jet. Many plastics have shock properties and density similar to water and as a result, the JSP may allow the shocks to efficiently transfer from the water through the JSP due to impedance matching. The reflected waves are reduced in amplitude over time as the pressure waves unload at the JSP-air boundary. The jet tip is not at the boundary with air and thus will not undergo spallation and atomization due to rarefaction. No evidence of pressure waves are observed along a water jet trailing a JSP as shown in FIG. 2. The shape of the JSP can also reduce the amplitude of the reflected wave at the JSP water boundary. Interior barrel pressure testing with other projectiles that have a boundary interface with a water column have shown that reflected shocks at the boundary can be greatly reduced by using a rounded or curved profile at the rear of the projectile which is in contact with the water. It was empirically shown using the SPLITR projectile the peak pressure at the water-projectile boundary dropped by approximately 30% when comparing a flat base to a rounded base. A spherical JSP or one with a rounded shape at its rear would produce a similar result. The JSP proximal profile should not be too aerodynamic as this would reduce the wake zone behind the JSP thus having a negative effective on the jet tip.

In addition to improving water jet free flight stability, there are several quantitative impact mechanics enhancements. The JSP approximately doubles the barrier thickness limit of water jets. Penetration in continuous media also improved the ReVJeT by 20%. Due to the JSP material composition, shapes, and hardness they reduce shock impulse on impact with a target. As a result, JSPs are successful in explosive impact tests against sensitive explosives, such as flash powder, resulting in an ability to double or even more than quadruple the output energy of the cartridge while avoiding unwanted shock initiation. For example, impact tests against flash powder using HDPE plastic barriers successfully demonstrate that a hydrosphere (spherical JSP) driven by a BK90 blank, avoids shock initiation of a target comprising 90 grains of smokeless powder. The conventional PAN configuration with the BK20 (20 grains of smokeless powder), in contrast, can shock initiate the same target. Impact pressures are linearly dependent on projectile density; the JSPs are inherently low density. The JSP has similar density and shock Hugoniot properties to water. The hard bodied spherical, ovoid or ogive shaped JSP initial impact with an IED surface is at a point on the projectile. Complex profile curvatures at the distal end can be used to further reduce impact area but not degrade air flow separation. Furthermore, due to the fact that the JSP is a solid, the cross sectional area of the projectile is smaller during impact compared to a water jet tip. The reduced impact area has benefits similar to the Sherwood™ projectile (U.S. Pat. No. 6,439,127), but is not accomplished using a cruciform metal point: in particular an "arrowhead." JSP enhanced water jets driven with blank cartridges with over triple the powder load that would typically cause shock initiation of the explosives produced no reaction.

Accordingly, the JSP distal end can be described as being smooth and without sharp edges, such as spherical, spheroid, conical, ogive, or parabolic in shape. It can be symmetric about is longitudinal axis or the proximal end can be a different shape than the distal end. The proximal end can have similar geometries listed above for the distal end, but does not have to be the same geometry and can also have a flat base. The most effective materials are plastics and synthetic rubbers such as polyurethane, Delrin™, silicone and nitrile. The JSPs made from higher strength materials, polyurethane and Delrin™, will maintain integrity after impact. The durometer of the material can also vary and generally higher durometers ranging from 60 to 90 (ASTM D2240, Shore D) are better. The projectiles are often recovered intact deep inside the targets or outside the targets after pass-through. The lower strength materials will fracture or disintegrate on impact. This is desirable, depending on the application of interest.

Additive manufacturing can be used with materials such as polylactic acid (PLA), specific gravity 1.25, or other plastics to create complex geometrics and internal structure. The JSP designs can be costly or physically not feasible to manufacture by machining or injection molding. An example are internal structures, such as air channels, to enhance flight stability and air flow around the water jet tip. The materials and the process used to manufacture objects by 3D printing makes them more likely to fracture and break up after impact against harder targets. Again, this can be a desirable property. This is fundamentally different from a frangible plug component, in that in the instant methods and devices, the entire JSP can be frangible because of the brittle nature of the construction material. A thin outer casing of metal assists in structural integrity during impact if the objective is to not have a frangible projectile, for example. A dense material, such as a rod, can be positioned internally in the JSP along the longitudinal axis of the JSP, optionally at or near the distal region or distal end of the JSP. For example, a rod, optionally narrow and/or pointed, formed of a material such as a metal, steel, tungsten, titanium, or any combination of these, can be positioned internally in the JSP along the longitudinal axis of the JSP, optionally at or near the distal region or distal end of the JSP, can provide additional flexural strength. Also, different rod materials and diameters can be used to adjust the effective density of the JSP. Optionally, this internal rod can have a length that is 10-50% of the length of the JSP. For example, this internal rod, such as one at the distal region of the JSP and having a length that is 10-50% of the length of the JSP, can place the center of air pressure in a location appropriate to promote air-drag stabilization to improve free-flight characteristics of the JSP. This dense material can have a variety of shapes, such as a rod. A dense material, such as a metal rod, inside the JSP can correspond to a "dense material region" of the JSP, such as a modified "Penetrator Projectile for Explosive Device Neutralization" (SPIKE) as described in U.S. patent application Ser. No. 16/209,643 by Vabnick filed Dec. 4, 2018, which is specifically incorporated by reference herein, including for the penetrator projectiles described therein.

During layered barrier tests the ogive shaped JSP, also known as Hydropoint, remained in line with the water jet. The tip is crushed and eroded evenly as the projectile and jet propagate through almost a half dozen evenly spaced plywood panels. The flattened tip reduced the penetration limit and also increased impact pressures. A thin metal jacketing around the projectile can be added to reduce or prevent the JSP tip from breaking apart. Alternatively, a small region of the JSP tip, approximately 0.5 inches in length, can be replaced with aluminum, titanium, steel, or tungsten, which does not alter the profile of the JSP. A stated above, a metallic rod with a pointed tip axially positioned inside the JSP does not erode and reinforces the JSP tip.

Additives such as lubricants and particles can be mixed inside the plastic and rubber bodies. The micro particles (0.001 to 0.01 inches in diameter) can be metals such as tungsten, steel alloy, silica, or plastics. The effective density of the JSP can be customized by adjusting the type and quantity of solid particles. The particle size can be varied and the particles may be porous or have voids. Non-homogeneous materials which contain particles further disrupt shocks that are produced by impacts. Lubricants impregnated in the bodies can reduce wall shear stress as the JSP moves through the barrel or ReVJeT (fluid jet enhancement adapter). PTFE or Teflon™ can be added to the JSP plastic. Also, other polymeric materials can be used as lubricants.

Figure 3:
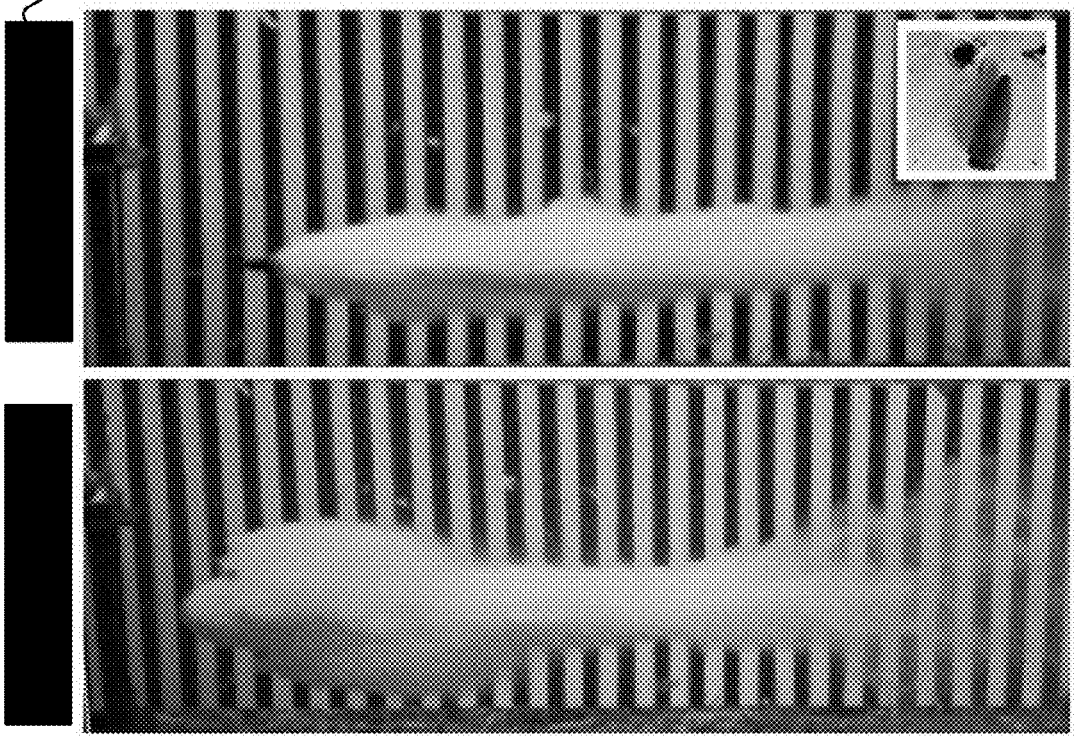
FIG. 3 are photographs comparing a fluid jet expelled from a disrupter using a JSP (top panel), such as a JSP having an ogive shape and formed of PLA polymer, and a fluid jet expelled from a disrupter having a RevJet adapter but without a JSP.

The JSP relationship with the fluid jet is synergistic. The JSP is stable in flight because of the fluid jet flowing behind it (FIG. 3). It does not require spin stabilization as bullets do or drag stabilization as arrows do. For all projectiles, the forward trajectory is dominated by the projectile momentum and the force of gravity. Conventional projectiles without spin or drag stabilization will yaw, wobble or tumble causing their trajectory to go off course. Provided herein is a novel mode of disrupter projectile stabilization: jet flow stabilization. In order for this behavior to benefit the projectile and the fluid jet, the JSP should travel with the water as a unit and not impede the jet. Its effective density, specific gravity 0.8 to 1.5, should be similar to that of the water. In this density range, the acceleration of the fluid jet tip is not measurably retarded as would occur with high density projectiles. The typical velocity range for the fluid jet is Mach 0.5 to 1.5. In contrast, the Sherwood™ plug end contains weighted shot and its commercial embodiment weighs up to four times a JSP.

Figure 4A:
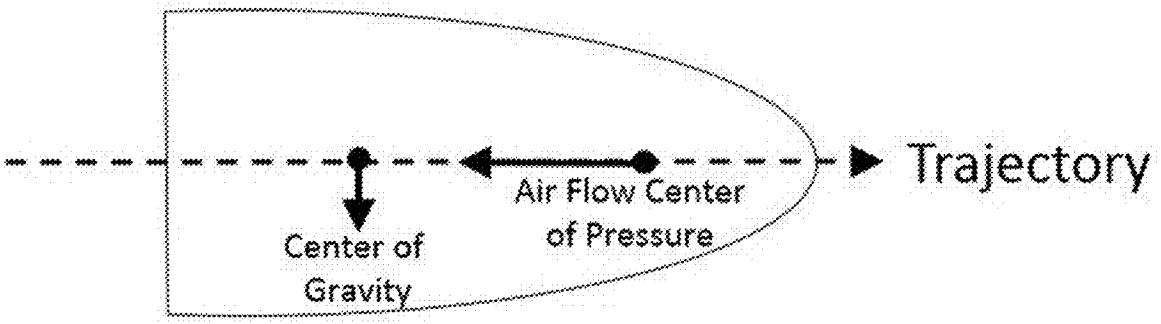
FIG. 4A is a schematic of a conventional projectile in flight without contact with a fluid jet, where the center of gravity is proximal relative to the center of pressure, resulting in an unstable flight path. Without a fluid jet, the projectile may be unstable in flight, at least due to the different force vectors.

For drag stabilized flight, a projectile requires the center of pressure (CP) to be behind the center of gravity (CG). However, the common ogive geometry for projectiles has the CP in front of the CG. Any air flow disturbance should cause the projectile to tumble. FIG. 4A shows a qualitative free body diagram of a bullet shaped JSP without a water jet. The CG point effectively acts as a fulcrum and the separation from CP acts as a lever. The nose of the projectile would tip up or down due to any air disturbance which causes the pressure vector to be out of alignment with the trajectory. The projectile would rotate about its CG. A JSP may have a geometry and/or effective density distribution selected to manipulate drag stabilization and improve flight characteristics of the JSP. Some geometries (shapes) disclosed herein have the CP and CG at the same point and other geometries have the CP behind the CG which is provides for drag stabilization. Placing denser materials (corresponding to a dense material region inside the JSP) such as a metal insert in the proximity of the tip of the projectile can move the CG forward to keep it more distal than the CP.

Because of the bullet shape, most firearms are rifled to induce a spin to the projectile. For spin stabilized flight, the projectile must have an angular momentum vector in line with the projectile central axis. The JSP is not spin stabilized because the PAN disrupter used and the ReVJeT are smooth bore and have no rifling. So what prevents the JSP from tumbling?

Figure 4B:
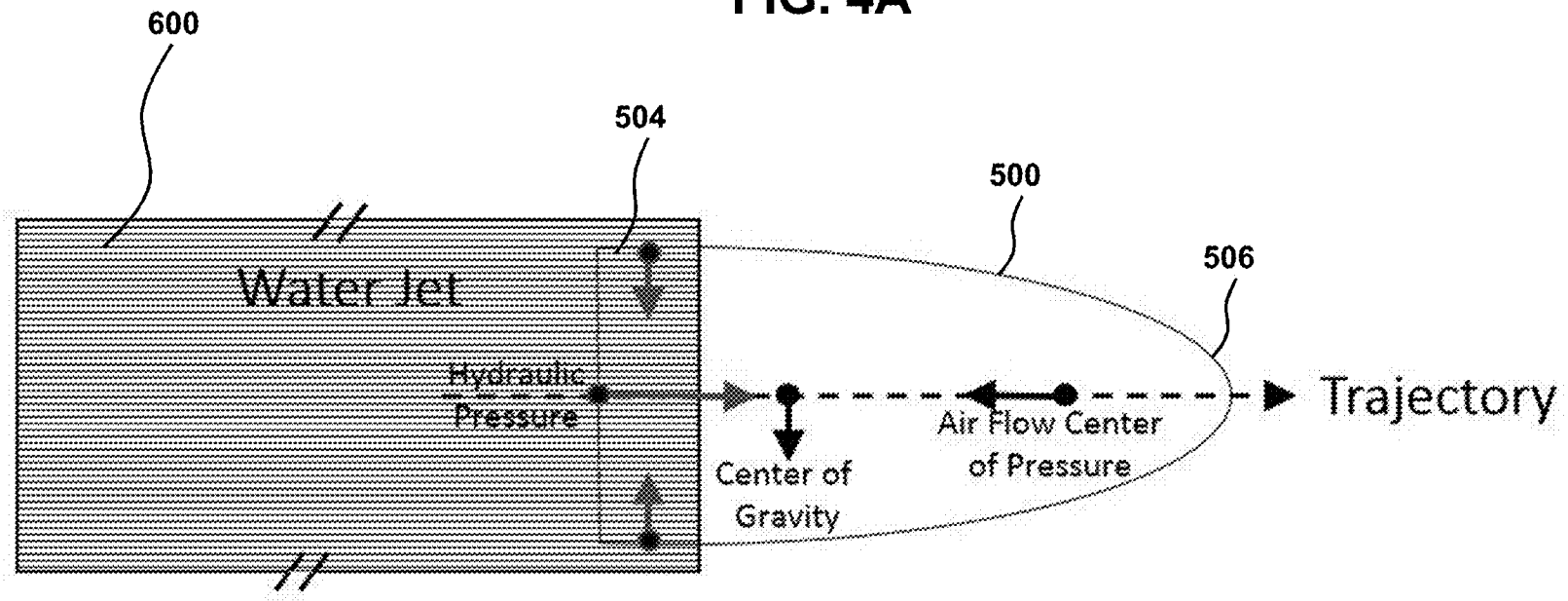
FIG. 4B is a schematic of a conventional projectile in flight and in contact with a fluid jet at and around the proximal end of the JSP. The fluid jet imparts a hydraulic pressure on at least the proximal end of the JSP in flight; as a result the JSP is better stabilized by the fluid jet, even though the center of gravity remains proximal relative the center of pressure.

The ogive-shaped Delrin™ or PLA JSP fly true (stable, straight) in free flight or during penetration through multiple barriers. FIG. 3 shows the PLA JSP in free flight approximately five feet from the muzzle. The inset picture shows a round hole made in a ½" plywood panel which was the sixth layer in a rack of evenly spaced plywood panels. A circular hole indicates the projectile longitudinal axis was normal to the surface at the moment of impact and not at an angle which would cause a keyhole. The water jet was exhausted between the fifth and sixth panel. The bottom free body diagram in FIG. 4B shows the water jet hydraulic pressure counterbalancing the air pressure. The hydraulic pressure point is at the base center of the projectile and the vector is in line with the jet trajectory. Also note that the air pressure magnitude is reduced compared to the projectile without the water jet. Water encapsulates the JSP proximal end. As the water flows around the sides of the JSP it exerts pressure on the outside surface of the projectile and thus keeps the central axis of the JSP in line with the flight path. Of note, prior studies conducted by Christopher Cherry using flash X-ray imagery have shown that the jet tip will retain the shape it had around the cap or sealing plug, even after it is no longer in the path of the jet tip. The inventor calls this phenomenon "flow memory" and can only be possible if the water and air interaction results in a continuous flow of water in the forward direction to preserve the water jet tip profile. This behavior explains why the water continuously encapsulates and exerts a force on the back portion of the JSP. The dominant hydraulic pressure stabilizing effect, and lower magnitude of air pressure expands the possible shapes and lengths of the JSPs that will fly true.

Figure 5A:
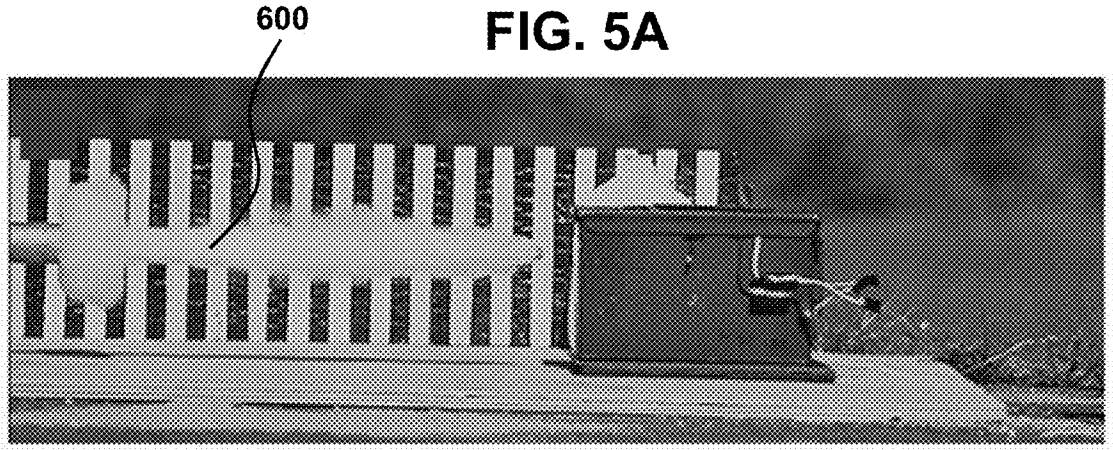
FIGS. 5A-5C are a series of sequential photographs showing a fluid jet and JSP fired from a disrupter toward an ammo can (a target) using a 24" standoff distance.
Figure 5B:
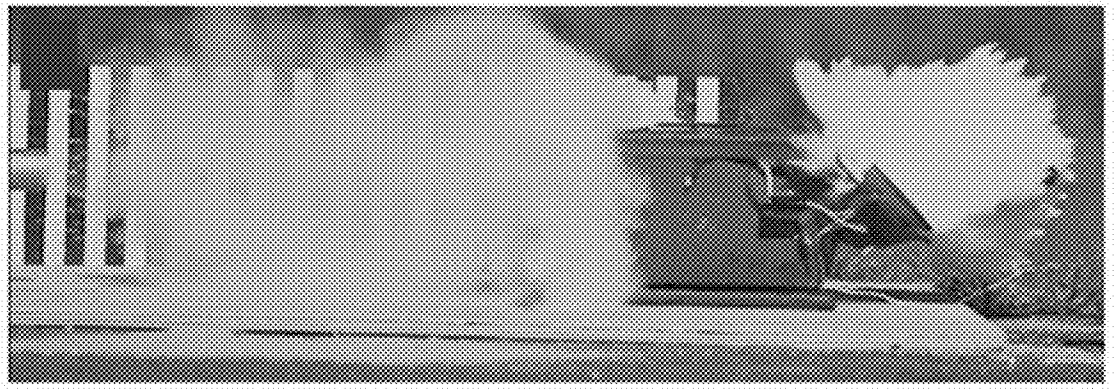
Figure 5C:
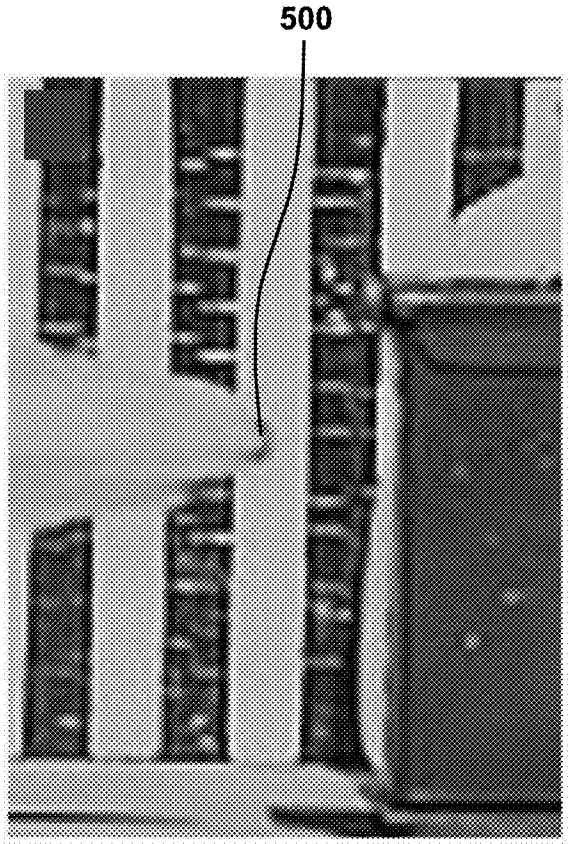

Spherical projectiles, also known as Hydrospheres, are inherently stable in flight and this shape is ideal to seal the barrel (being circular in cross-section). The specific gravity of the materials can be between 0.8 and 1.5. High speed video shows the spherical JSPs fly in line with the water jet. High tensile strength materials (such as up to 8,000 psi, or greater, such as up to 10,000 psi, or up to 12,000 psi, or greater for example) allow the JSP and the jet following it to pierce through both sides of thin-walled steel and aluminum bodied IED casings. Barrier limit thickness tests show the JSPs almost double the barrier limit of PAN-fired water jets. The penetration tests through layered barriers or through a block of continuous media show the spherical JSP improves penetration by 20%. FIG. 5A shows a spherical JSP just prior to impact with an ammo can IED test device. FIG. 5C is an expanded view of the water jet tip and JSP. The performance compared to the conventional PAN with the same set up is unprecedented. The ammo can was filled with explosive simulant and a fast responding, latching anti-disturbance fuze. An electric match not visible in the frame did not ignite. The JSP reduces barrier penetration time, and less fluid is used to burst the container. The JSP aided the water jet to traverse completely through the ammo can (FIG. 5B). Using conventional PAN, the water jet typically folds the ammo can wall rather than perforating it.

Example 2: Exemplary JSP Geometries

The systems and methods provided herein are compatible with a range of JSP sizes, shapes, material construction and geometries, depending on the application of interest. For example, FIGS. 15-29 illustrate various JSP geometries, including material compositions, composites, hollow portions, microparticles, and the like.

Figure 15:
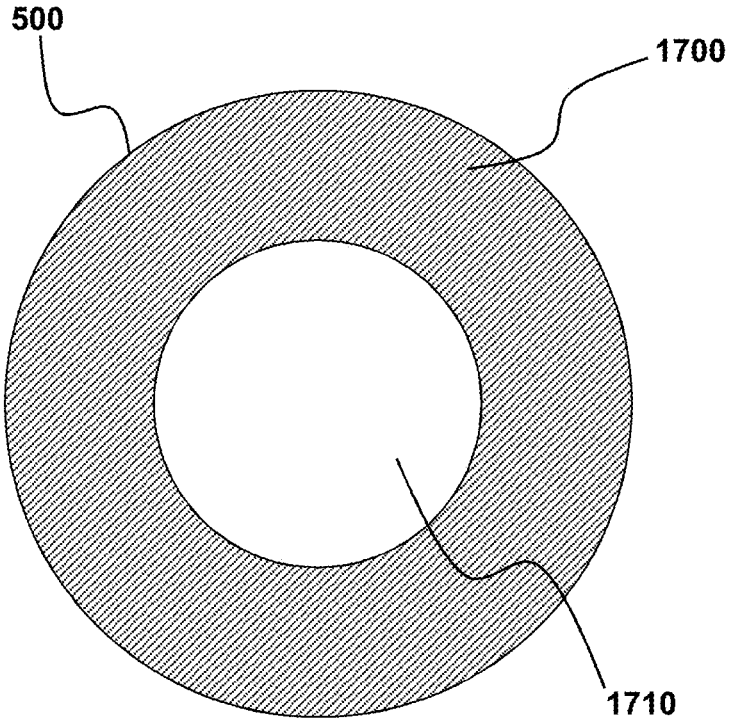
FIG. 15 illustrates a JSP having a hollow core (hollow central region), according to certain embodiments.
Figure 16:
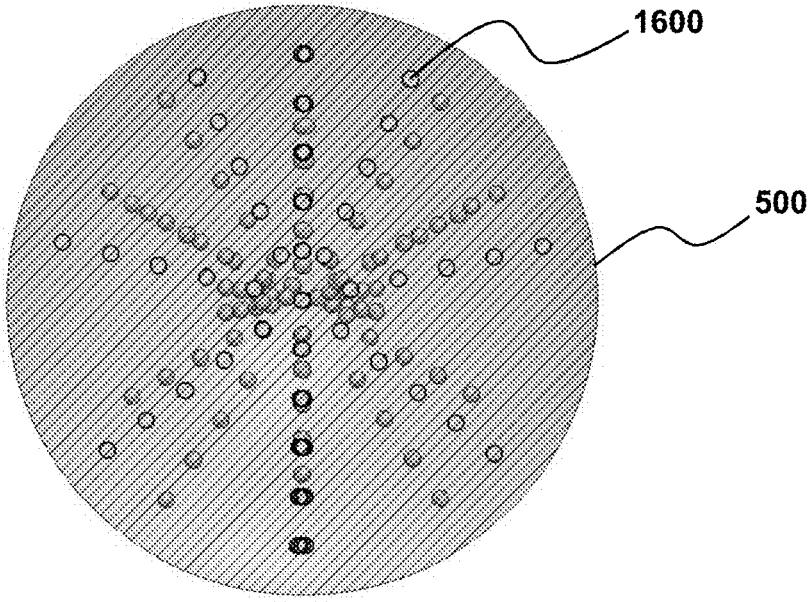
FIG. 16 is an illustration of a JSP having embedded particles, such as microparticles, suspended inside the JSP, according to certain embodiments.

FIG. 15 illustrates a cross-section of a spherical JSP 500 having a hollow core or internal cavity (hollow central region) 1710, formed by an outer layer 1700. FIG. 16 is a cross-section of a spherical JSP 500 having embedded particles 1600, such as microparticles, suspended inside the JSP.

Figure 17A:
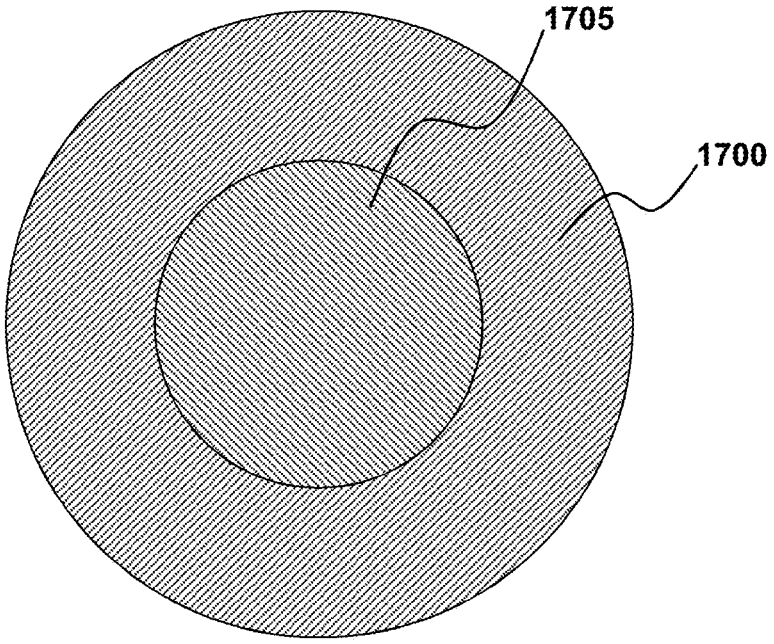
FIG. 17A illustrates a composite JSP, formed as a multilayer, with a first material forming a core region that is encapsulated by a second material, such as a layer having a thickness, including a substantially uniform thickness or a spatially-varying thickness, such as to provide a weighted distribution to further influence flight trajectory and characteristics.
Figure 17B:
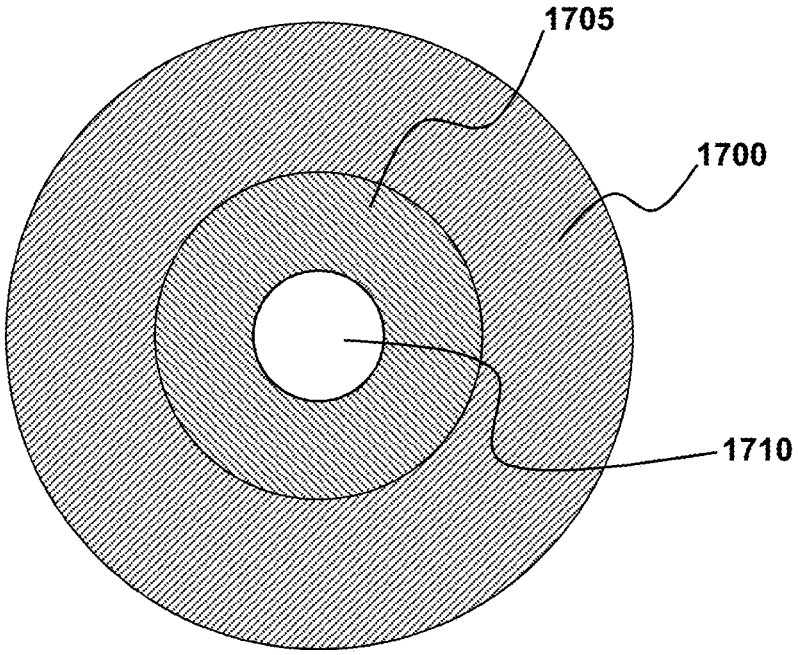
FIG. 17B illustrates that the multilayer JSP, as desired, may also contain a hollow region.

FIG. 17A illustrates a composite JSP formed of different materials 1700 1705, such as a multilayer geometry, with a first material 1705 forming a core region that is encapsulated by a second material 1700, such as a layer having a thickness, including a substantially uniform thickness or a spatially-varying thickness, such as to provide a weighted distribution to further influence flight trajectory and characteristics. FIG. 17B illustrates that the multilayer JSP, as desired, may also contain a hollow region 1710.

Figure 18:
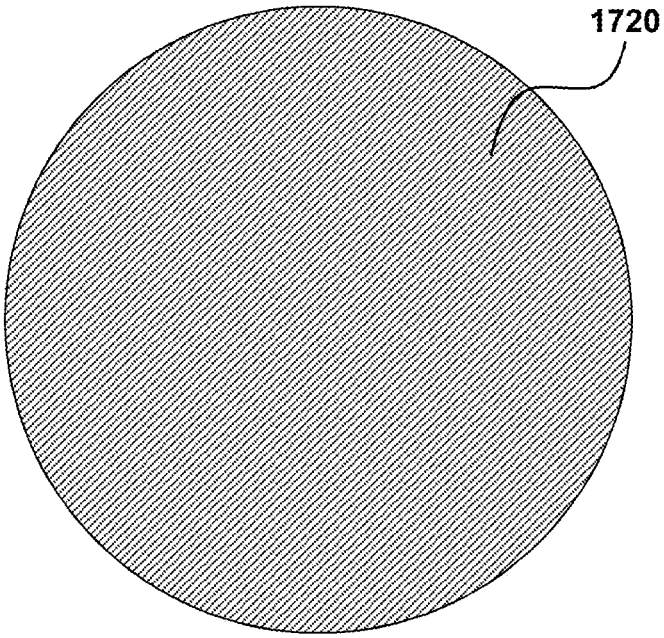
FIG. 18 illustrates a unitary spherical JSP, which is a JSP formed from a single material.

FIG. 18 illustrates a unitary spherical JSP, which is a JSP formed from a single solid material 1720.

Figure 19A:
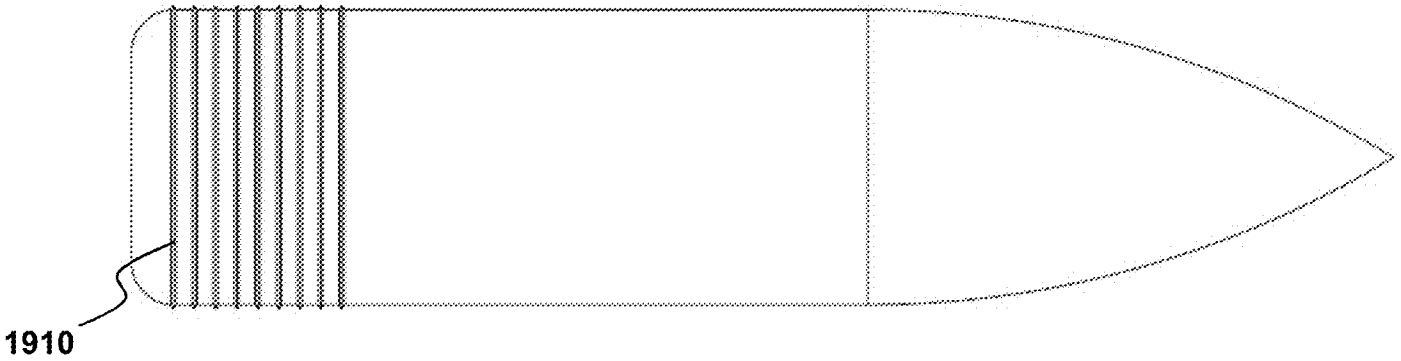
FIGS. 19A-D are various views of several embodiments of JSP geometry.
Figure 19B:
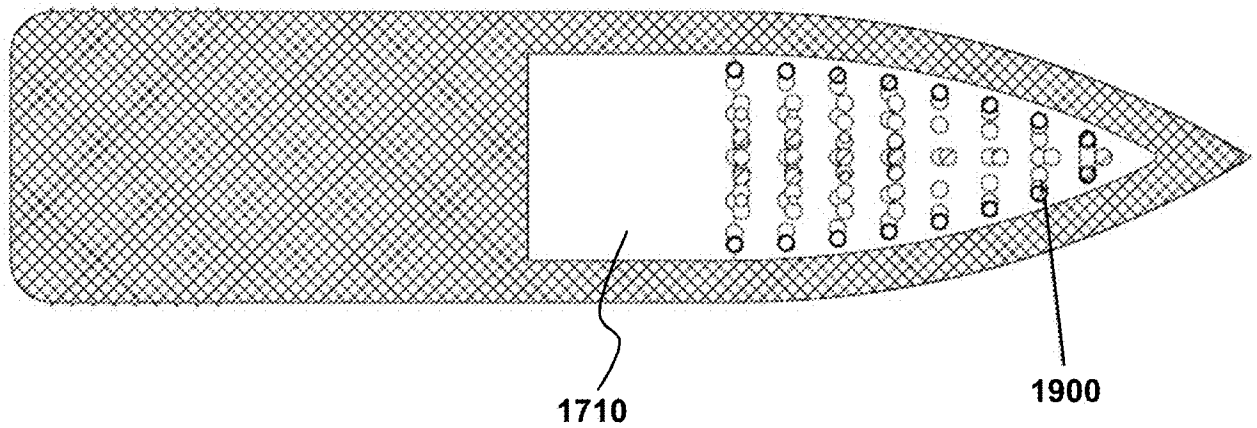
Figure 19C:
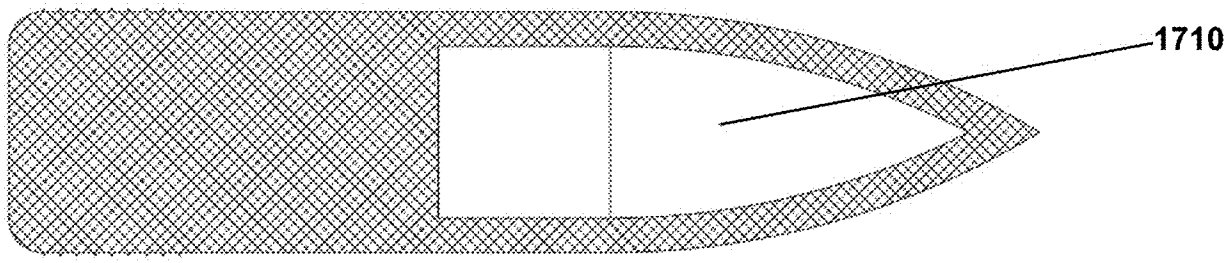
Figure 19D:
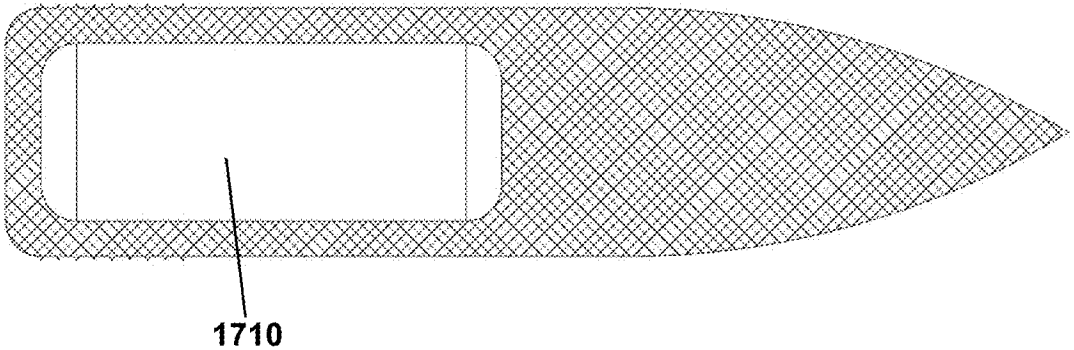

FIGS. 19A-D are various views of several embodiments of JSP geometry. FIG. 19A illustrates a JSP having an ogive-shaped distal region. The JSP may have a hollow region (FIGS. 19B and 19C) 1710. For example, the JSP may have a hollow region 1710 extending from the distal region FIGS. 19B-19D), and the hollow region may further include microparticles (FIG. 19B) 1900, such as metal microspheres, or may be without microparticles (FIG. 19C-19D). FIG. 19D illustrates that the JSP hollow region position may be varied, and may extend from the proximal region (e.g., the end of the JSP that faces toward the breech end of the disrupter). The outer surface of the JSP proximal end may comprise a seal 1910, such as formed by relief/recess features for tight-fitting in a barrel, thereby enhancing a fluidic seal.

Figure 20:
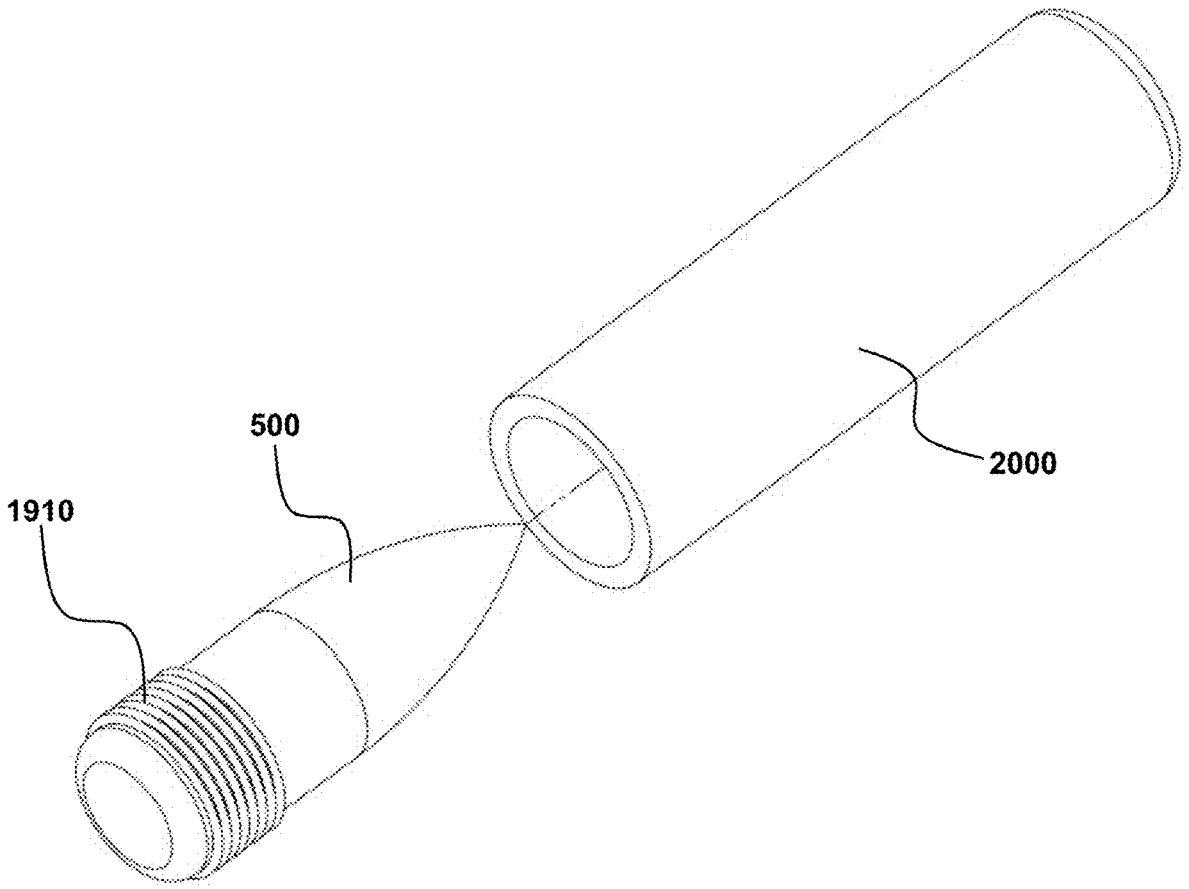
FIG. 20 is an exploded view schematic of a JSP and a rammer. A rammer is optionally used to insert the JSP into the barrel. The seal extending from the proximal portion of the JSP is used to reliably and consistently seat the JSP in and against the rammer.
Figure 21A:
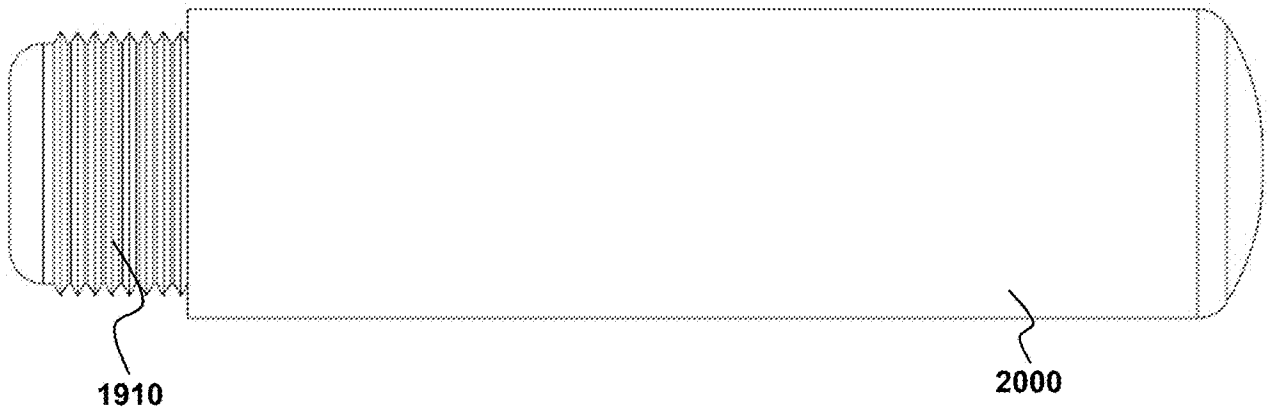
FIGS. 21A-21G are various views of a rammer and JSP system of FIG. 20.
Figure 21B:
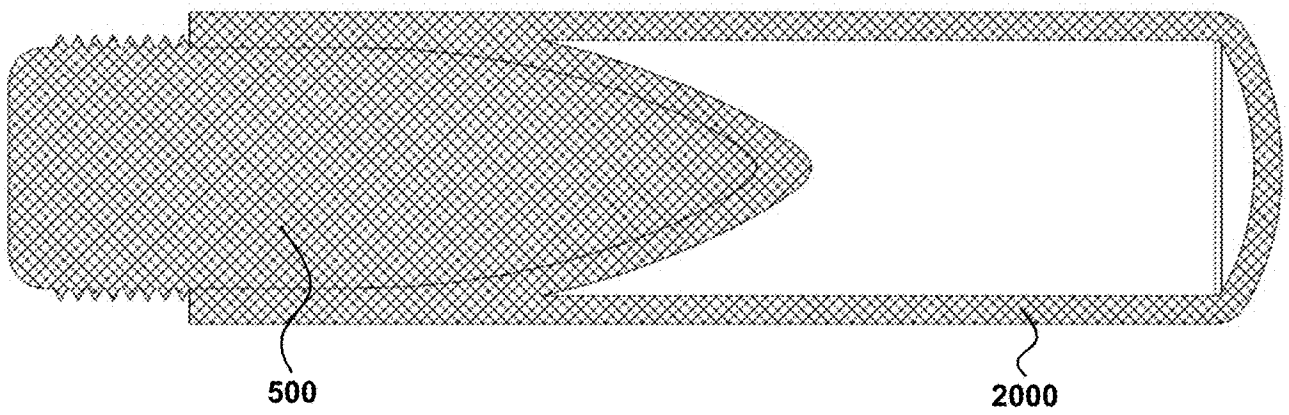
Figure 21D:
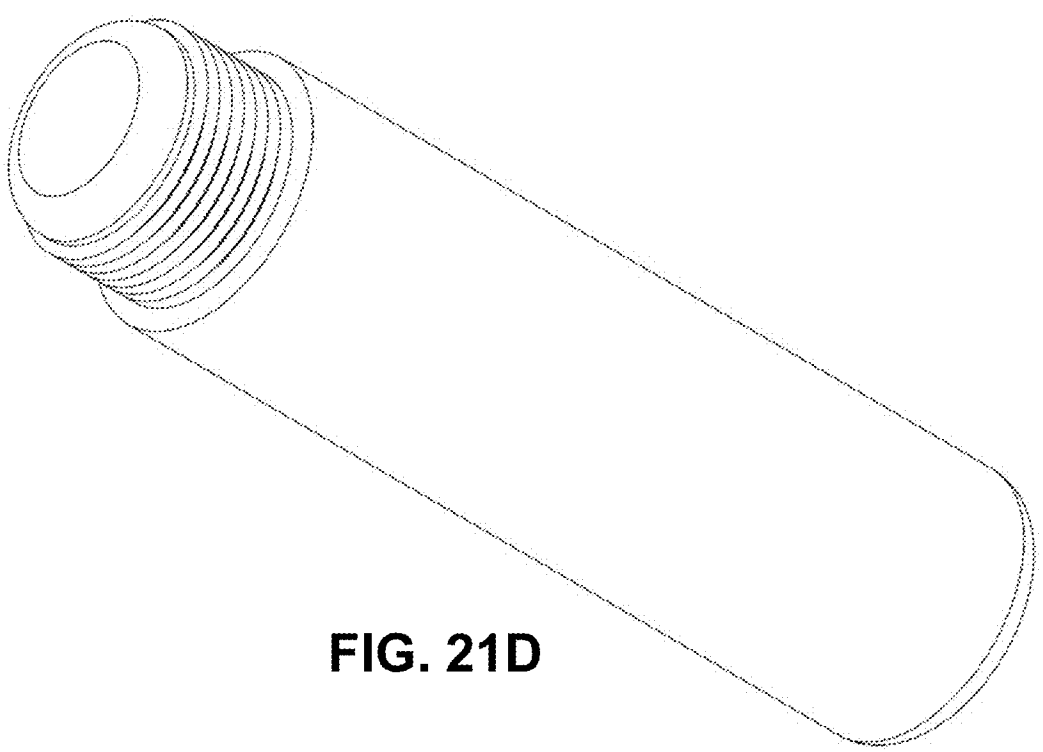

FIG. 20 is an exploded view schematic of a JSP 500 and a rammer 2000. A rammer is optionally used to facilitate reliable insertion of the JSP into the barrel. The seal 1910 extending from the proximal portion of the JSP is used to reliably and consistently seat the JSP in and against the rammer, as shown in FIGS. 21A-21B. Any JSP disclosed herein optionally includes a seal to form a fluidic plug in the barrel of a PDD. The seal may be at the proximal region of the JSP. The seal 1910 is optionally formed of a material configured to press-fit and form the fluidic plug of the JSP in the barrel. The seal material may be described as a "flexible material", or a material that can deform under an applied force and, at least partially, relax back to an undeformed state upon removal of the applied force. Examples of a seal material include elastomers and soft polymers, such as polyurethane. The seal of the JSP may correspond to an O-ring or multiple sealing members or nubs. The seal of the JSP may correspond to one or more protrusions of a surface of the JSP, optionally formed of a same material as in the JSP, or optionally formed of a different material from that/those of the JSP, configured to allow the JSP the form a fluidic seal in a barrel. The seal of the JSP may optionally correspond to a combination of one or more protrusions and one or more depressions configured to allow the JSP to form a fluidic seal in a barrel. For example, the JSP may include a plurality of circumferential protrusions (e.g., "ribs") as a seal of the JSP configured to allow the JSP to form a fluidic plug in a barrel.

Figure 21C:
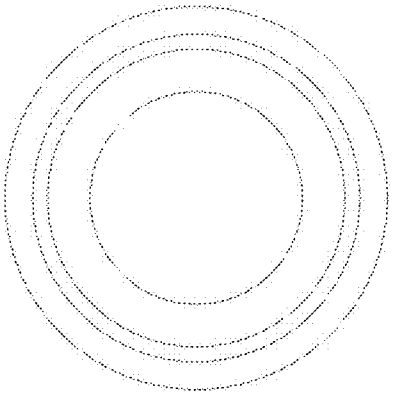
Figure 21E:
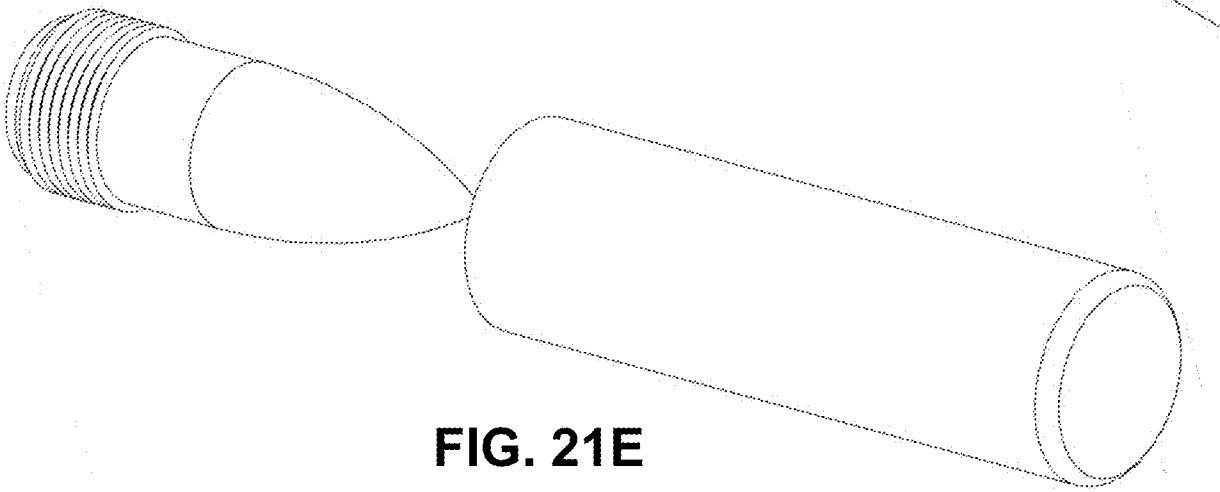
Figure 21F:
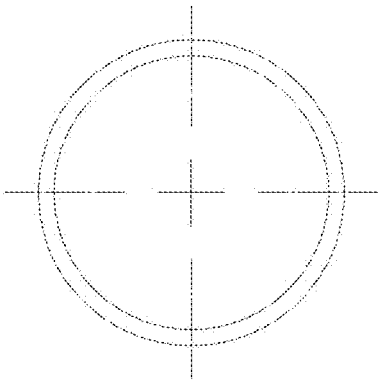
Figure 21G:
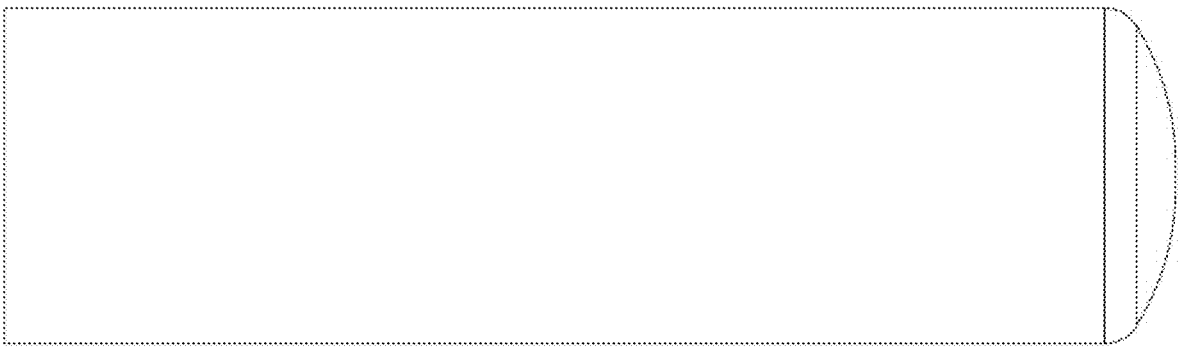

The rammer 2000 may be configured to push the JSP at the proximal end of the JSP 500 into a barrel, optionally such that the distal end of the JSP is outside of the barrel. This reflects that it can be challenging to tightly-fit a relatively small JSP into the barrel. The rammer 2000 is a conveniently shaped rigid material that can be used by an individual to apply a force to the JSP via the JSP outer surface and the end of the seal 1910 to reliably force the JSP into a disrupter barrel. The rammer may be removed before the JSP is fired out of the barrel or may be fired along with the JSP, with the rammer falling away, separating or disintegrating so as to not adversely impact JSP flight trajectory. FIG. 21B is a cross-sectional view along a longitudinal center plane of the JSP in a rammer of FIG. 21A. FIG. 21C is a view of the JSP-rammer proximal end ready to be press-fit into a disrupter barrel. FIG. 21E is an exploded view of the JSP and rammer of FIG. 21A. FIG. 21F is a cross-sectional view of the rammer of FIG. 21E. FIG. 21G is a side view of the rammer. The proximal end of the rammer is open to receive the JSP. The distal end of the rammer may have a closed surface.

Figure 22D:
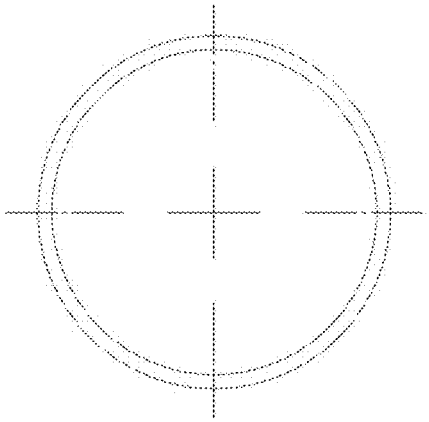
FIGS. 22A-22M are schematics of a variety of JSPs showing different exemplary shapes, features, and configurations of a JSP, according to certain embodiments. For example, each of the JSPs of FIGS. 22A-22M include a proximal and/or distal region having a conical, parabolic, hemispherical, ogive, flat/square/rectangular shape, and/or combinations thereof.
Figure 22C:
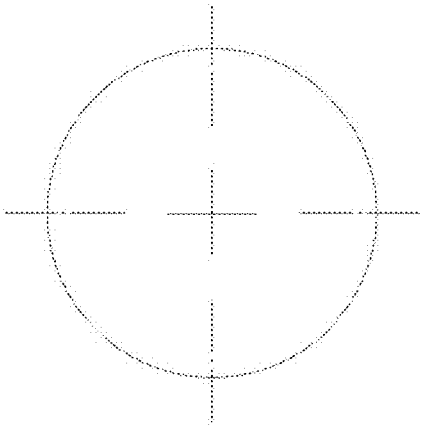

FIGS. 22A-M are schematics of a variety of JSPs showing different exemplary shapes, features, and configurations of a JSP, according to certain embodiments. For example, each of the JSPs of FIGS. 22A-M include a proximal and/or distal region having a conical, parabolic, ogive, and/or flat/square/rectangular shape. FIG. 22D is a cross-sectional view of the JSP of FIG. 22A. FIG. 22C is a cross-sectional view of the JSP of FIG. 22B. FIG. 22F is a cross-sectional view of the JSP of FIGS. 22E and 22G. The JSP of FIGS. 22E, 22F, and 22G includes a metal portion 2200, such as internal metal point having an apex tip 2210, inside of the JSP at the distal region to improve flight characteristics and/or target penetration. FIG. 22I is a cross-sectional view of the JSP of FIG. 22H. FIG. 22K is a cross-sectional view of the JSP of FIG. 22J. FIG. 22M is a cross-sectional view of the JSP of FIG. 22L, reflecting a JSP formed of a single material.

Figure 4C:
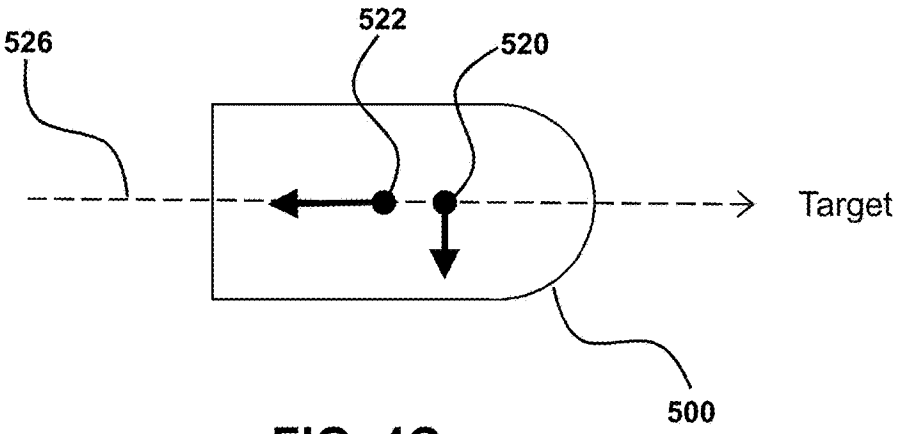
FIGS. 4C-4D illustrate a JSP of the instant invention configured to position the center of gravity distal to the center of pressure, thereby ensuring good stable flight characteristics.
Figure 4D:
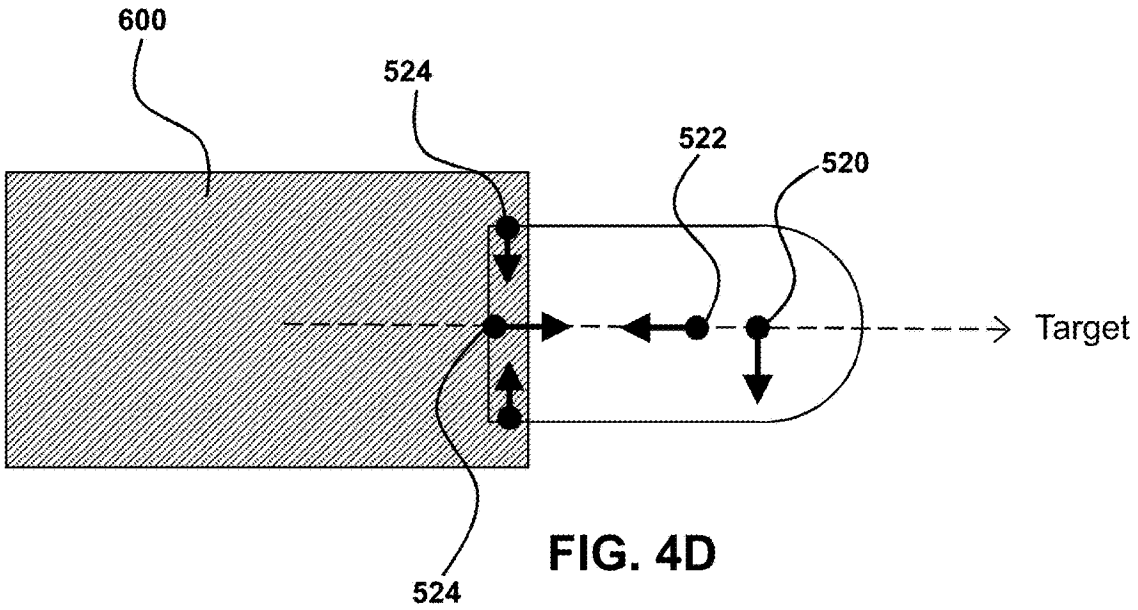
Figure 22A:
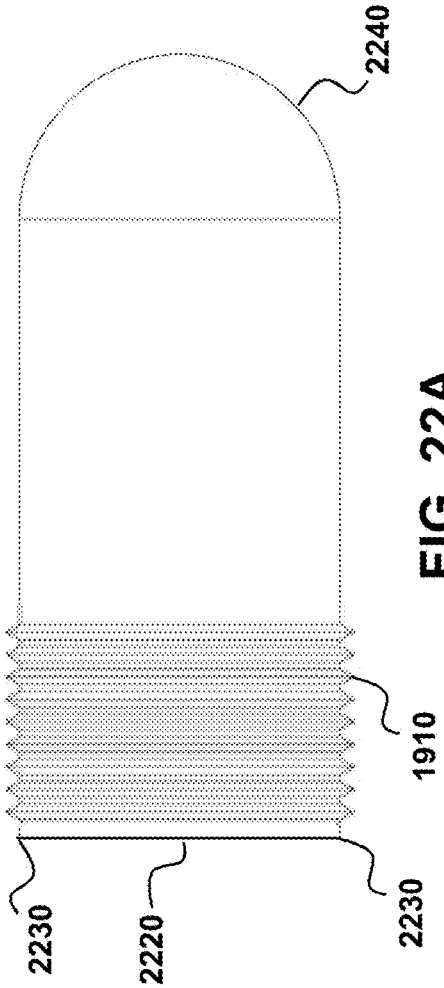
Figure 22B:
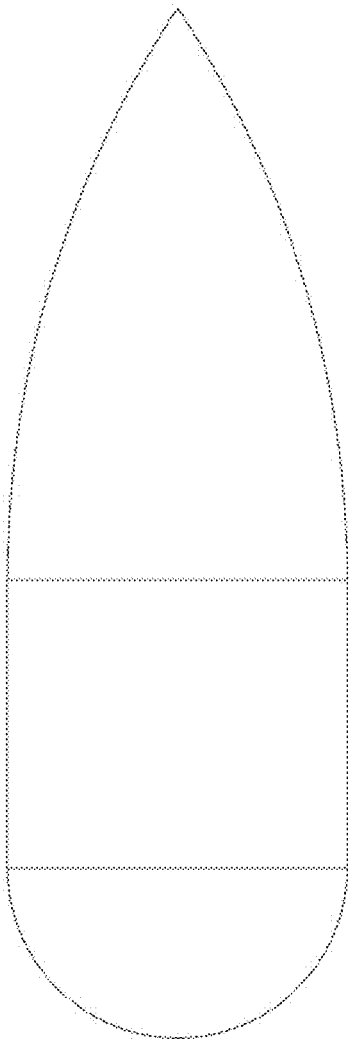
Figure 22F:
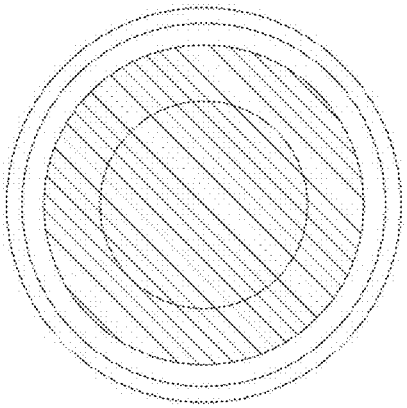
Figure 22E:
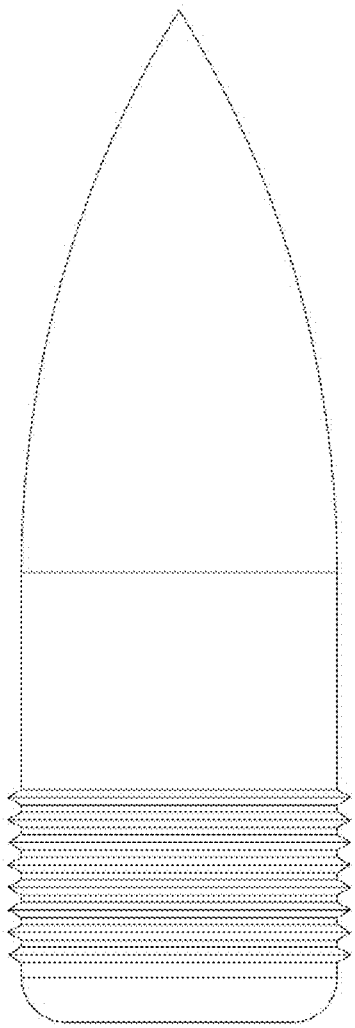
Figure 22G:
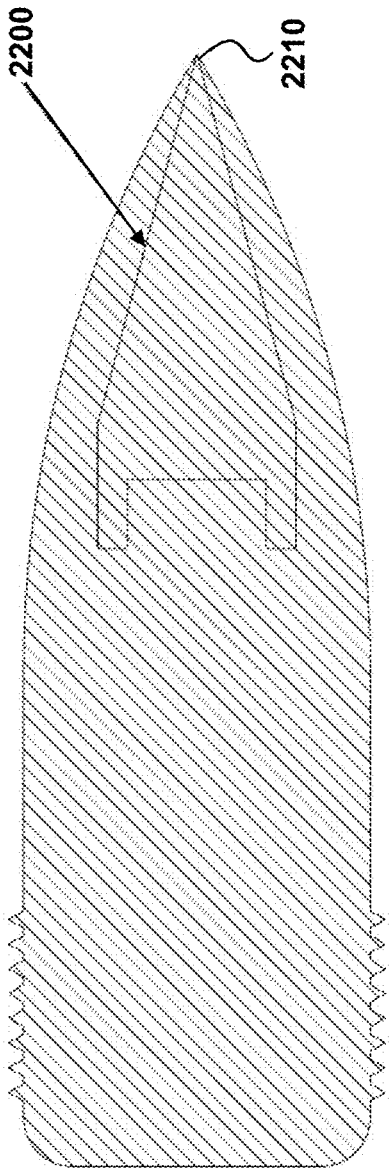
Figure 22I:
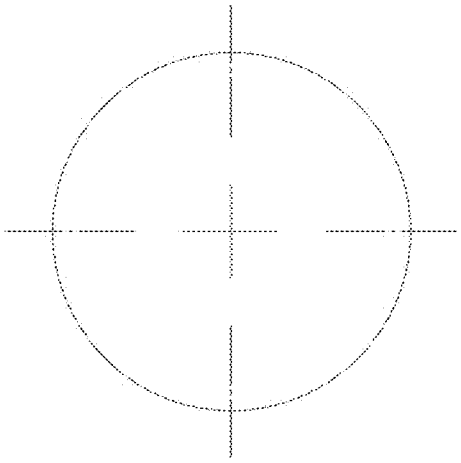
Figure 22K:
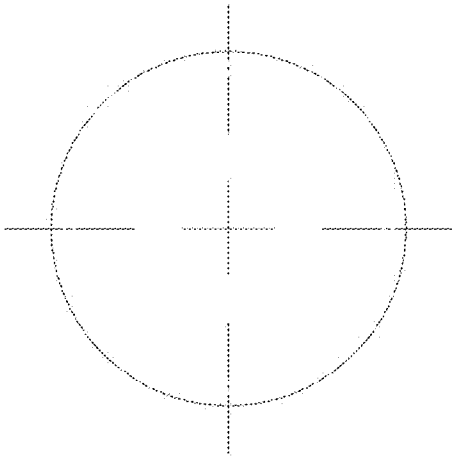
Figure 22H:
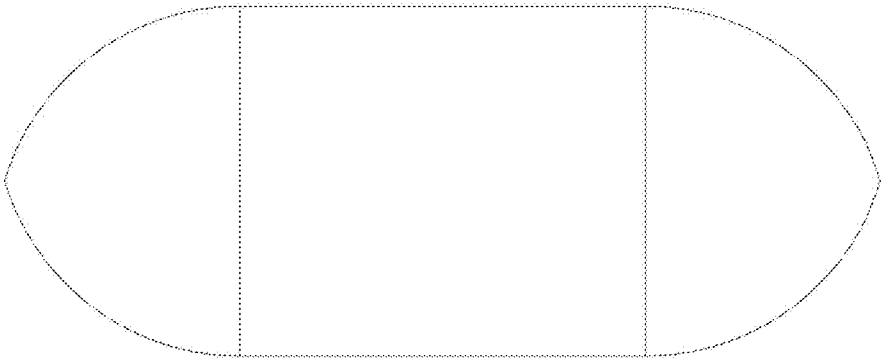
Figure 22J:
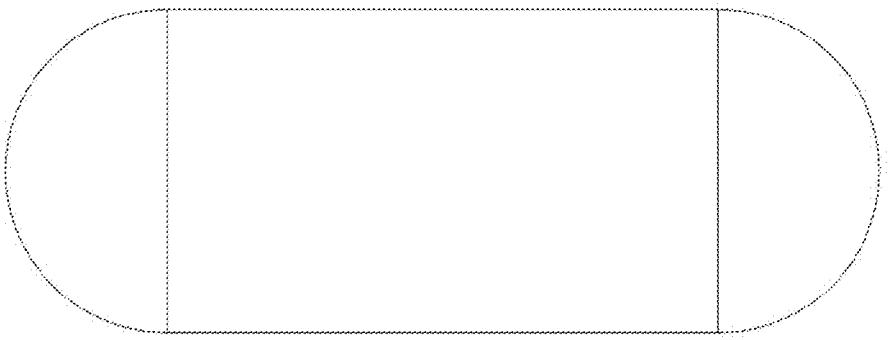
Figure 22L:
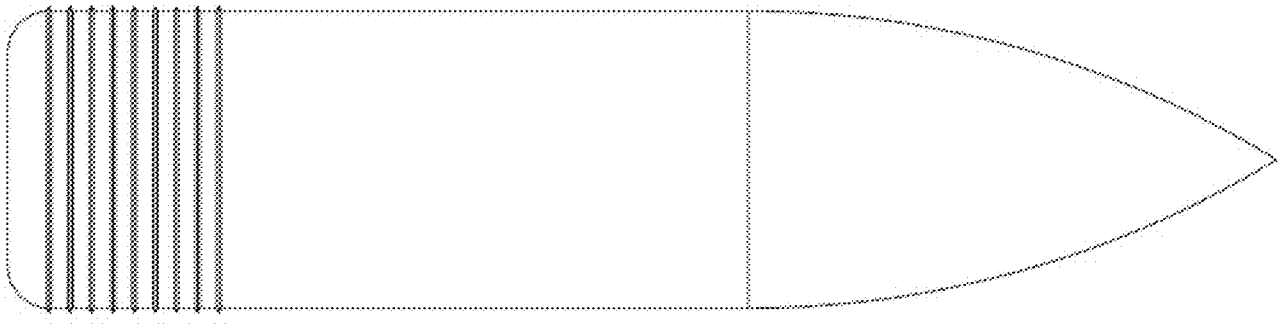
Figure 22M:
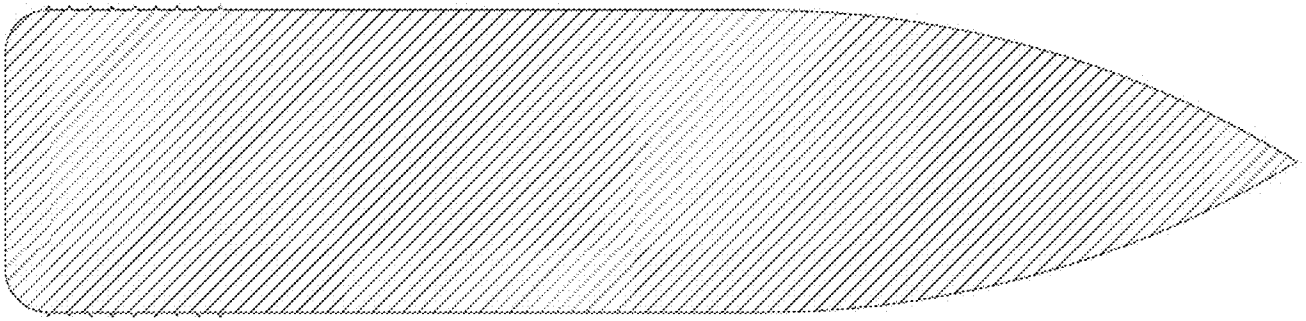

FIG. 22A is a preferred embodiment, illustrating a JSP proximal end that is a flat back surface 2220 and at least a portion of the JSP distal end that is hemispherically shaped 2240, with a sharp corner shape 2230 between the proximal end and the distal end. Also illustrated are compression rings that function as seal 1910 to ensure a good fluidic seal between the JSP and the disrupter barrel, thereby preventing or minimizing fluid leakage before firing. Upon expulsion of the JSP and liquid from the disrupter barrel, both hydraulic (e.g., interaction of liquid jet on the JSP proximal surface) and air drag stabilization of the JSP contributes to improved in-flight stability of the JSP, with attendant improvement in target disruption performance. In particular, the JSP center of gravity 520 is favorably positioned in a distal position relative to the center of air pressure 522 of the JSP, including as summarized by the force balance illustration of FIG. 4D. The liquid jet embodiment, where the liquid jet 600 exerts a hydraulic force 524 (with a corresponding center of hydraulic pressure) on the proximal end of the JSP, further increases stability, including compared to the embodiment where a projectile gas (e.g., air) is used (FIG. 4C).

Figure 23A:
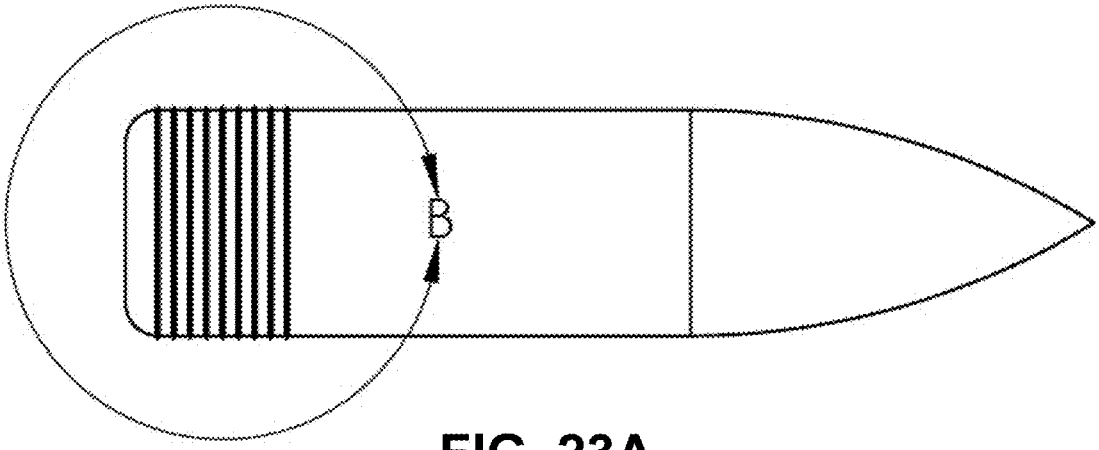
FIGS. 23A-23G are different views of a JSP. The circle region of FIG. 23A corresponds to the close-up view of the seal portion of the JSP illustrated in FIG. 23G.
Figure 23B:
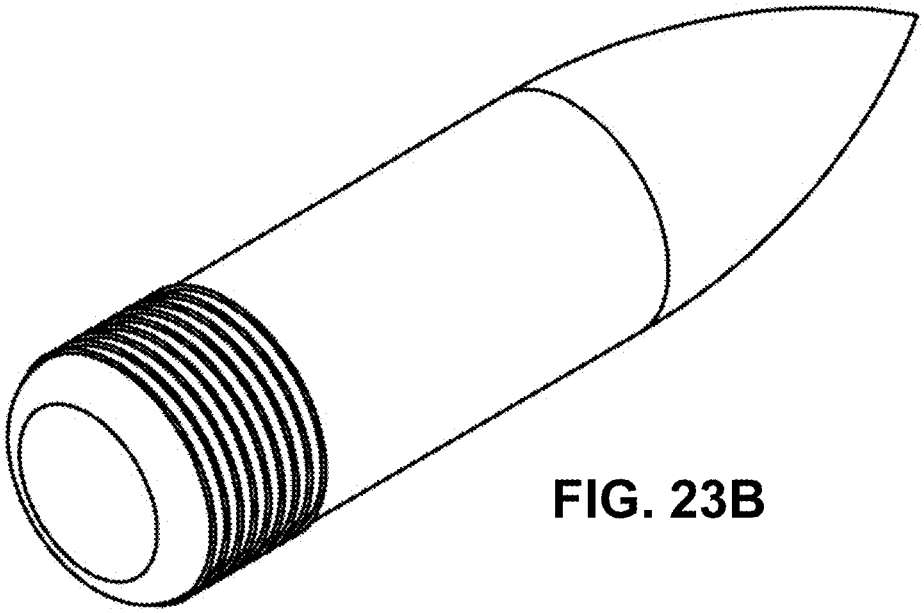
Figure 23C:
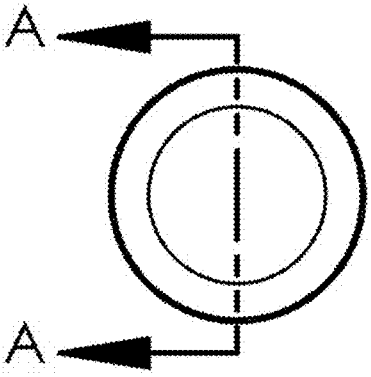
Figure 23D:
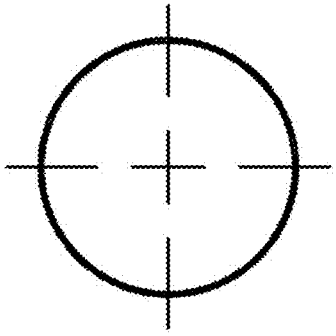
Figure 23E:
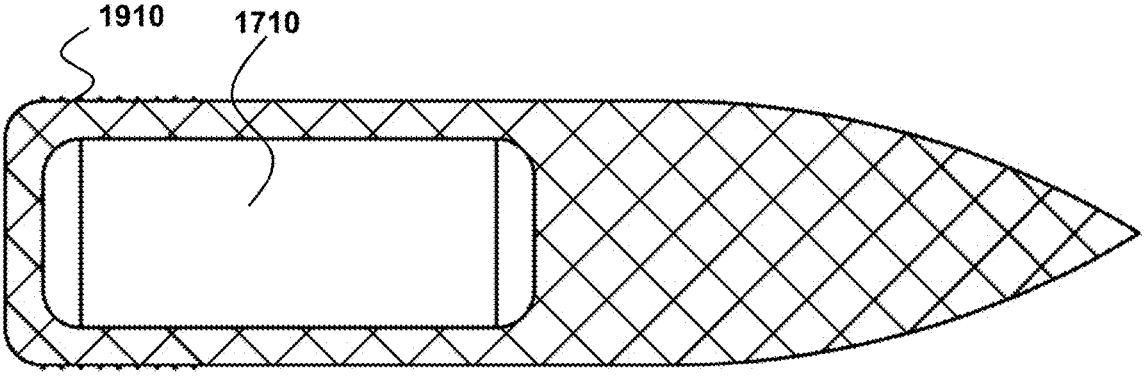
Figure 23F:
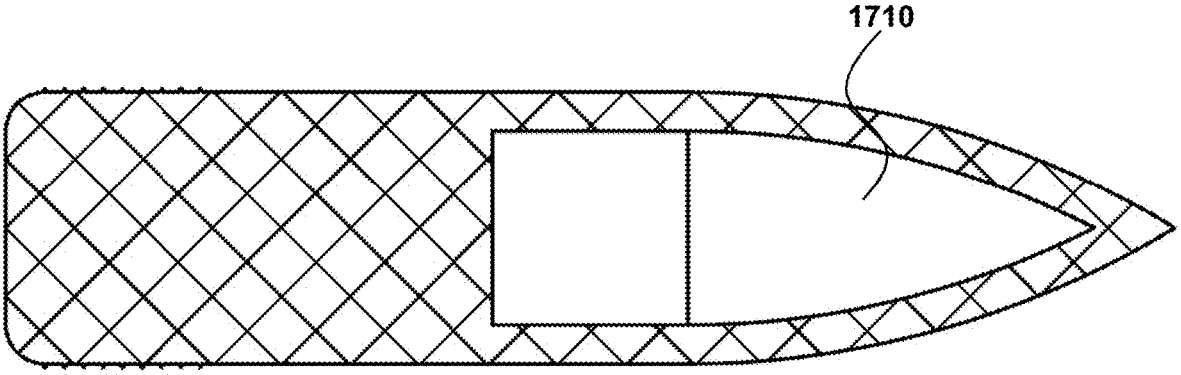
Figure 23G:
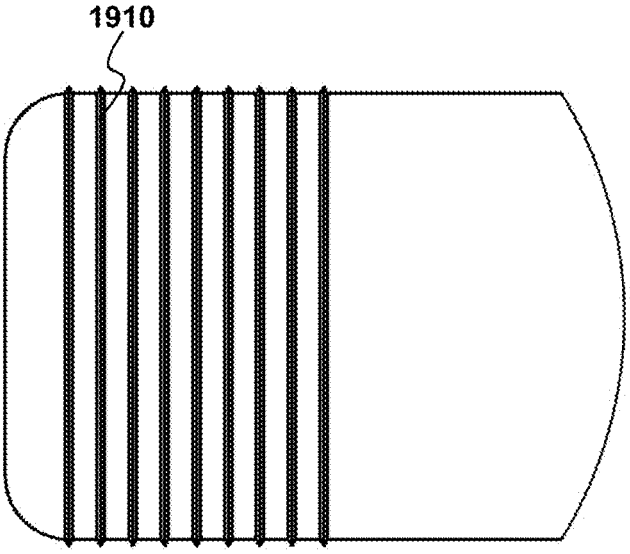
Figure 24A:
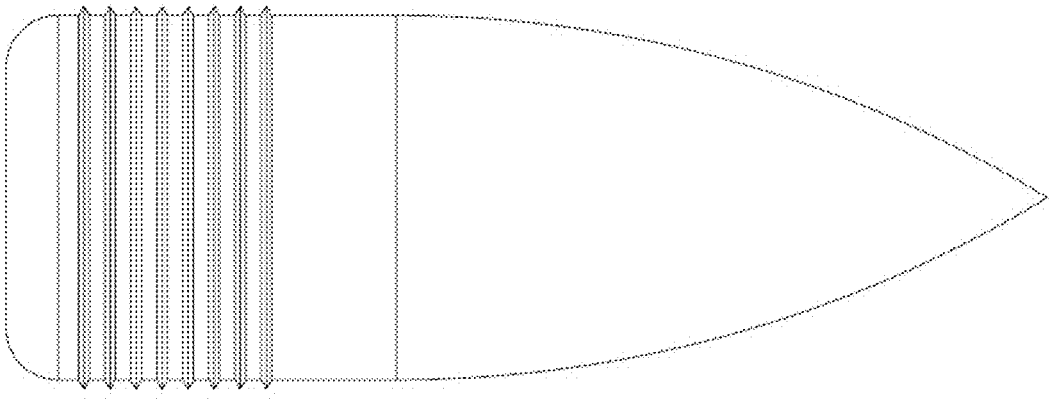
FIGS. 24A-24F are various views of another JSP configuration. Any JSP can be fully solid (non-porous and non-hollow), such the JSP of FIGS. 24A-24F.
Figure 24D:
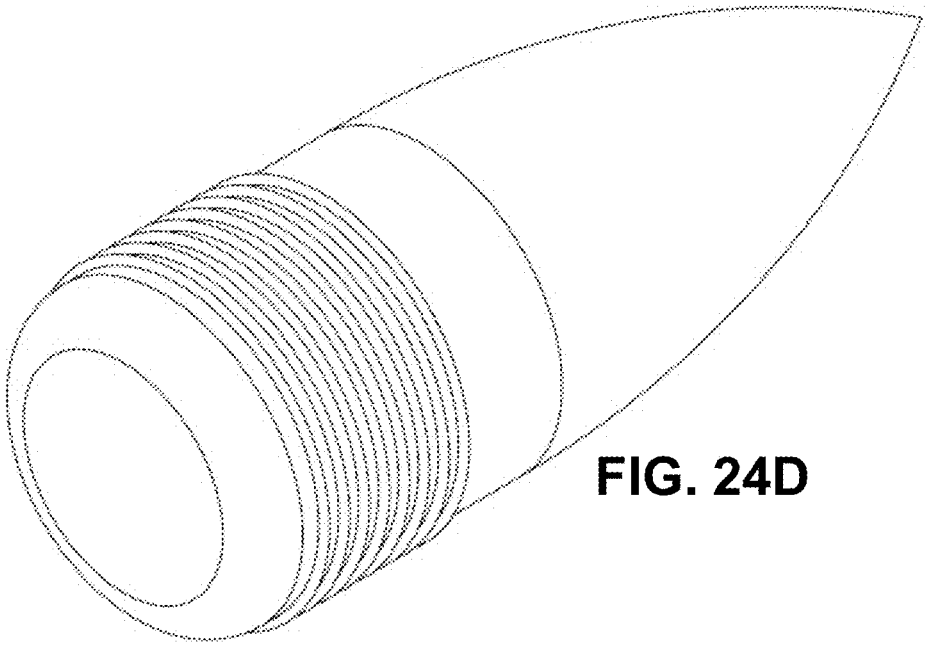
Figure 24C:
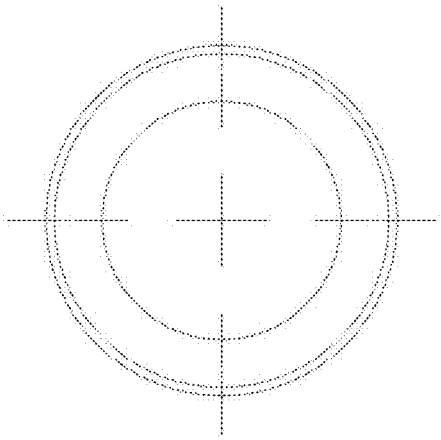
Figure 24B:
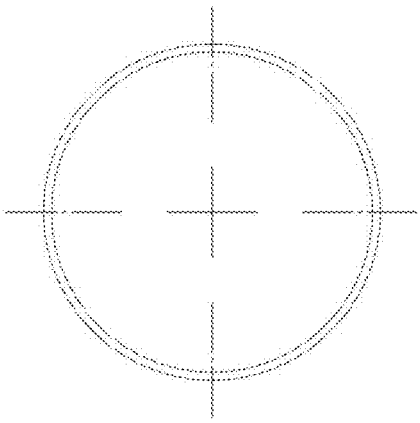
Figure 24E:
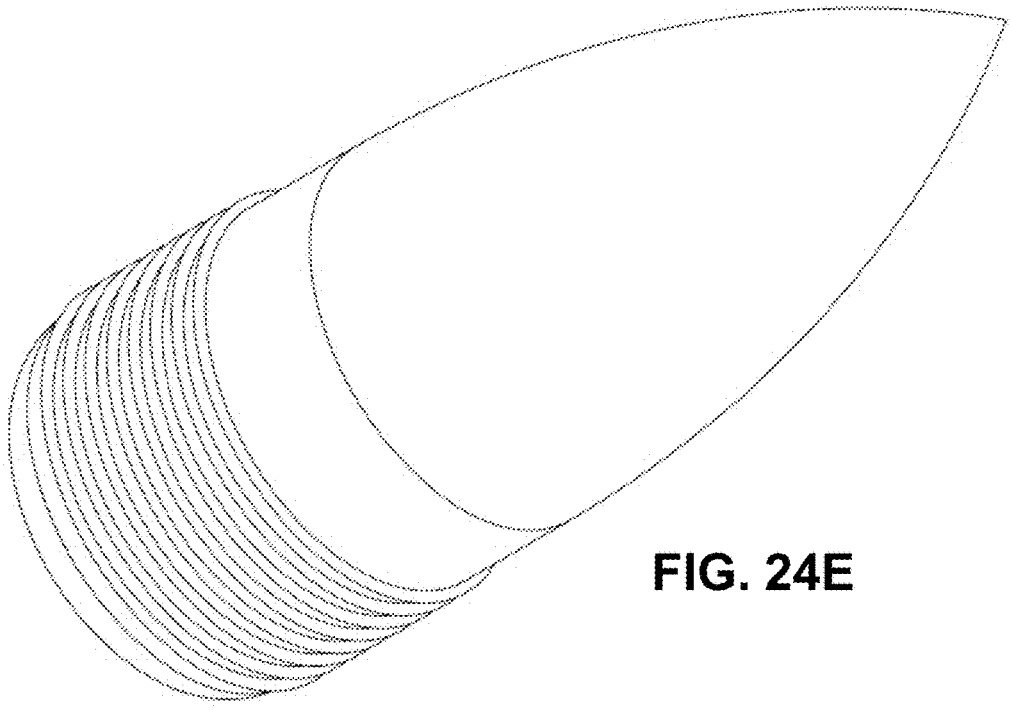
Figure 24F:
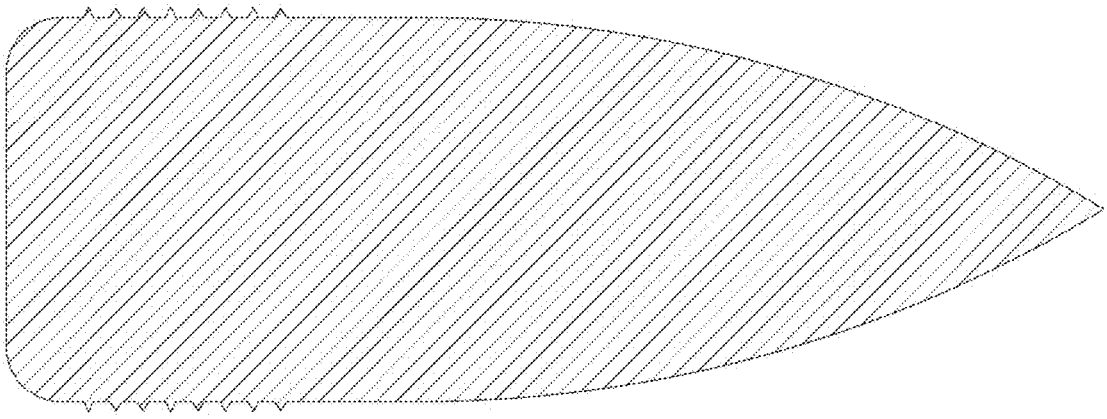

FIGS. 23A-23G are different views of a JSP. The circle region of FIG. 23A corresponds to the close-up view of the seal portion of the JSP illustrated in FIG. 23G. FIG. 23B is a perspective view. FIGS. 23C and 23D are end views of the proximal and distal ends of the JSP, respectively. The JSP may include a hollow internal region extending from the proximal region or the distal region, as shown in FIGS. 23E-23F, respectively. A JSP of this configuration can exhibit stable flight characteristics, for example.

FIGS. 24A-24F are different views of a JSP. Any JSP can be fully solid (non-porous and non-hollow), such the JSP of FIGS. 24A-24F.

Figure 25C:
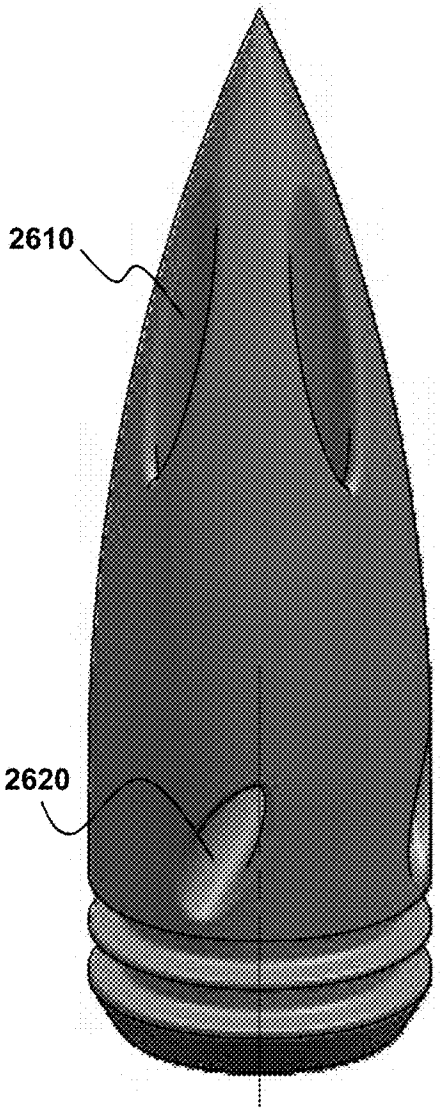
FIGS. 25A-25C are different views of a JSP according to certain embodiments. A JSP can include hollow air channels, such as the JSP of FIGS. 25A-25C to help facilitate desired flight characteristics. One or more hollow air channels can have any configuration, shape, path, etc., such as shown in FIGS. 25A-25C. Hollow air channels can provide for improved fluid-jet characteristics. Optionally, hollow air channels help facilitate a frangible JSP that can break upon target impact.
Figure 25B:
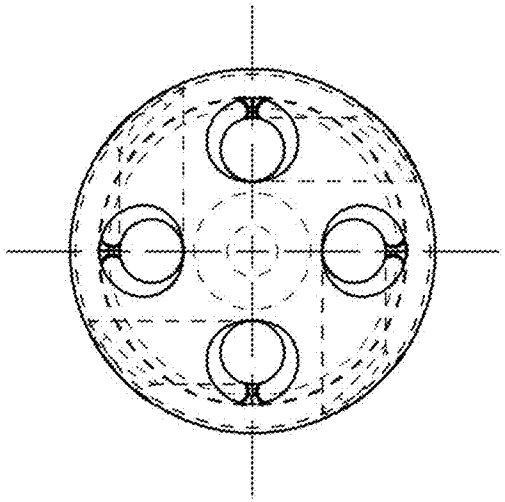
Figure 25A:
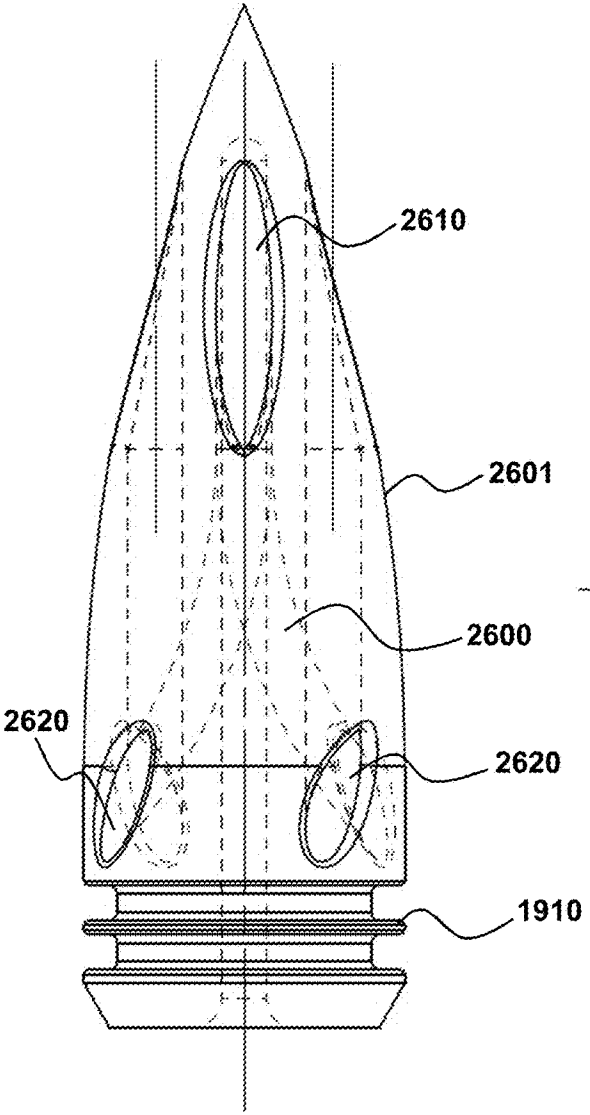

FIGS. 25A-25C are different views of a JSP. A JSP can include hollow air channels 2600, such as the JSP of FIGS. 25A-25C. One or more hollow air channels 2600 can have any configuration, shape, path, etc., such as shown in FIGS. 25A-25C, with an inlet 2610, an outlet 2620 formed from the JSP outer surface 2601. Hollow air channels are an additional independent means to achieve improved fluid-jet characteristics. In addition, hollow air channels can help facilitate a frangible JSP that can break upon target impact. FIG. 25C is a solid view and FIG. 25A is a transparent view of the JSP to help show air-flow channels through the JSP. FIG. 25B is an end view of the distal end of the JSP of FIG. 26A. As noted, a JSP can include protrusions and/or depressions 1910, such as the JSP of FIGS. 26A-26C, optionally at the proximal region, optionally for providing a fluidic plug in the barrel.

Figure 26C:
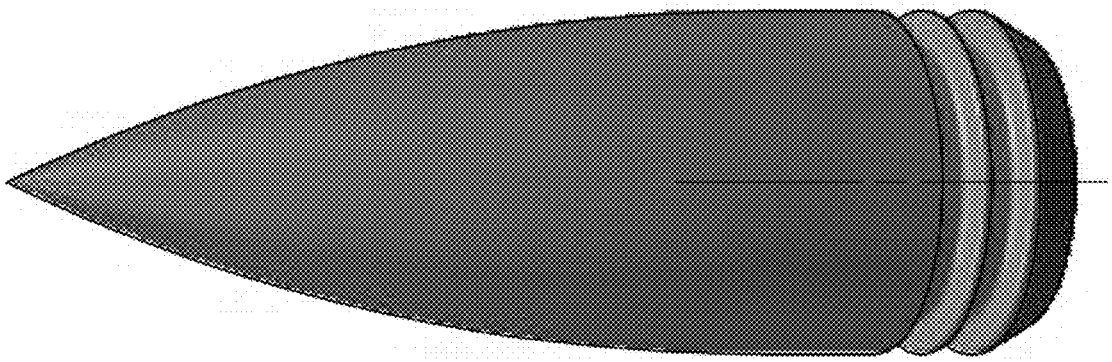
FIGS. 26A-26C are different views of a JSP according to certain embodiments. For example, the JSP of FIGS. 26A-26C is solid (non-hollow, non-porous) and free of hollow air channels, in contrast to the JSP of FIGS. 25A-25C.
Figure 26B:
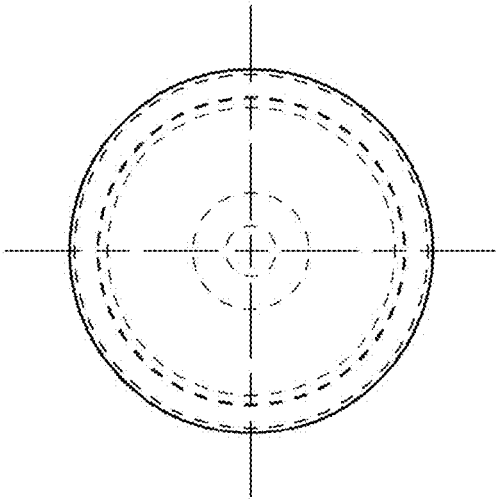
Figure 26A:
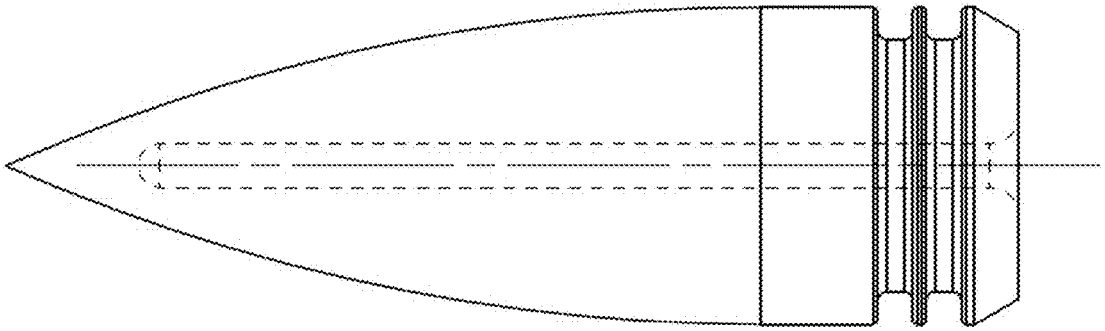

FIGS. 26A-26C are different views of a JSP. For example, the JSP of FIGS. 26A-26C is solid (non-hollow, non-porous) JSP free of hollow air channels, in contrast to the JSP of FIGS. 25A-25C.

Figure 27C:
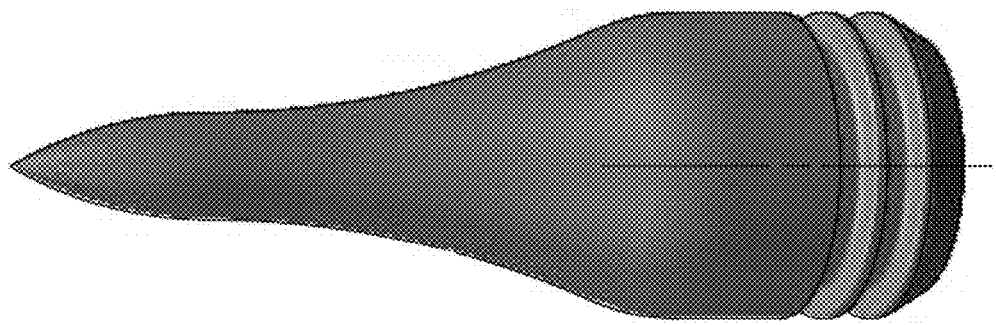
FIGS. 27A-27C are different views of a JSP according to certain embodiments. A JSP can have complex surface shapes, such as including both convex and concave regions, as illustrated in FIGS. 27A-27C.
Figure 27B:
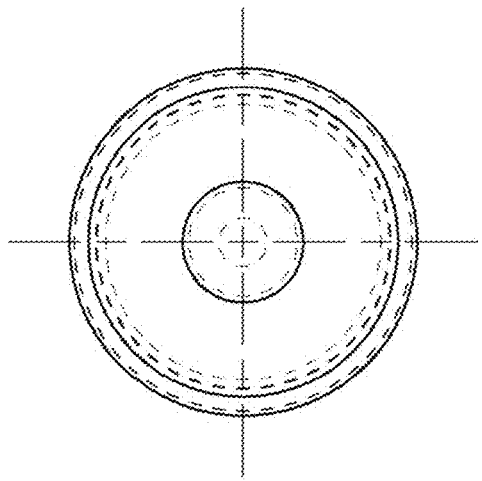
Figure 27A:
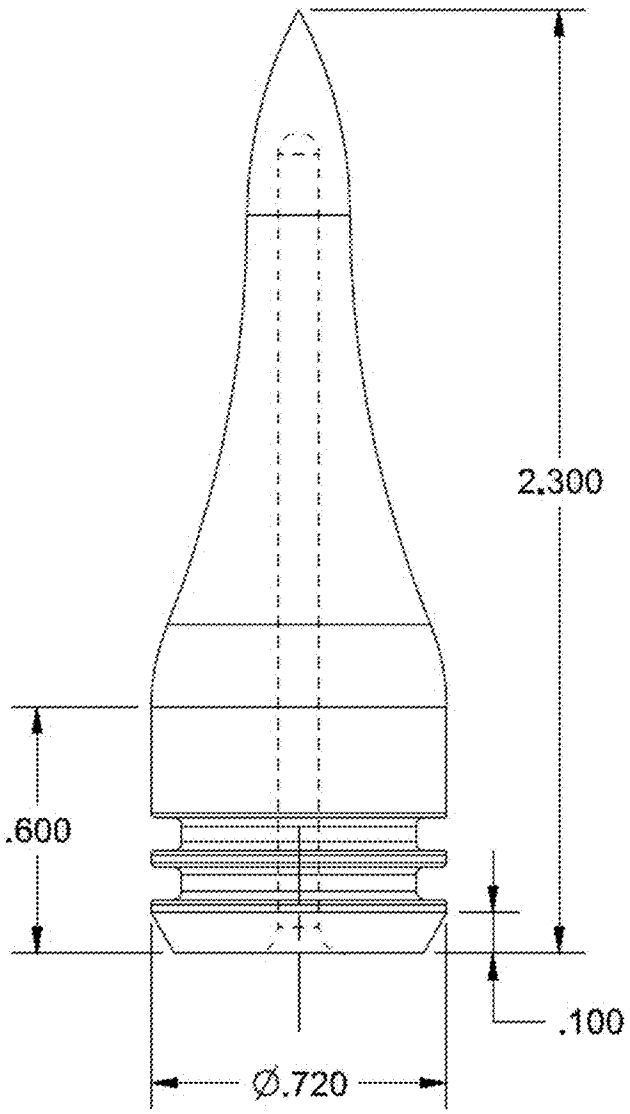
Figure 28:
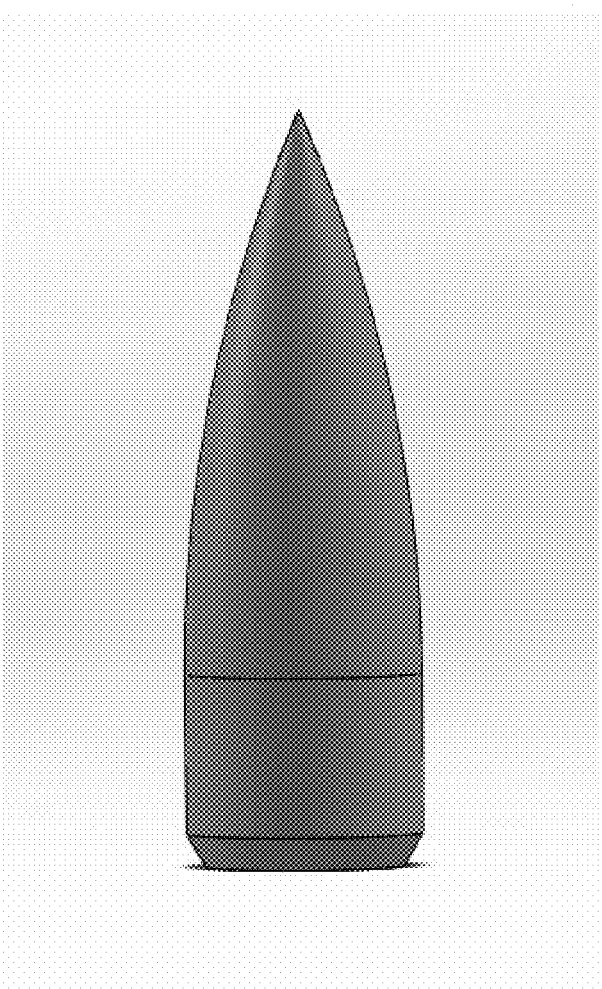
FIG. 28 is an exemplary JSP. The JSP of FIG. 28 includes an ogive shaped distal region.

FIGS. 27A-27C are different views of a JSP. A JSP can have complex surface shapes, such as including both convex and concave regions, as illustrated in FIGS. 27A-27C. FIG. 27A shows optional dimensions of a JSP in inches. The JSP of FIG. 28 includes an ogive shaped distal region.

Statements Regarding Incorporation by Reference and Variations

All references throughout this application, for example patent documents including issued or granted patents or equivalents; patent application publications; and non-patent literature documents or other source material are hereby incorporated by reference herein in their entireties, as though individually incorporated by reference, to the extent each reference is at least partially not inconsistent with the disclosure in this application (for example, a reference that is partially inconsistent is incorporated by reference except for the partially inconsistent portion of the reference).

The terms and expressions which have been employed herein are used as terms of description and not of limitation, and there is no intention in the use of such terms and expressions of excluding any equivalents of the features shown and described or portions thereof, but it is recognized that various modifications are possible within the scope of the invention claimed. Thus, it should be understood that although the present invention has been specifically disclosed by preferred embodiments, exemplary embodiments and optional features, modification and variation of the concepts herein disclosed may be resorted to by those skilled in the art, and that such modifications and variations are considered to be within the scope of this invention. The specific embodiments provided herein are examples of useful embodiments of the present invention and it will be apparent to one skilled in the art that the present invention may be carried out using a large number of variations of the devices, device components, methods and steps set forth in the present description. As will be obvious to one of skill in the art, methods and devices useful for the present embodiments can include a large number of optional device components, compositions, materials, combinations and processing elements and steps.

Every device, system, combination of components or method described or exemplified herein can be used to practice the invention, unless otherwise stated.

When a group of substituents is disclosed herein, it is understood that all individual members of that group and all subgroups, including any device components, combinations, materials and/or compositions of the group members, are disclosed separately. When a Markush group or other grouping is used herein, all individual members of the group and all combinations and subcombinations possible of the group are intended to be individually included in the disclosure.

Whenever a range is given in the specification, for example, a number range, a flow-rate range, a size range, a pressure range, a velocity range, a time range, or a composition or concentration range, all intermediate ranges and subranges, as well as all individual values included in the ranges given are intended to be included in the disclosure. It will be understood that any subranges or individual values in a range or subrange that are included in the description herein can be excluded from the claims herein.

All patents and publications mentioned in the specification are indicative of the levels of skill of those skilled in the art to which the invention pertains. References cited herein are incorporated by reference herein in their entirety to indicate the state of the art as of their publication or filing date and it is intended that this information can be employed herein, if needed, to exclude specific embodiments that are in the prior art.

As used herein, "comprising" is synonymous with "including," "containing," or "characterized by," and is inclusive or open-ended and does not exclude additional, unrecited elements or method steps. As used herein, "consisting of" excludes any element, step, or ingredient not specified in the claim element. As used herein, "consisting essentially of" does not exclude materials or steps that do not materially affect the basic and novel characteristics of the claim. In each instance herein any of the terms "comprising", "consisting essentially of" and "consisting of" may be replaced with either of the other two terms. The invention illustratively described herein suitably may be practiced in the absence of any element or elements and/or limitation or limitations, which are not specifically disclosed herein.

One of ordinary skill in the art will appreciate that compositions, materials, components, methods and/or processing steps other than those specifically exemplified can be employed in the practice of the invention without resort to undue experimentation. All art-known functional equivalents, of any such compositions, materials, components, methods and/or processing steps are intended to be included in this invention. The terms and expressions which have been employed are used as terms of description and not of limitation, and there is no intention in the use of such terms and expressions of excluding any equivalents of the features shown and described or portions thereof, but it is recognized that various modifications are within the scope of the invention claimed. Thus, it should be understood that although the present invention has been specifically disclosed by exemplary embodiments and optional features, modification and variation of the concepts herein disclosed may be resorted to by those skilled in the art, and that such modifications and variations are considered to be within the scope of this invention as defined by the appended claims.

It must be noted that as used herein and in the appended claims, the singular forms "a", "an", and "the" include plural reference unless the context clearly dictates otherwise. Thus, for example, reference to "a layer" includes a plurality of layers and equivalents thereof known to those skilled in the art, and so forth. As well, the terms "a" (or "an"), "one or more" and "at least one" can be used interchangeably herein. It is also to be noted that the terms "comprising", "including", and "having" can be used interchangeably. The expression "of any of claims XX-YY" (wherein XX and YY refer to claim numbers) is intended to provide a multiple dependent claim in the alternative form, and in some embodiments is interchangeable with the expression "as in any one of claims XX-YY."

Unless defined otherwise, all technical and scientific terms used herein have the same meanings as commonly understood by one of ordinary skill in the art to which this invention belongs. Although any methods and materials similar or equivalent to those described herein can be used in the practice or testing of the present invention, the preferred methods and materials are described.

I claim:

1. A propellant driven disrupter (PDD) for disrupting an explosive target, the PDD comprising:

a disrupter barrel having a breech end and a muzzle end;

a projectile liquid positioned in the disrupter barrel and extending a longitudinal distance in the disrupter barrel, wherein the projectile liquid has a distal end that is located farthest from the disrupter barrel breech end, wherein at least a portion of the projectile liquid is configured to form a fluid-jet when the projectile liquid is propelled out of the disrupter barrel; and a jet stabilizing projectile (JSP) at least partially positioned in the disrupter barrel and in operable contact with the projectile liquid distal end, wherein the JSP has:

a JSP proximal end facing toward the disrupter barrel breech end;

a JSP distal end opposed to the JSP proximal end; and wherein 50% to 100% of a longitudinal length of the JSP is positioned in the disrupter barrel;

wherein the JSP has an effective density that is within 20% of an effective density of the projectile liquid; and wherein the JSP has an outer surface shape characterized as spherical, hemispherical, spheroidal, ovoid, ogive, conical, parabolic, or any combination of these.

2. The PDD of claim 1, further comprising a seal positioned between an outer surface of the JSP and a lumen surface of the disrupter barrel, wherein the JSP and seal form a fluidic plug in the disrupter barrel.

3. The PDD of claim 1, wherein the proximal end of the JSP is in physical contact with the projectile liquid or the proximal end of the JSP is in physical contact with a distal end of a container, the container having the projectile liquid contained therein, and the proximal end of the JSP fluidically seals a proximal end of the container.

4. The PDD of claim 1, wherein the outer surface shape and the effective density of the JSP provides for the fluid-jet encapsulating at least the proximal end of the JSP after expulsion from the disrupter barrel and encapsulating between 10% to 75% of an outer surface of the JSP after expulsion from the disrupter barrel.

5. The PDD of claim 1, wherein the projectile liquid comprises water and the JSP has an effective density between 0.8 q/cm$^3$ and 1.5 g/cm$^3$.

6. The PDD of claim 1, wherein the projectile liquid comprises water or a HEET fluid having an effective density of between 0.5 g/mL and 15 g/mL at 20° C.

7. The PDD of claim 1, wherein the outer surface shape and the effective density of the JSP provides for a center of air pressure and a center of hydraulic pressure of the fluid-jet on the JSP are proximally located on the JSP relative to a center of gravity of the JSP.

8. The PDD of claim 1, wherein the JSP comprises at least one polymer material.

9. The PDD of claim 1, wherein the JSP is frangible, such that the JSP is fractured or disintegrated upon a target impact.

10. The PDD of claim 1, wherein the disrupter barrel has an air-space between the distal end of the JSP and the muzzle end of the disrupter barrel; and wherein the air-space corresponds to a length of the disrupter barrel selected from the range of 20% to 200% of a longitudinal length of the projectile liquid in the disrupter barrel.

11. The PDD of claim 1, further comprising a fluid jet enhancement adapter operably connected to the muzzle end of the disrupter barrel; wherein a length of the adapter is selected from the range of 20% to 200% of a longitudinal length of the projectile liquid in the disrupter barrel.

12. The PDD of claim 1, wherein the projectile liquid is water or a HEET fluid.

13. The PDD of claim 1, wherein the JSP proximal end is a flat back surface and the JSP distal end comprises a hemispherically-shaped portion, with a sharp corner shape transition defining the flat back surface, for both hydraulic and air drag stabilization upon the liquid projectile propelled out of the disrupter barrel.

14. The PDD of claim 1, further comprising an internal cavity and/or air channels formed in the JSP.

15. The PDD of claim 1, wherein the JSP has an effective density distribution to position a center of gravity in a more distal location, the JSP further comprising a dense material region inside of the JSP, the dense material region having a higher density than any other portion of the JSP with at least a portion of the dense material positioned toward a distal end of the JSP.

16. The PDD of claim 1, further comprising a rammer configured to receive a portion of the JSP and to force the JSP at least partially into the disrupter barrel and form a fluidic seal between the JSP and the disrupter barrel, wherein optionally a proximal end of the JSP having a seal extends out of the rammer and is configured to provide a press-fit seal with the disrupter barrel by user-applied force to the rammer in a direction toward the disrupter barrel.

17. A propellant driven disrupter (PDD) for disrupting an explosive target, the PDD comprising:

a disrupter barrel having a breech end and a muzzle end;

a projectile gas positioned in the disrupter barrel and extending a longitudinal distance in the disrupter barrel;

a jet stabilizing projectile (JSP) positioned in the disrupter barrel and in operable contact with the projectile gas, wherein the JSP has:

a JSP proximal end facing toward the disrupter barrel breech end;

a JSP distal end opposed to the JSP proximal end;

wherein the JSP distal end is separated from the disrupter barrel muzzle end or from a distal end of an adapter connected to the disrupter barrel muzzle end; and a center of gravity that is distally located relative to a center of pressure to provide air-drag stabilization upon the JSP propelled out of the disrupter barrel.

18. A method of stabilizing a fluid-jet projectile, the method comprising steps of:

loading a liquid projectile into a proximal portion of a disrupter barrel of a propellant driven disrupter (PDD) or leaving the proximal portion of the disrupter barrel filled with air;

inserting a jet stabilizing projectile (JSP) into a distal portion of the disrupter barrel, such that a proximal end of the JSP is in contact with the liquid projectile and the JSP forms a fluidic plug in the disrupter barrel or the proximal end of the JSP is separated from a breech end of the PDD by air; and exploding an explosive cartridge in a breech of the PDD, wherein the breech is operably connected to a proximal end of the disrupter barrel thereby propelling the projectile liquid or gas and the JSP out of the disrupter barrel and toward a target;

wherein the liquid of the liquid projectile forms a fluid-jet that continuously encapsulates at least a proximal portion of the JSP after the JSP is propelled out of the disrupter barrel, thereby improving flight stability of the JSP; and wherein after the JSP is propelled out of the disrupter barrel a center of gravity of the JSP is located distally relative to a center of pressure generated by airflow over the JSP, or the center of gravity of the JSP is located at the same point as the center of pressure generated by airflow over the JSP.

19. The method of claim 18, having one or more improved performance characteristics of the fluid-jet compared to a fluid-jet without the JSP;

wherein the one or more performance characteristics are selected from the group consisting of: reducing shock-waves in the fluid-jet, reducing pressure waves in the fluid-jet, increasing fluid-jet length at impact with the target, increasing fluid-jet impact duration, decreasing fluid-jet reverse velocity gradient, decreasing atomization of the fluid-jet, decreasing air drag on the fluid jet tip, decreasing cross-sectional area of the fluid-jet at impact, increasing target penetration depth, increasing barrier limit thickness, increasing momentum and energy transfer to the target, increasing volumetric destruction of the target, increasing stand-off distance while maintaining target disruption, decreasing penetration time, reducing risk of target explosive's shock initiation, and any combination thereof.

20. The method of claim 18, wherein the step of inserting the JSP comprises forming an air-space between a distal end of the JSP and a muzzle end of the disrupter barrel.

21. The method of claim 18, further comprising the step of: attaching a fluid jet enhancement adapter to a muzzle end of the disrupter barrel.

* * * * *